US007437778B2

(12) United States Patent
Parsons et al.

(10) Patent No.: US 7,437,778 B2
(45) Date of Patent: Oct. 21, 2008

(54) AUTOMATIC BATHROOM FLUSHERS

(75) Inventors: Natan E. Parsons, Brookline, MA (US); Fatih Guler, Winchester, MA (US); Kay Herbert, Winthrop, MA (US); Xiaoxiong Mo, Lexington, MA (US); Gregory P. Greene, Waltham, MA (US)

(73) Assignee: Arichell Technologies Inc., W. Newton, MA (US)

( * ) Notice: Subject to any disclaimer, the term of this patent is extended or adjusted under 35 U.S.C. 154(b) by 0 days.

(21) Appl. No.: 10/859,750

(22) Filed: Jun. 3, 2004

(65) Prior Publication Data

US 2005/0062004 A1 Mar. 24, 2005

Related U.S. Application Data

(63) Continuation of application No. PCT/US02/38758, filed on Dec. 4, 2002, which is a continuation-in-part of application No. 10/012,252, filed on Dec. 4, 2001, now Pat. No. 6,691,979, and a continuation-in-part of application No. 10/012,226, filed on Dec. 4, 2001, now Pat. No. 6,619,614, and a continuation-in-part of application No. 10/011,390, filed on Dec. 4, 2001.

(60) Provisional application No. 60/012,252, filed on Mar. 5, 2002, provisional application No. 60/391,282, filed on Jun. 24, 2002, provisional application No. 60/424,378, filed on Nov. 6, 2002.

(51) Int. Cl.
*F16K 31/02* (2006.01)

(52) U.S. Cl. ..... 4/249; 251/129.04; 251/129.15; 251/129.17; 137/554; 4/304; 4/305; 4/313; 250/221

(58) Field of Classification Search ..... 251/129.04, 251/129.15, 30.01–30.05, 129.17; 361/160; 137/554; 4/249, 302, 304, 305, 313; 250/221
See application file for complete search history.

(56) References Cited

U.S. PATENT DOCUMENTS

| | | | | |
|---|---|---|---|---|
| 207,482 | A | 8/1878 | Blessing | 137/188 |
| 1,501,331 | A | 7/1924 | Gulick | 137/245 |
| 2,471,328 | A | 5/1949 | Jones | 137/403 |
| 2,619,122 | A | 11/1952 | Hunter | 251/120 |
| 2,619,986 | A | 12/1952 | Goepfrich et al. | 251/129.17 |
| 2,685,301 | A | 8/1954 | Dreier | 137/386 |
| 2,827,073 | A | 3/1958 | Owens | 137/426 |
| 2,842,400 | A | 7/1958 | Booth et al. | 239/569 |
| 2,877,791 | A | 3/1959 | Rich | 137/487 |

(Continued)

FOREIGN PATENT DOCUMENTS

EP 0848193 A1 6/1998

(Continued)

*Primary Examiner*—John Bastianelli
(74) *Attorney, Agent, or Firm*—Ivan David Zitkovsky

(57) ABSTRACT

An automatic bathroom flusher includes a body having an inlet in communication with a supply line and an outlet in communication with a flush conduit, a valve assembly in the body positioned to close water flow between the inlet and the outlet upon sealing action of a moving member at a valve seat thereby controlling flow from the inlet to the outlet, an actuator for actuating operation of the moving member, and a controller.

33 Claims, 36 Drawing Sheets

U.S. PATENT DOCUMENTS

| | | | | | |
|---|---|---|---|---|---|
| 2,923,314 | A | | 2/1960 | Badger, Jr. et al. | 137/414 |
| 2,986,155 | A | | 5/1961 | Doyle | 137/218 |
| 2,999,191 | A | | 9/1961 | Muradian et al. | 361/195 |
| 3,019,453 | A | | 2/1962 | Radcliffe | 4/249 |
| 3,034,151 | A | | 5/1962 | Filliung | 4/249 |
| 3,056,143 | A | | 10/1962 | Foster | 4/249 |
| 3,058,485 | A | | 10/1962 | McQueen | 137/403 |
| 3,098,635 | A | | 7/1963 | Delaporte et al. | 251/54 |
| 3,242,940 | A | | 3/1966 | Sirotek | 137/218 |
| 3,254,664 | A | | 6/1966 | Delaney et al. | 137/244 |
| 3,285,261 | A | | 11/1966 | Chaney | 137/505.12 |
| 3,318,565 | A | | 5/1967 | Cutler | 251/45 |
| 3,369,205 | A | | 2/1968 | Hamrick | 335/177 |
| 3,373,449 | A | | 3/1968 | Rusnok | 4/305 |
| 3,386,462 | A | | 6/1968 | Walters | 137/244 |
| 3,400,731 | A | | 9/1968 | McCormack | 137/245 |
| 3,429,333 | A | | 2/1969 | Schoepe et al. | |
| 3,495,803 | A | | 2/1970 | Schoepe et al. | 251/25 |
| 3,495,804 | A | | 2/1970 | Muller et al. | 251/36 |
| 3,559,675 | A | | 2/1971 | Schoepe et al. | 137/436 |
| 3,586,017 | A | | 6/1971 | Walters | 137/59 |
| 3,606,241 | A | | 9/1971 | Bornholdt | 251/52 |
| 3,693,649 | A | | 9/1972 | Gordon et al. | 137/414 |
| 3,740,019 | A | | 6/1973 | Kessell et al. | 251/129.17 |
| 3,763,881 | A | | 10/1973 | Jones | 137/414 |
| 3,778,023 | A | | 12/1973 | Billeter | 251/30.01 |
| 3,791,619 | A | | 2/1974 | Pett | 251/45 |
| 3,802,462 | A | | 4/1974 | Trösch | 137/556 |
| 3,812,398 | A | | 5/1974 | Kozel et al. | 251/331 |
| 3,821,967 | A | | 7/1974 | Sturman | 137/624.15 |
| 3,842,857 | A | | 10/1974 | McCornack | 137/242 |
| 3,895,645 | A | | 7/1975 | Johnson | 137/403 |
| 4,010,769 | A | | 3/1977 | De Lorenzo et al. | 137/312 |
| 4,065,095 | A | | 12/1977 | Johnson | 251/118 |
| 4,097,786 | A | | 6/1978 | Lund | 318/282 |
| 4,105,186 | A | | 8/1978 | Eby | 251/35 |
| 4,135,696 | A | | 1/1979 | Saarem et al. | 251/30.02 |
| 4,141,091 | A | | 2/1979 | Pulvari | 4/313 |
| 4,206,901 | A | | 6/1980 | Williams | 251/35 |
| 4,231,287 | A | | 11/1980 | Smiley | 92/94 |
| 4,272,052 | A | | 6/1981 | Gidner | 251/39 |
| 4,280,680 | A | | 7/1981 | Payne | 251/175 |
| 4,295,485 | A | | 10/1981 | Waterfield | 137/74 |
| 4,295,631 | A | | 10/1981 | Allen | 251/30.03 |
| 4,295,653 | A | | 10/1981 | Coles | 277/320 |
| 4,304,391 | A | | 12/1981 | Yamaguchi | 251/129.05 |
| 4,309,781 | A | | 1/1982 | Lissau | 4/304 |
| 4,383,234 | A | | 5/1983 | Yatsushiro et al. | 335/253 |
| 4,488,702 | A | | 12/1984 | Lapeyre | 251/46 |
| 4,505,451 | A | | 3/1985 | Jonas | 251/285 |
| 4,570,272 | A | | 2/1986 | Kawaguchi et al. | 4/302 |
| 4,597,895 | A | | 7/1986 | Bartlett | 252/392 |
| 4,599,892 | A | * | 7/1986 | Doshi | 73/49.2 |
| 4,604,735 | A | | 8/1986 | Parsons | 367/93 |
| 4,609,178 | A | | 9/1986 | Baumann | 251/229 |
| 4,611,356 | A | | 9/1986 | Lin | 4/301 |
| 4,651,777 | A | * | 3/1987 | Hardman | 251/129.04 |
| 4,690,120 | A | * | 9/1987 | Egle | 123/568.16 |
| 4,709,427 | A | | 12/1987 | Laverty, Jr. | 4/427 |
| 4,713,847 | A | * | 12/1987 | Oldfelt et al. | 251/61.1 |
| 4,729,342 | A | | 3/1988 | Loctin | 119/163 |
| 4,756,031 | A | | 7/1988 | Barrett | 4/407 |
| 4,787,411 | A | | 11/1988 | Moldenhauer | 137/244 |
| 4,793,588 | A | | 12/1988 | Laverty, Jr. | 251/30.03 |
| 4,796,662 | A | | 1/1989 | Hoffmann et al. | 137/596.16 |
| 4,805,247 | A | | 2/1989 | Laverty, Jr. | 4/304 |
| 4,823,414 | A | | 4/1989 | Piersimoni et al. | 4/623 |
| 4,823,825 | A | | 4/1989 | Buchl | 137/1 |
| 4,826,132 | A | | 5/1989 | Moldenhauer | 251/129.17 |
| 4,832,582 | A | | 5/1989 | Buffet | 417/413.1 |
| 4,839,039 | A | | 6/1989 | Parsons et al. | 210/143 |
| 4,887,032 | A | | 12/1989 | Hetrick | 324/207.16 |
| 4,891,864 | A | | 1/1990 | Laverty, Jr. | 91/399 |
| 4,893,645 | A | | 1/1990 | Augustinas et al. | 137/315.03 |
| 4,894,698 | A | | 1/1990 | Hijikigawa et al. | 257/254 |
| 4,894,874 | A | | 1/1990 | Wilson | 4/623 |
| 4,910,487 | A | | 3/1990 | Kleinhappl | 335/234 |
| 4,911,401 | A | | 3/1990 | Holcomb et al. | 251/30.03 |
| 4,921,208 | A | | 5/1990 | LaMarca | 251/30.04 |
| 4,921,211 | A | | 5/1990 | Novak et al. | 251/129.04 |
| 4,932,430 | A | | 6/1990 | Fernstrom | 137/85 |
| 4,941,215 | A | | 7/1990 | Liu | 4/406 |
| 4,941,219 | A | | 7/1990 | Van Marcke | 4/623 |
| 4,944,487 | A | | 7/1990 | Holtermann | 251/129.17 |
| 4,977,929 | A | | 12/1990 | Chinnock et al. | 137/863 |
| 4,988,074 | A | | 1/1991 | Najmolhoda | 251/129.08 |
| 4,989,277 | A | * | 2/1991 | Tsutsui et al. | 251/129.06 |
| 4,998,673 | A | | 3/1991 | Pilolla | 239/67 |
| 5,025,516 | A | | 6/1991 | Wilson | 4/623 |
| 5,027,850 | A | | 7/1991 | Peterson et al. | 137/245 |
| 5,032,812 | A | | 7/1991 | Banick et al. | 335/17 |
| 5,036,553 | A | | 8/1991 | Sanderson | 4/313 |
| 5,074,520 | A | | 12/1991 | Lee et al. | 251/40 |
| 5,109,885 | A | | 5/1992 | Tauscher | 137/596.17 |
| 5,125,621 | A | | 6/1992 | Parsons et al. | 251/30.03 |
| 5,127,625 | A | | 7/1992 | Kleinhappl | 251/129.17 |
| 5,169,118 | A | | 12/1992 | Whiteside | 251/30.03 |
| 5,188,337 | A | | 2/1993 | Mertens et al. | 251/129.17 |
| 5,195,720 | A | | 3/1993 | Nortier et al. | 251/129.04 |
| 5,213,303 | A | | 5/1993 | Walker | 251/30.02 |
| 5,213,305 | A | | 5/1993 | Whiteside et al. | 251/40 |
| 5,224,685 | A | | 7/1993 | Chiang et al. | 251/129.04 |
| 5,232,194 | A | | 8/1993 | Saadi et al. | 251/40 |
| 5,244,179 | A | | 9/1993 | Wilson | 251/30.03 |
| 5,245,024 | A | | 9/1993 | Scarpa et al. | 536/56 |
| 5,251,188 | A | | 10/1993 | Parsons et al. | 367/140 |
| 5,265,594 | A | | 11/1993 | Olsson et al. | 128/204.18 |
| 5,265,843 | A | | 11/1993 | Kleinhappl | 251/129.17 |
| 5,295,655 | A | | 3/1994 | Wilson et al. | 251/40 |
| 5,313,673 | A | | 5/1994 | Saadi et al. | 4/313 |
| 5,315,719 | A | | 5/1994 | Tsutsui et al. | 4/300 |
| 5,335,694 | A | | 8/1994 | Whiteside | 137/625.37 |
| 5,362,026 | A | * | 11/1994 | Kobayashi et al. | 251/30.02 |
| 5,375,811 | A | | 12/1994 | Reinicke | 251/129.16 |
| D354,113 | S | | 1/1995 | Wortier et al. | D23/233 |
| D355,478 | S | | 2/1995 | Allen et al. | D23/249 |
| 5,408,369 | A | | 4/1995 | Miura et al. | 360/75 |
| D357,976 | S | | 5/1995 | Allen et al. | D23/249 |
| 5,412,816 | A | | 5/1995 | Paterson et al. | 4/623 |
| 5,431,181 | A | | 7/1995 | Saadi et al. | 137/15.11 |
| 5,433,245 | A | | 7/1995 | Prather et al. | 137/554 |
| 5,456,279 | A | | 10/1995 | Parsons et al. | 137/245 |
| 5,460,196 | A | * | 10/1995 | Yonnet | 251/29 |
| 5,474,303 | A | | 12/1995 | Coles | 277/317 |
| 5,481,187 | A | | 1/1996 | Marcott et al. | 324/207.16 |
| 5,508,510 | A | | 4/1996 | Laverty et al. | 250/221 |
| 5,520,217 | A | * | 5/1996 | Grawunde | 251/30.01 |
| 5,539,198 | A | | 7/1996 | McMichael et al. | 250/221 |
| 5,548,119 | A | | 8/1996 | Nortier | 250/341.1 |
| 5,553,827 | A | * | 9/1996 | Perkey | 251/30.01 |
| 5,555,912 | A | | 9/1996 | Saadi et al. | 137/801 |
| 5,566,702 | A | | 10/1996 | Philipp | 137/1 |
| 5,574,617 | A | | 11/1996 | Shimanuki et al. | 361/154 |
| 5,583,434 | A | | 12/1996 | Moyers et al. | 324/207.16 |
| 5,584,465 | A | | 12/1996 | Ochsenreiter | 251/65 |
| 5,600,237 | A | | 2/1997 | Nippert | 324/207.16 |
| 5,625,150 | A | * | 4/1997 | Greene et al. | 73/649 |
| 5,636,601 | A | | 6/1997 | Moriya et al. | 123/90.11 |
| 5,668,366 | A | | 9/1997 | Mauerhofer | 250/221 |
| 5,680,879 | A | | 10/1997 | Sheih et al. | 137/240 |
| 5,708,355 | A | | 1/1998 | Schrey | 323/282 |
| 5,716,038 | A | | 2/1998 | Scarffe | 251/30.03 |
| 5,747,684 | A | | 5/1998 | Pace et al. | 73/119 A |
| D396,090 | S | | 7/1998 | Marcichow et al. | D23/233 |

| | | | | |
|---|---|---|---|---|
| 5,785,955 | A | 7/1998 | Fischer | 424/49 |
| 5,787,915 | A | 8/1998 | Byers et al. | 137/1 |
| 5,787,924 | A | 8/1998 | Cewers et al. | 137/487.5 |
| 5,797,360 | A | 8/1998 | Pischinger et al. | 123/90.11 |
| 5,804,962 | A | 9/1998 | Kather et al. | 324/207.16 |
| 5,815,362 | A | 9/1998 | Kahr et al. | 361/153 |
| 5,819,336 | A | 10/1998 | Gilliam et al. | 4/623 |
| 5,881,993 | A | 3/1999 | Wilson et al. | 251/40 |
| 5,887,848 | A | 3/1999 | Wilson | 251/40 |
| 5,900,201 | A | 5/1999 | Chatterjee et al. | 264/109 |
| 5,901,384 | A | 5/1999 | Sim | 4/313 |
| 5,905,625 | A | 5/1999 | Schebitz | 361/154 |
| 5,941,505 | A | 8/1999 | Nagel | 251/335.2 |
| 5,950,983 | A | 9/1999 | Jahrling | 251/129.04 |
| 5,964,192 | A | 10/1999 | Ishii | 123/90.11 |
| 5,967,182 | A | 10/1999 | Wilson | 137/544 |
| 5,979,500 | A | 11/1999 | Jahrling et al. | 137/624.12 |
| 5,984,262 | A | 11/1999 | Parsons et al. | 251/129.04 |
| 5,996,965 | A | 12/1999 | Eichholz et al. | 251/30.05 |
| 6,000,674 | A | 12/1999 | Cheng | 251/26 |
| 6,003,170 | A | 12/1999 | Humpert et al. | 4/623 |
| 6,024,059 | A | 2/2000 | Kamimaru et al. | 123/90.11 |
| 6,044,814 | A | 4/2000 | Fuwa | 123/90.11 |
| 6,056,261 | A | 5/2000 | Aparicio et al. | 251/129.03 |
| 6,073,904 | A | 6/2000 | Diller et al. | 251/30.03 |
| 6,076,550 | A * | 6/2000 | Hiraishi et al. | 251/30.03 |
| 6,127,671 | A | 10/2000 | Parsons et al. | 250/221 |
| 6,155,231 | A | 12/2000 | Adachi et al. | 123/399 |
| 6,158,715 | A | 12/2000 | Kirschbaum | 251/129.06 |
| 6,161,726 | A | 12/2000 | Parsons et al. | 222/52 |
| 6,182,689 | B1 | 2/2001 | Lauer et al. | 137/550 |
| 6,212,697 | B1 | 4/2001 | Parsons et al. | 4/302 |
| 6,216,730 | B1 | 4/2001 | Hall | 137/550 |
| 6,227,219 | B1 | 5/2001 | Pino | 137/1 |
| 6,250,601 | B1 * | 6/2001 | Kolar et al. | 251/129.04 |
| 6,260,576 | B1 | 7/2001 | Allen | 137/550 |
| 6,273,394 | B1 | 8/2001 | Vincent et al. | 251/129.04 |
| 6,293,516 | B1 | 9/2001 | Parsons et al. | 251/129.04 |
| 6,299,127 | B1 | 10/2001 | Wilson | 251/38 |
| 6,305,662 | B1 * | 10/2001 | Parsons et al. | 251/129.04 |
| 6,340,032 | B1 | 1/2002 | Zosimadis | 137/552 |
| 6,353,942 | B1 | 3/2002 | Pondelick et al. | 4/431 |
| 6,367,096 | B1 | 4/2002 | Quintana | 4/427 |
| 6,382,586 | B1 | 5/2002 | Wilson et al. | 251/40 |
| 6,394,414 | B1 * | 5/2002 | Breitling et al. | 251/129.04 |
| 6,450,478 | B2 | 9/2002 | Parsons et al. | 251/129.04 |
| 6,609,698 | B1 | 8/2003 | Parsons et al. | 251/129.17 |
| 6,619,614 | B2 | 9/2003 | Parsons et al. | 251/129.04 |
| 6,643,853 | B2 | 11/2003 | Wilson et al. | 4/249 |
| 6,669,909 | B2 * | 12/2003 | Shvets et al. | 251/129.08 |
| 6,685,158 | B2 | 2/2004 | Parsons | 251/30.01 |

FOREIGN PATENT DOCUMENTS

| | | |
|---|---|---|
| GB | 1532210 | 11/1978 |
| WO | WO 97/04262 | 2/1997 |

* cited by examiner

| |
|---|
| FIG. 2A |
| FIG. 2B |

| |
|---|
| FIG. 2A |
| FIG. 3B |

AUTOMATIC BATHROOM FLUSHERS

This application is a continuation of PCT Application PCT/US02/38758 filed Dec. 4, 2002, which is a continuation-in-part of U.S. Application Ser. No. 10/012,252, entitled "Adaptive Object-Sensing System for Automatic Flushers" filed on Dec. 4, 2001 now U.S. Pat. No. 6,691,979; U.S. Application Ser. No. 10/012,226, entitled "Automatic Flow Controller Employing Energy-Conservation Mode" filed on Dec. 4, 2001 now U.S. Pat. No. 6,619,614; U.S. Application Ser. No. 10/011,390, entitled "Assembly of Solenoid controlled Pilot-Operated Valve" filed on Dec. 4, 2001; U.S. Application Ser. No. 60/012,252, entitled "Controlling a Solenoid Based on Current Time Profile" filed on Mar. 5, 2002; U.S. Application Ser. No. 60/391,282, entitled "High Flow-Rate Diaphragm Valve And Control Method" filed on Jun. 24, 2002; and U.S. Application Ser. No. 60/424,378 entitled "Automatic Bathroom Flushers for Long-Term Operation" filed on Nov. 6, 2002; all of which are incorporated by reference.

BACKGROUND OF THE INVENTION

1. Field of the Invention

The present invention is directed to automatic bathroom flushers and methods for operating and controlling such flushers.

2. Background Information

Automatic flow-control systems have become increasingly prevalent, particularly in public rest-room facilities, both toilets and urinals. Automatic faucets and flushers contribute to hygiene, facility cleanliness, and water conservation. In such systems, object sensors detect the user and operate a flow-control valve in response to user detection. In the case of an automatic faucet, for instance, presence or motion of a user's hands in the faucet's vicinity normally results in flow from the faucet. In the case of an automatic flusher, detection of the fact that a user has approached the facility and then left is typically what triggers flushing action.

Although the concept of such object-sensor-based automatic flow control is not new, its use has been quite limited until recently. The usage is becoming more widespread due to the recent availability of battery-powered conversion kits. These kits make it possible for manual facilities to be converted into automatic facilities through simple part replacements that do not require employing electricians to wire the system to the supply grid. A consequence of employing such battery-powered systems is that the batteries eventually need to be replaced.

There is still a need for automatic flushers that are highly reliable and can operate for a long time without any service or just minimal service.

SUMMARY OF THE INVENTION

The described inventions are directed to automatic bathroom flushers and methods for operating and controlling such flushers.

According to one aspect, the present invention is a bathroom flusher. The bathroom flusher includes a body, a valve assembly, and an actuator. The body has an inlet and an outlet, and the valve assembly is located in the body and positioned to close water flow between the inlet and the outlet upon sealing action of a moving member at a valve seat thereby controlling flow from the inlet to the outlet. The actuator actuates operation of the moving member.

The moving member may be a high flow rate fram member, or a standard diaphragm, or a piston. The bathroom flusher may further include an infra-red sensor assembly for detecting urinal or toilet user. The bathroom flusher may further include different types of electromechanical, hydraulic, or only mechanical actuators.

According to another aspect, the present invention is a bathroom flusher that includes a cover mounted upon said body and defining a pressure chamber with the valve assembly. The bathroom flusher may further include a flexible member fixed relative to the cover at one end thereof, the other end of the flexible member being attached to a movable member of the valve assembly, wherein there is a passage in said flexible member arranged to reduce pressure in said pressure chamber. The flexible member may be a hollow tube.

Preferably, the bathroom flusher may include an automatic flow-control system. The automatic flow-control system may employ infrared-light-type object sensors.

Another important aspect of the present inventions is a novel design of an infrared-light-type object sensor including an indicator. In the IR sensor, an IR source (typically an infrared-light-emitting diode) is positioned behind an infrared-light-transmitting aperture as to transmit the infrared light into a target region. The indicator may be a visible-light-emitting diode included in an LED-combination device in which it is connected antiparallel to the infrared-light-emitting diode. When the combination device is driven in one direction, the infrared source shines normally through an appropriate aperture. When the device is driven in the other direction, visible light instead shines through the same aperture as the infrared light did. This arrangement avoids separate provisions for the visible light's location or transmission.

Yet another important aspect of the present inventions is a novel algorithm for operating an automatic flusher. The automatic flusher employs an infrared-light-type object sensor for providing an output on the basis of which a control circuit decides whether to flush a toilet. After each pulse of transmitted radiation, the control circuit determines if the resultant percentage of reflected radiation differs significantly from the last, and determines whether the percentage change was positive or negative. From the determined subsequent data having a given direction and the sums of the values, the control circuit determines whether a user has approached the facility and then withdrawn from it. Based on this determination, the controller operates the flusher's valve. That is, the control circuit determines the flush criteria based on whether a period in which the reflection percentage decreased (in accordance with appropriate withdrawal criteria) has been preceded by a period in which the reflection percentage increased (in accordance with appropriate approach criteria). In this embodiment, the control circuit does not base its determination of whether the user has approached the toilet on whether the reflection percentage has exceeded a predetermined threshold, and it does not base a determination of whether the user has withdrawn from the toilet on whether the reflection percentage has fallen below a predetermined threshold.

Yet another important aspect of the present inventions is novel system and method for storing or shipping the above-described automatic flushers. The automatic flushers may include an object sensor (e.g., an IR sensor) and a manual a push button actuator. When the flusher is operational, the push button is designed for a user to provide signal to the control circuit to open the flusher's valve. However, if the button actuator has been pressed continually for an extended period, the control circuit assumes a sleep mode, in which its power consumption is negligible. A storage or shipping container may be designed to activate the button actuator while the container is closed. As a consequence, the flusher can be packed with the control circuit's batteries installed without draining those batteries significantly during shipping and storage. Alternatively, the storage or shipping container may include an external magnet cooperatively arranged together with a reed sensor connected to the control circuit. If the magnet continually activates the reed sensor for an extended period, the control circuit assumes the sleep mode, in which its power consumption is negligible. There are also other "sleep mode inducing" devices that allow batteries to be installed without draining battery power significantly during the shipping and storage.

According to yet another aspect, the present invention is a novel valve device and the corresponding method for controlling flow-rate of fluid between the input and output ports of the valve device. A novel valve device includes a fluid input port and a fluid output port, a valve body, and a fram assembly. The valve body defines a valve cavity and includes a valve closure surface. The fram assembly provides two pressure zones and is movable within the valve cavity with respect a guiding member. The fram assembly is constructed to move to an open position enabling fluid flow from the fluid input port to the fluid output port upon reduction of pressure in a first of the two pressure zones and is constructed to move to a closed position, upon increase of pressure in the first pressure zone, creating a seal at the valve closure surface.

According to preferred embodiments, the two pressure zones are formed by two chambers separated by the fram assembly, wherein the first pressure zone includes a pilot chamber. The guiding member may be a pin or internal walls of the valve body.

The fram member (assembly) may include a pliable member and a stiff member, wherein the pliable member is constructed to come in contact with a valve closure surface to form seal (e.g., at a sealing lip located at the valve closure surface) in the closed position. The valve device may include a bias member. The bias member is constructed and arranged to assist movement of the fram member from the open position to the closed position. The bias member may be a spring.

The valve is controlled, for example, by an electromechanical operator constructed and arranged to release pressure in the pilot chamber and thereby initiate movement of the fram assembly from the closed position to the open position. The operator may include a latching actuator (as described in U.S. Pat. No. 6,293,516, which is incorporated by reference), a non-latching actuator (as described in U.S. Pat. No. 6,305,662, which is incorporated by reference), or an isolated operator (as described in PCT Application PCT/US01/51098, which is incorporated by reference). The valve may also be controlled may also including a manual operator constructed and arranged to release pressure in the pilot chamber and thereby initiate movement of the fram member from the closed position to the open position.

The novel valve device including the fram assembly may be used to regulate water flow in an automatic or manual bathroom flusher.

According to yet another aspect, the present invention is a novel electromagnetic actuator and a method of operating or controlling such actuator. The electromagnetic actuator includes a solenoid wound around an armature housing constructed and arranged to receive an armature including a plunger partially enclosed by a membrane. The armature provides a fluid passage for displacement of armature fluid between a distal part and a proximal part of the armature thereby enabling energetically efficient movement of the armature between open and closed positions. The membrane is secured with respect to the armature housing and is arranged to seal armature fluid within an armature pocket having a fixed volume, wherein the displacement of the plunger (i.e., distal part or the armature) displaces the membrane with respect to a valve passage thereby opening or closing the passage. This enables low energy battery operation for a long time.

Preferred embodiments of this aspect include one or more of the following features: The actuator may be a latching actuator (including a permanent magnet for holding the armature) of a non-latching actuator. The distal part of the armature is cooperatively arranged with different types of diaphragm membranes designed to act against a valve seat when the armature is disposed in its extended armature position. The electromagnetic actuator is connected to a control circuit constructed to apply said coil drive to said coil in response to an output from an optional armature sensor.

The armature sensor can sense the armature reaching an end position (open or closed position). The control circuit can direct application of a coil drive signal to the coil in a first drive direction, and in responsive to an output from the sensor meeting a predetermined first current-termination criterion to start or stop applying coil drive to the coil in the first drive direction. The control circuit can direct or stop application of a coil drive signal to the coil responsive to an output from the sensor meeting a predetermined criterion.

According to yet another aspect, the present invention is a novel assembly of an electromagnetic actuator and a piloting button. The piloting button has an important novel function for achieving consistent long-term piloting of a main valve. The present invention is also a novel method for assembling a pilot-valve-operated automatic flow controller that achieves a consistent long-term performance.

Method of assembling a pilot-valve-operated automatic flow controller includes providing a main valve assembly and a pilot-valve assembly including a stationary actuator and a pilot body member that includes a pilot-valve inlet, a pilot-valve seat, and a pilot-valve outlet. The method includes securing the pilot-valve assembly to the main valve assembly in a way that fluid flowing from a pressure-relief outlet of the main valve must flow through the pilot-valve inlet, past the pilot-valve seat, and through the pilot-valve outlet, whereby the pilot-valve assembly is positioned to control relief of the pressure in the pressure chamber (i.e., pilot chamber) of the main valve assembly. The main valve assembly includes a main valve body with a main-valve inlet, a main-valve seat, a main-valve outlet, a pressure chamber (i.e., a pilot chamber), and a pressure-relief outlet through which the pressure in the pressure chamber (pilot chamber) can be relieved. A main valve member (e.g., a diaphragm, a piston, or a fram member) is movable between a closed position, in which it seals against the main-valve seat thereby preventing flow from the main inlet to the main outlet, and an open position, in which it permits such flow. During the operation, the main valve member is exposed to the pressure in the pressure chamber (i.e., the pilot chamber) so that the pressurized pilot chamber urges the main valve member to its closed position, and the unpressurized pilot chamber (when the pressure is relieved using the pilot valve assembly) permits the main valve member to assume its open position.

According to yet another aspect, the present invention is a novel electromagnetic actuator system. This electromagnetic actuator system includes an actuator, a controller, and an actuator sensor. The actuator includes a solenoid coil and an armature housing constructed and arranged to receive in a movable relationship an armature. The controller is coupled to a power driver constructed to provide a drive signal to the solenoid coil for displacing the armature and thereby open or close a valve passage for fluid flow. The actuator sensor is constructed and arranged to sense a position of the armature and provide a signal to the controller.

Preferred embodiments of this aspect include one or more of the following features: The sensor is constructed to detect voltage induced by movement of the armature. Alternatively, the sensor is constructed and arranged to detect changes to the drive signal due to the movement of the armature.

Alternatively, the sensor includes a resistor arranged to receive at least a portion of the drive signal, and a voltmeter constructed to measure voltage across the resistor. Alternatively, the sensor includes a resistor arranged to receive at least a portion of the drive signal, and a differentiator receiving current flowing through the resistor.

Alternatively, the sensor includes a coil sensor constructed and arranged to detect the voltage induced by movement of the armature. The coil sensor may be connected in a feedback arrangement to a signal conditioner providing conditioned signal to the controller. The signal conditioner may include a preamplifier and a low-pass filter.

Alternatively, the system includes two coil sensors each constructed and arranged to detect the voltage induced by movement of the armature. The two coil sensors may be connected in a feedback arrangement to a differential amplifier constructed to provide a differential signal to the controller.

The actuator sensor includes an optical sensor, a capacitance sensor, an inductance sensor, or a bridge for sensitively detecting a signal change due to movement of the armature.

The actuator may have the armature housing constructed and arranged for a linear displacement of the armature upon the solenoid receiving the drive signal. The actuator may be a latching actuator constructed to maintain the armature in the open passage state without any drive signal being delivered to the solenoid coil. The latching actuator may include a permanent magnet arranged to maintain the armature in the open passage state. The latching actuator may further include a bias spring positioned and arranged to bias the armature toward an extended position providing a close passage state without any drive signal being delivered to the solenoid coil.

The controller may be constructed to direct the power driver to provide the drive signal at various levels depending on the signal from the actuator sensor. The drive signal may be current. The system may include a voltage booster providing voltage to the power driver.

The controller may be constructed to direct the power driver to provide the drive signal in a first drive direction and thereby create force on the armature to achieve a first end position. The controller is also constructed to determine whether the armature has moved in a first direction based on signal from the actuator sensor; and if the armature has not moved within a predetermined first drive duration, the controller directs application of the drive signal to the coil in the first direction at an elevated first-direction drive level that is higher than an initial level of the drive signal.

The controller may be constructed to trigger the power driver to provide the drive signal in a first drive direction and thereby create force on the armature to achieve a first end position. The controller is also constructed to determine whether the armature has moved in a first direction based on signal from the actuator sensor; and if the armature has moved, the controller directs application of the drive signal to the coil in the first direction at a first-direction drive level that is being lower than an initial level of the drive signal.

The actuator system may include the controller constructed to determine a characteristic of the fluid at the passage based on the signal from the actuator sensor. The characteristic of the fluid may be pressure, temperature, density, or viscosity. The actuator system may include a separate a temperature sensor for determining temperature of the fluid.

The actuator system may include the controller constructed to determine a pressure of the fluid at the passage based on the signal from the actuator sensor. The actuator system may receive signals from an external motion sensor or a presence sensor coupled to the controller.

BRIEF DESCRIPTION OF THE DRAWINGS

FIGS. 3A and 3B together form a cross-sectional view of a second embodiment of the flusher.

DETAILED DESCRIPTION OF ILLUSTRATIVE EMBODIMENTS

Figure 1:
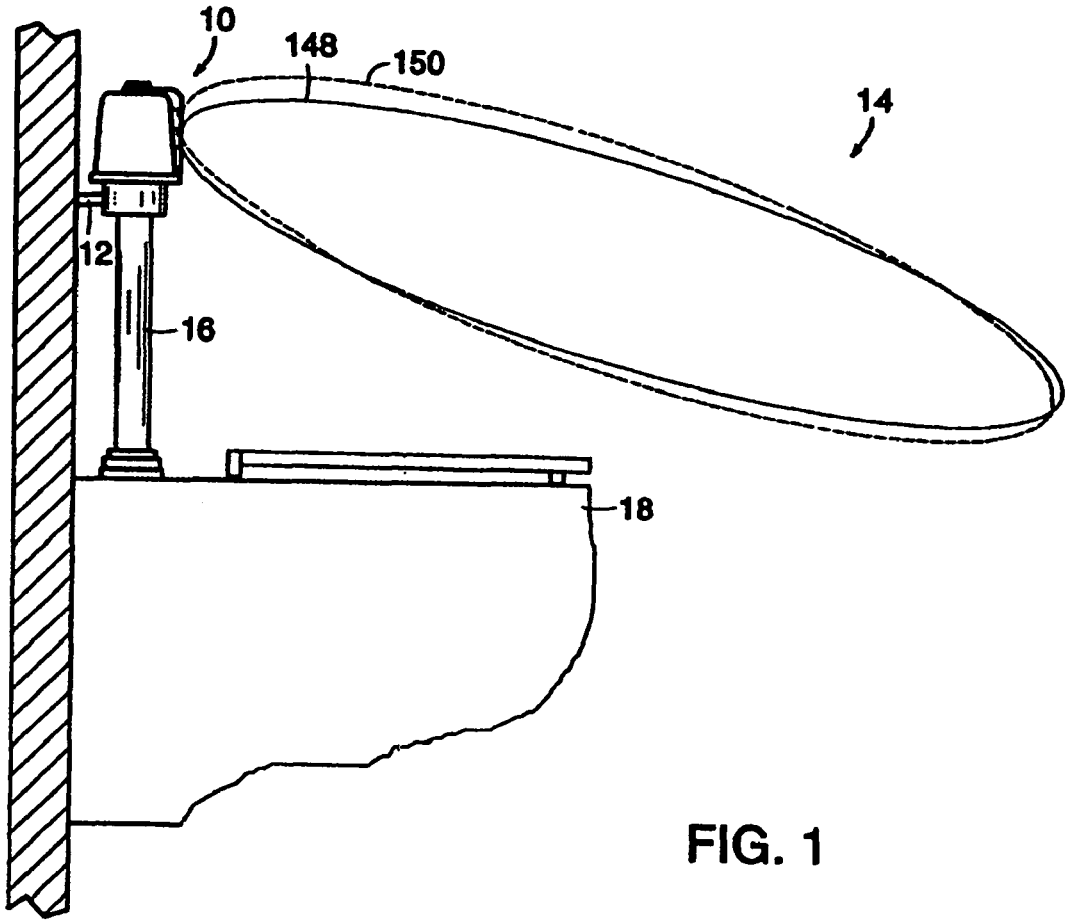
FIG. 1 is a side elevation of a toilet and an accompanying automatic flusher.
Figures 1A, 2, 3:
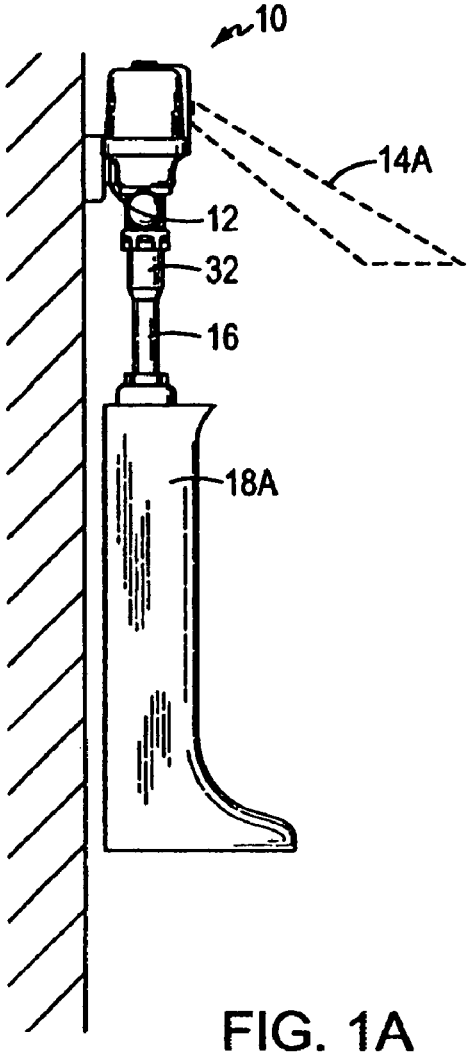
FIG. 1A is a side view of a urinal and an accompanying automatic flusher.

In FIG. 1, a flusher 10 receives pressurized water from a supply line 12 and employs an object sensor, typically of the infrared variety, to respond to actions of a target within a target region 14 by selectively opening a valve that permits water from the supply line 12 to flow through a flush conduit 16 to the bowl of a toilet 18. FIG. 1A illustrates a flusher 10 for automatically flushing a urinal 18A. As described above, flusher 10 receives pressurized water from supply line 12 and employs the object sensor to respond to actions of a target within a target region 14A by selectively opening a valve that permits water from the supply line 12 to flow through the flush conduit 16 to the urinal 18A.

Figure 2A:
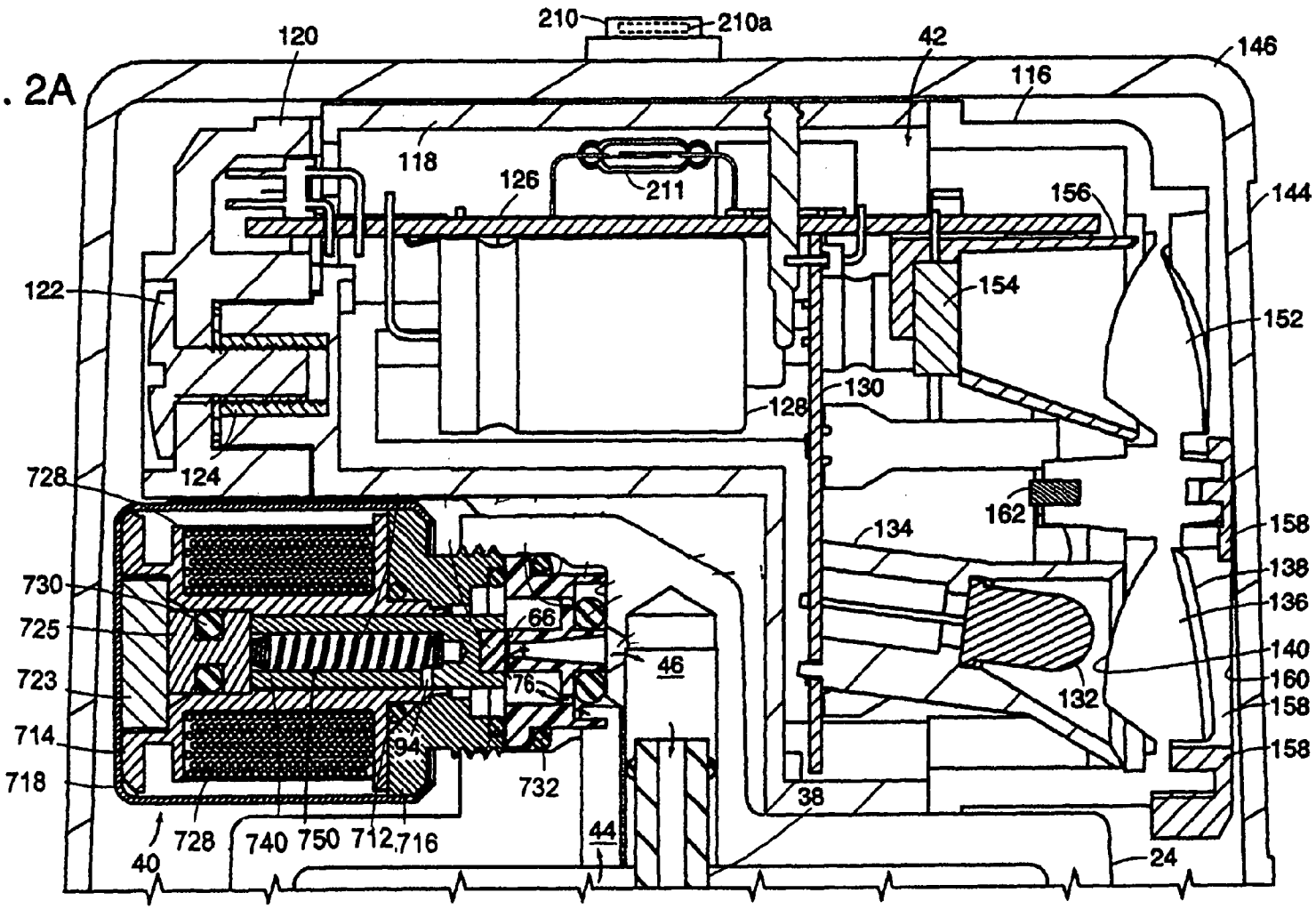
FIGS. 2A and 2B together form a cross-sectional view of a first embodiment of the flusher.
Figure 2B:
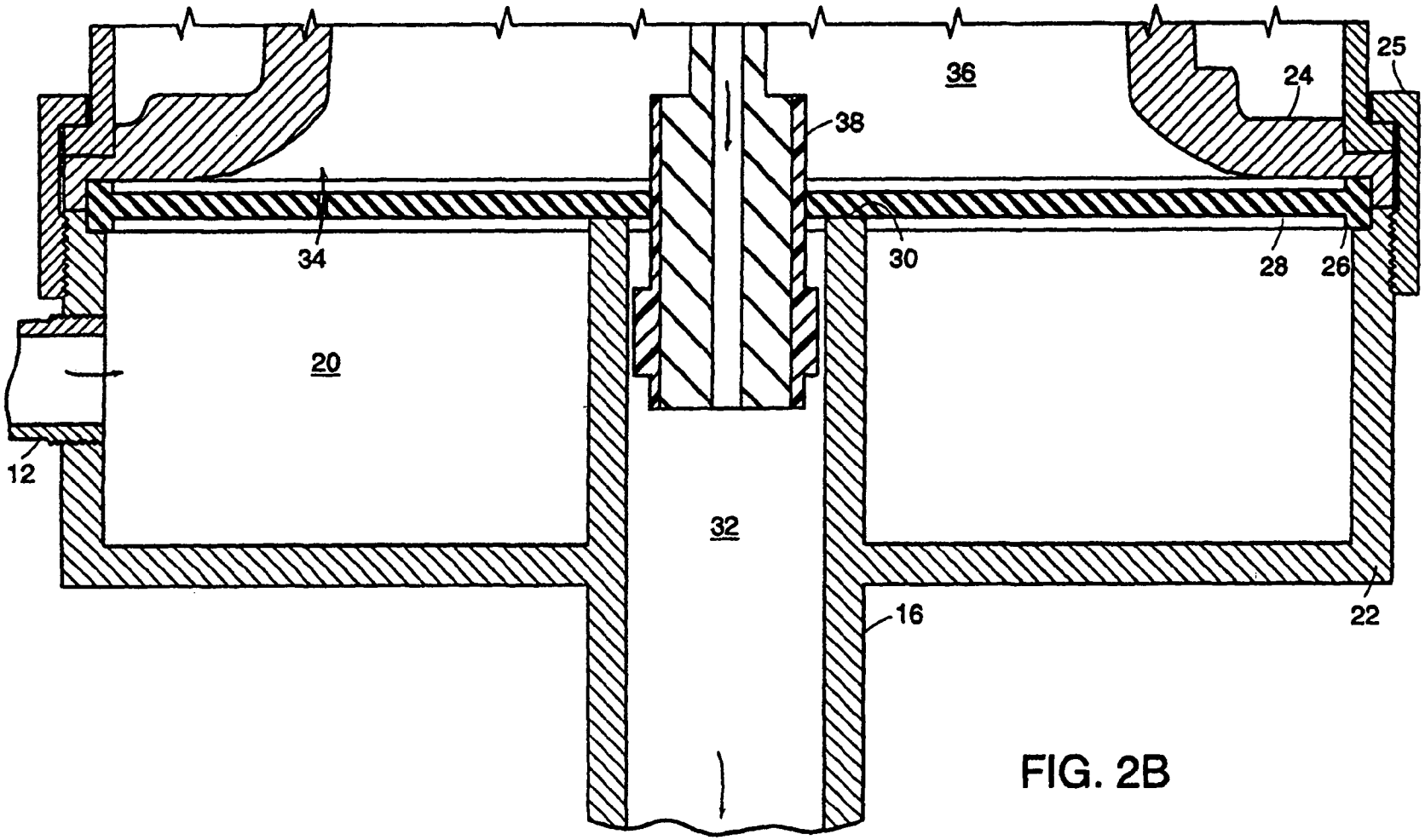

FIGS. 2A and 2B illustrate in detail a first embodiment of automatic flusher 10. FIG. 2B shows supply line 12, which communicates with an annular entrance chamber 20 defined by an entrance-chamber wall 22 formed near the flush conduit 16's upper end. A pressure cap 24 secured by a retaining ring 25 to the chamber housing clamps between itself and that housing the outer edge 26 of a flexible diaphragm 28 seated on a main valve seat 30 formed by the flush conduit 16's mouth.

The supply pressure that prevails in the entrance chamber 20 tends to unseat the flexible diaphragm 28 and thereby cause it to allow water from the supply line 12 to flow through the entrance chamber 20 into the flush conduit 16's interior 32. But the diaphragm 28 ordinarily remains seated because of pressure equalization that a bleed hole 34 formed by the diaphragm 28 tends to permit between the entrance chamber 20 and a main pressure chamber 36 formed by the pressure cap 24. Specifically, the pressure that thereby prevails in that upper chamber 36 exerts greater force on the diaphragm 28 than the same pressure within entrance chamber 20 does, because the entrance chamber 20's pressure prevails only outside the flush conduit 16, whereas the pressure in the main pressure chamber 36 prevails everywhere outside of a through-diaphragm feed tube 38.

The flusher also include a solenoid-operated actuator assembly, that can include any known solenoid or can include an actuator assembly 40 described in U.S. Pat. No. 6,293,516 or 6,305,662 both of which are incorporated by reference. Alternatively, the solenoid-operated actuator assembly includes an isolated actuator assembly 40A described in detail in PCT Application PCT/US01/51098, filed on Oct. 25, 2001, which is incorporated by reference as if fully reproduced herein. The isolated actuator assembly 40A is also in this application called a sealed version of the operator.

To flush the toilet 18, the solenoid-operated actuator assembly 40 controlled by circuitry 42 relieves the pressure in the main pressure chamber 38 by permitting fluid flow, in a manner to be described in more detail below, between pilot entrance and exit passages 44 and 46 formed by the pressure cap 24's pilot-housing portion 48. A detailed description of operation is provided below.

Figure 3B:
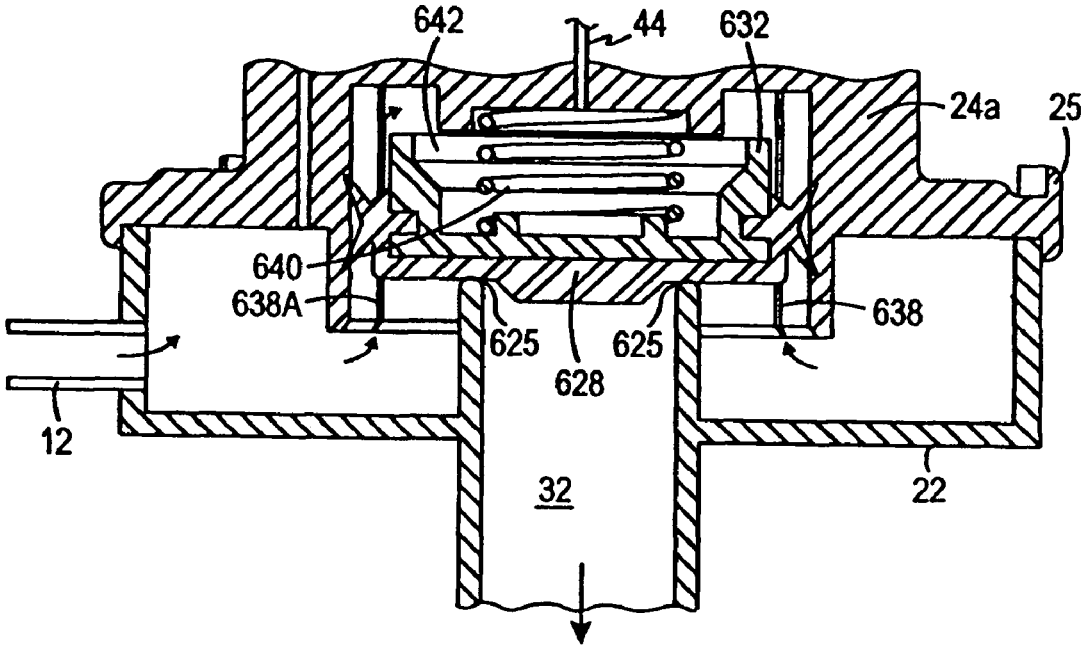

FIG. 3 (formed by FIGS. 2A and 3B) illustrates in detail a second embodiment of automatic flusher 10. This embodiment uses a novel high flow rate valve 600 (shown in FIG. 3B) utilizing a fram assembly described in detail in connection with FIG. 5C below. Referring to FIGS. 2A and 3B, automatic flusher 10 receives water input from supply line 12, which is in communication with a pliable member 628 supported by a support member 632 of a fram member 626. Grooves 638 and 638A provide water passages to a pilot chamber 642. The actuator relieves pressure in pilot chamber 642 and thus initiate opening of valve 600. Then water flows from input line 12 by a valve seat 625 to output chamber 32. The entire flushing cycle is controlled by the solenoid-operated actuator assembly 40 controlled by circuitry 42, shown in FIG. 2A. A detailed description of operation is provided below.

Figure 4:
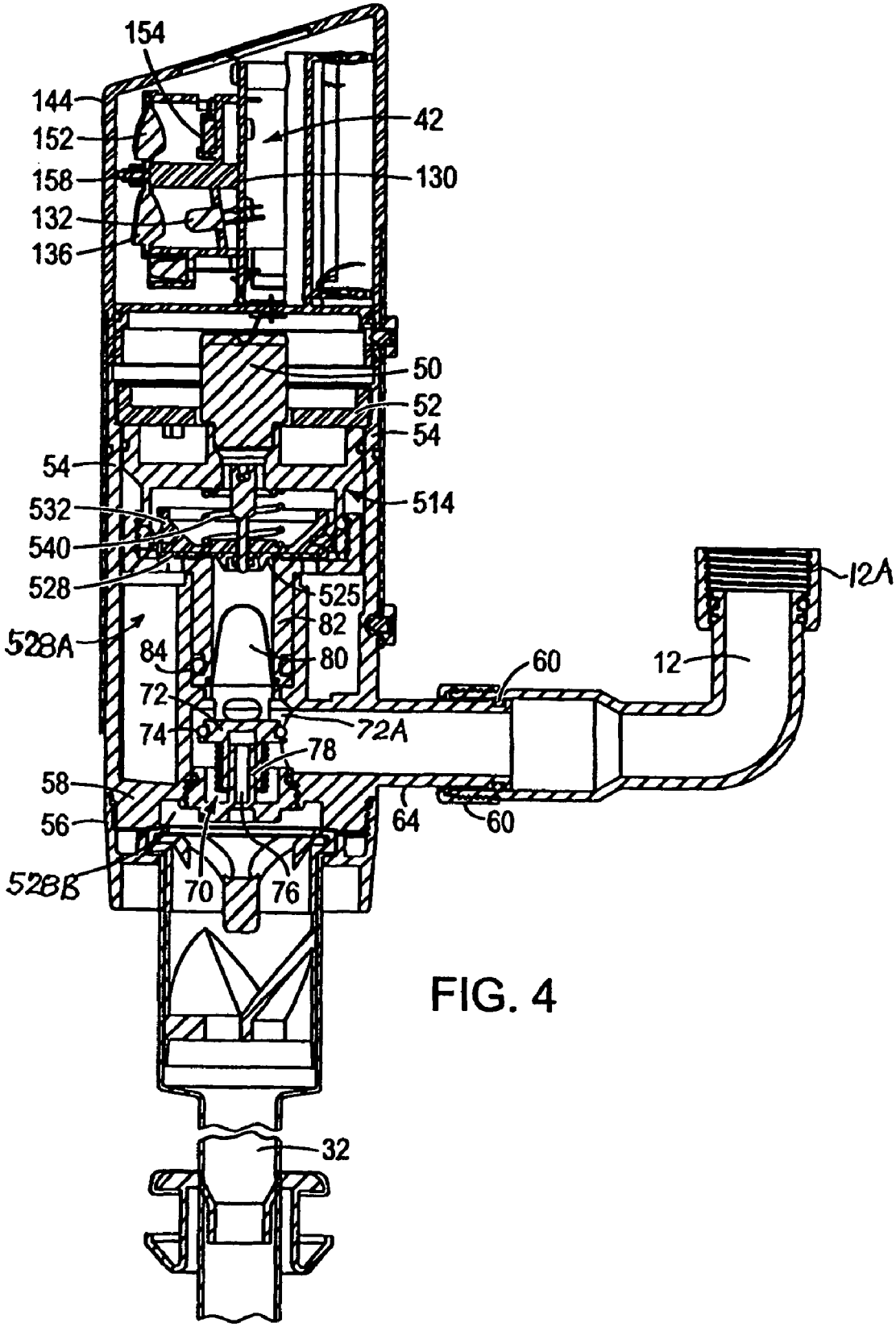
FIG. 4 is a cross-sectional view of a third embodiment of the flusher.

FIG. 4 illustrates in detail a third embodiment of automatic flusher 10. Automatic flusher 10 is a high performance, electronically controlled or manually controlled tankless flush system. Water enters thru input union 12, preferably made of a suitable plastic resin. Union 12 is attached via thread to input fitting 12A that interacts with the building water supply system. Furthermore, union 12 is designed to rotate on its own axis when no water is present so as to facilitate alignment with the inlet supply line.

Referring still to FIG. 4, union 12 is attached to an inlet pipe 64 by a fastener 60 and a radial seal 62, which enables union 12 to move in or out along inlet pipe 64. This movement can align the inlet to the supply line. However, with fastener 60 secured, there is pressure applied by the junction of union 12 to inlet 60. This forms a unit that is rigid and sealed through seal number 62. The water supply travels through union 12 to inlet 64 and thru the inlet valve assembly in the direction of elements 76, 78, 70, 72, and 74. Automatic flusher 10 also includes an inlet screen filter 80, which resides in a passage formed by member 82 and is in communication with a main valve seat 525, the operation of the entire main valve is described in connection with FIGS. 5, 5A and 5B.

As described in connection with FIGS. 5, 5A and 5B, an electro-magnetic actuator 50 controls operation of the main valve. In the opened state, water flows thru passage 528 thru passage 528A thru passage 528B into main outlet 32. In the closed state, the fram element 528 seals the valve main seat 525.

Automatic flusher 10 includes an adjustable input valve 72 controlled by rotation of a valve element 54 threaded together with valve elements 514 and 540, which are sealed from body 54 via o-ring seals 84 and 54A. Valve elements 514 and 540 of the assembly are held down by threaded element 52, when element 52 is threaded all the way. The resulting force presses down element 82 on valve element 72 therefore creating a path from inlet 78 to passage of body 82. When valve element 52 is unthreaded all the way, valve assembly 514 and 540 moves up due to the force of the spring located in the adjustable valve 70. The spring force combined with fluid pressure from inlet 78 forces element 72 against seat 72A resulting in a sealing action. Seal element 74 blocks the flow of water to inner passage of 82, which in turn enables servicing of all internal valve elements including elements 82, 50, 514, 50, and 528 without the need to shut off the water supply at the inlet 12. This is a major advantage of this embodiment.

According to another function of adjustable valve 70, the threaded retainer is fastened part way resulting in valve body elements 514 and 82 to push down valve seat 72 only partly. There is a partial opening that provides a flow restriction reducing the flow of input water thru valve 70. This novel function is designed to meet application specific requirements. In order to provide for the installer the flow restriction, the inner surface of valve body 54 includes application specific marks such as 1.6 W.C., 1.0 GPF urinals etc.

Automatic flusher 10 includes a sensor-based electronic flush system located in housing 144 and described in connection with FIG. 2A. Furthermore, the sensor-based electronic flush system may be replaced by an all mechanical activation button or lever. Alternatively, the flush valve may be controlled by a hydraulically timed mechanical actuator that acts upon a hydraulic delay arrangement. Such hydraulic system can reside in housing 144. The hydraulic system can be adjusted to a delay period corresponding to the needed flush volume for a given fixture such a 1.6 GPF W.C etc. The hydraulic delay mechanism can open the outlet orifice of the pilot section instead of electromagnetic actuator 50 (shown in FIG. 4) for duration equal to the installer preset value.

Alternatively, control circuitry 42 can be modified so that the sensory elements housed in housing 144 are replaced with a timing control circuit. Upon activation of the flusher by an electromechanical switch (or a capacitance switch), the control circuitry initiates a flush cycle by activating electromagnetic actuator 50 for duration equal to the preset level. This level can be set at the factory or by the installer in the field. This arrangement can be combined with the static pressure measurement scheme described below for compensating the pressure influence upon the desired volume per each flush.

The embodiment of FIG. 4 has several advantages. The hydraulic or the electromechanical control system can be serviced without the need to shut off the water supply to the unit. Furthermore, the valve mechanism enables controlling the quantity of fluid that is passed thru the unit. The main flush valve includes the design shown in detail in connection with FIGS. 5, 5A, and 5B. This flush valve arrangement provides for a high flow rate (for its valve size) when compared to conventional diaphragm type flush valves, as shown in FIG. 2B.

The embodiment of FIG. 4 provides fluid control valves in combination with a low power bi-stable electro magnetic actuator that combined with the described control circuitry can precisely control the delivered water volume per each flush. As described below, the capability of measuring fluid static pressure and in turn altering the main valve open time controls dynamically the delivered volume. That is, this system can deliver a selected water volume regardless of the pressure variation in the water supply line.

The system can include a flexible conducting spring contact arrangement for converting electrical control signals from the control electronics to the electro magnetic actuator without the use of a wire/connector arrangement. The system can also enable actuation of the main flush valve using a direct mechanical lever or a mechanical level actuating upon a hydraulic delay arrangement that in turn acts upon the main valve pilot arrangement. The individual functions are described in detail below.

Figure 5:
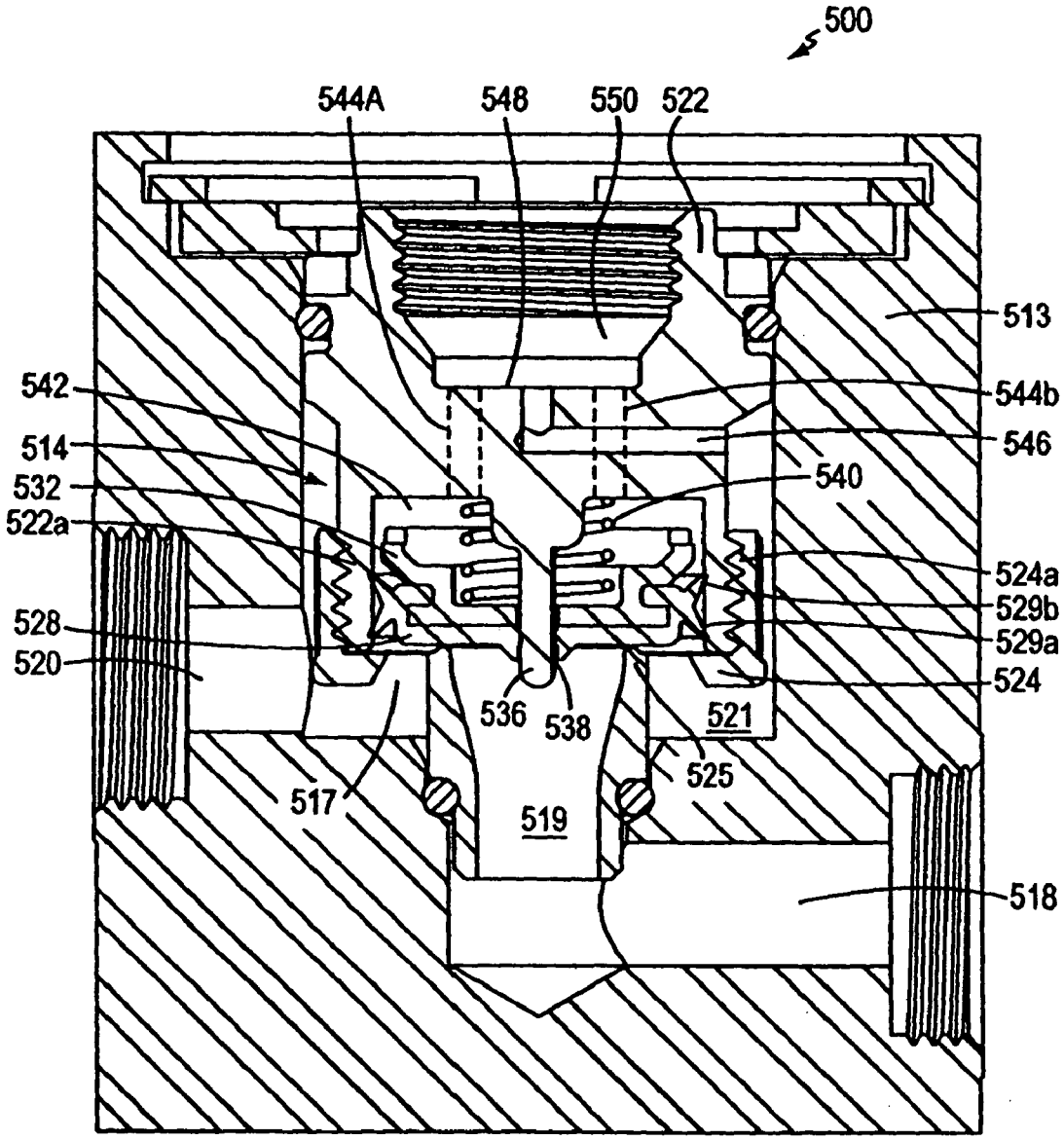
FIG. 5 is an enlarged sectional view of a valve for controlling fluid flow in the flusher shown in FIG. 4.
Figure 5A:
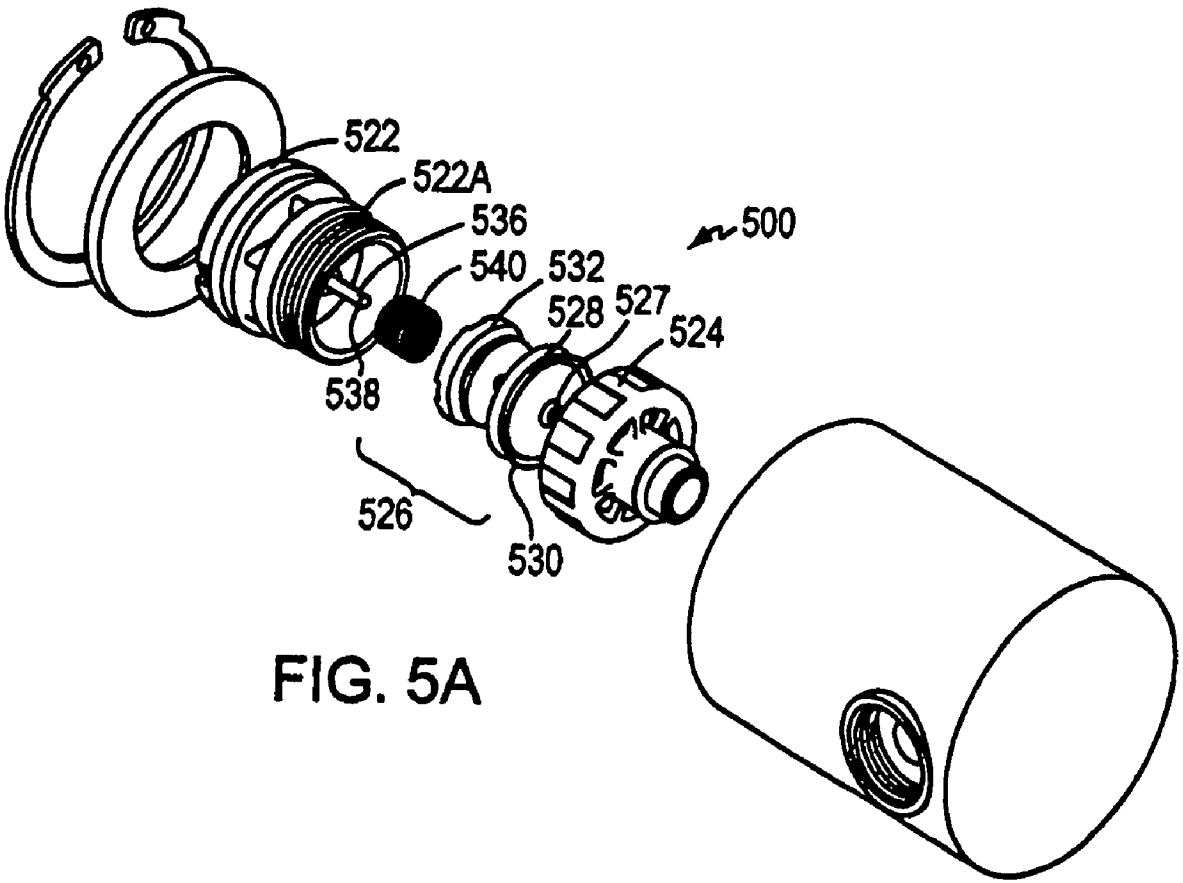
FIG. 5A is a perspective exploded view of the valve shown in FIG. 5.

FIG. 5 illustrates a preferred embodiment of a valve 500 used in the faucet embodiment shown in FIG. 3 or 4. Valve device 500 includes a valve body 513 providing a cavity for a valve assembly 514, an input port 518, and an output port 520. Valve assembly 514 includes a proximal body 522, a distal body 524, and a fram member 526 (FIG. 5A). Fram member 526 includes a pliable member 528 and a support member 532. Pliable member 528 may be a diaphragm-like member with a sliding seal 530. Support member 532 may be plunger-like member or a piston like member, but having a different structural and functional properties that a conventional plunger or piston. Valve assembly 514 also includes a guiding member such as a guide pin 536 or sliding surfaces, and includes a spring 540.

Proximal body 522 includes threaded surface 522A cooperatively sized with threaded surface 524A of distal body 524. Fram member 526 (and thus pliable member 528 and a plunger-like member 532) includes an opening 527 constructed and arranged to accommodate guiding pin 536. Fram member 526 defines a pilot chamber 542 arranged in fluid communication with actuator cavity 550 via control passages 544A and 544B. Actuator cavity 550 is in fluid communication with output port 520 via a control passage 546. Guide pin 536 includes a V-shaped or U-shaped groove 538 shaped and arranged together with fram opening 527 (FIG. 5A) to provide a pressure communication passage between input chamber 519 and pilot chamber 550.

Referring still to FIG. 5, distal body 524 includes an annular lip seal 525 arranged, together with pliable member 528, to provide a seal between input port chamber 529 and output port chamber 521. Distal body 524 also includes one or several flow channels 517 providing communication (in open state) between input chamber 519 and output chamber 521. Pliable member 528 also includes sealing members 529A and 529B arranged to provide a sliding seal, with respect to valve body 522, between pilot chamber 542 and output chamber 521. There are various possible embodiments of seals 529A and 529B (FIG. 5). This seal may be one-sided as seal 530 (shown in FIG. 5A) or two-sided seal 529*a* and 529*b* shown in FIG. 5. Furthermore, there are various additional embodiments of the sliding seal including O-ring etc.

The present invention envisions valve device 10 having various sizes. For example, the "full" size embodiment, shown in FIG. 5B, has the pin diameter A=0.070", the spring diameter B=0.360", the pliable member diameter C=0.730", the overall fram and seal's diameter D=0.812", the pin length E=0.450", the body height F=0.380", the pilot chamber height G=0.280", the fram member size H=0.160", and the fram excursion I=0.100". The overall height of the valve is about 1.39" and diameter is about 1.178".

The "half size" embodiment (of the valve shown in FIG. 5B) has the following dimensions provided with the same reference letters (each also including a subscript 1). In the "half size" valve $A_1$=0.070", $B_1$=0.30, $C_1$=0.56041 , $D_1$=0.650", $E_1$=0.38", $F_1$=0.310", $G_1$=0.215", $H_1$=0.125", and $I_1$=0.60". The overall length of the ½ embodiment is about 1.350" and the diameter is about 0.855". Similarly, the valve devices of FIG. 5B or 5C may have various larger or smaller sizes.

Figure 5B:
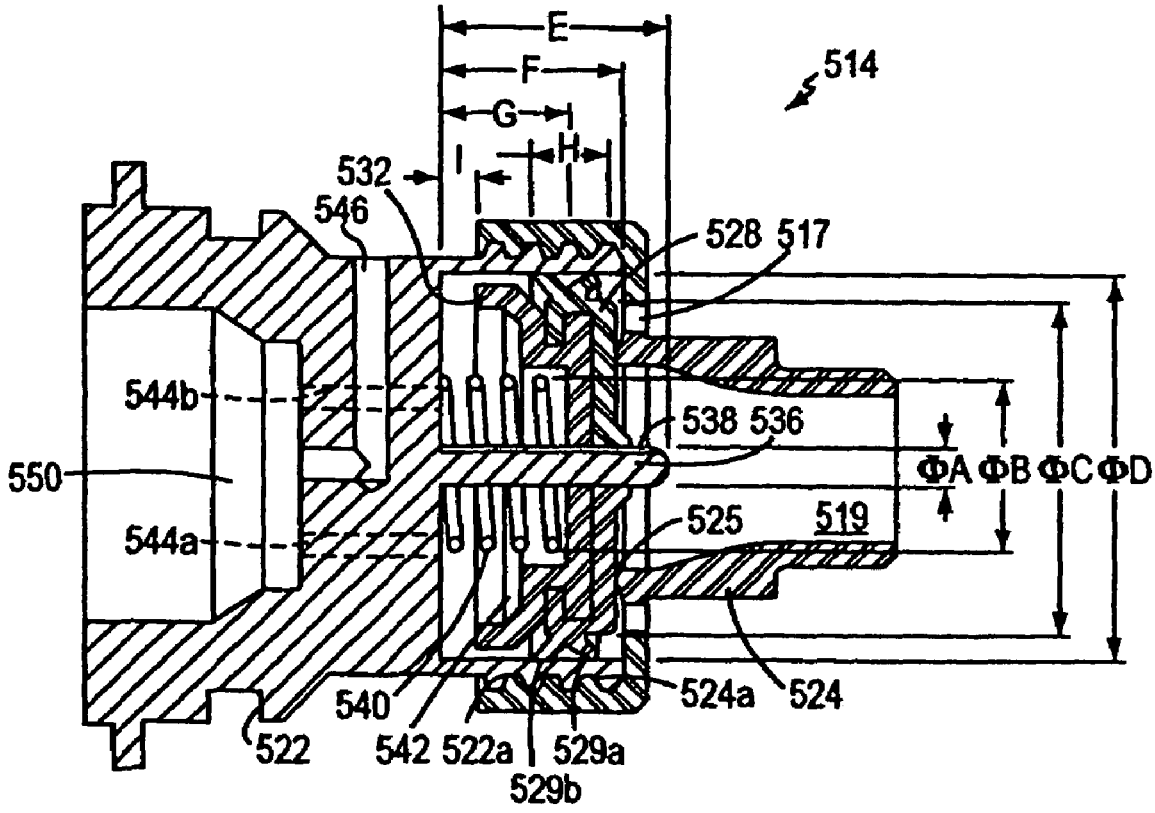
FIG. 5B is an enlarged sectional view of another embodiment of the valve shown in FIG. 5.

Referring to FIGS. 5 and 5B, valve 500 receives fluid at input port 518, which exerts pressure onto diaphragm-like members 528 providing a seal together with a lip member 525 in a closed state. Groove passage 538 provides pressure communication with pilot chamber 542, which is in communication with actuator cavity 550 via communication passages 544A and 544B. An actuator (shown in FIGS. 5C, 7) provides a seal at surface 548 thereby sealing passages 544A and 544B and thus pilot chamber 542. When the plunger of actuator 142 or 143 moves away from surface 548, fluid flows via passages 544A and 544B to control passage 546 and to output port 520.

This causes pressure reduction in pilot chamber 542. Therefore, diaphragm-like member 528 and piston-like member 532 move linearly within cavity 542, thereby providing a relatively large fluid opening at lip seal 525. A large volume of fluid can flow from input port 518 to output port 520.

When the plunger of actuator 142 or 143 seals control passages 544A and 544B, pressure builds up in pilot chamber 542 due to the fluid flow from input port 518 through groove 538. The increased pressure in pilot chamber 542 together with the force of spring 540 displace linearly, in a sliding motion over guide pin 536, fram member 526 toward sealing lip 525. When there is sufficient pressure in pilot chamber 542, diaphragm-like pliable member 528 seals input port chamber 519 at lip seal 525. Preferably, soft member 528 is designed to clean groove 538 of guide pin 536 during the sliding motion.

The embodiment of FIG. 5 shows valve 500 having input chamber 519 (and guide pin 536) symmetrically arranged with respect to passages 544A, 544B and 546 (and the location of the plunger of actuator 701. However, valve device 500 may have input chamber 519 (and guide pin 536) non-symmetrically arranged with respect to passages 544A, 544B (not shown) and passage 546. That is, this valve has input chamber 519 (and guide pin 536) non-symmetrically arranged with respect to the location of the plunger of actuator 142 or 143. The symmetrical and non-symmetrical embodiments are equivalent.

Figure 5C:
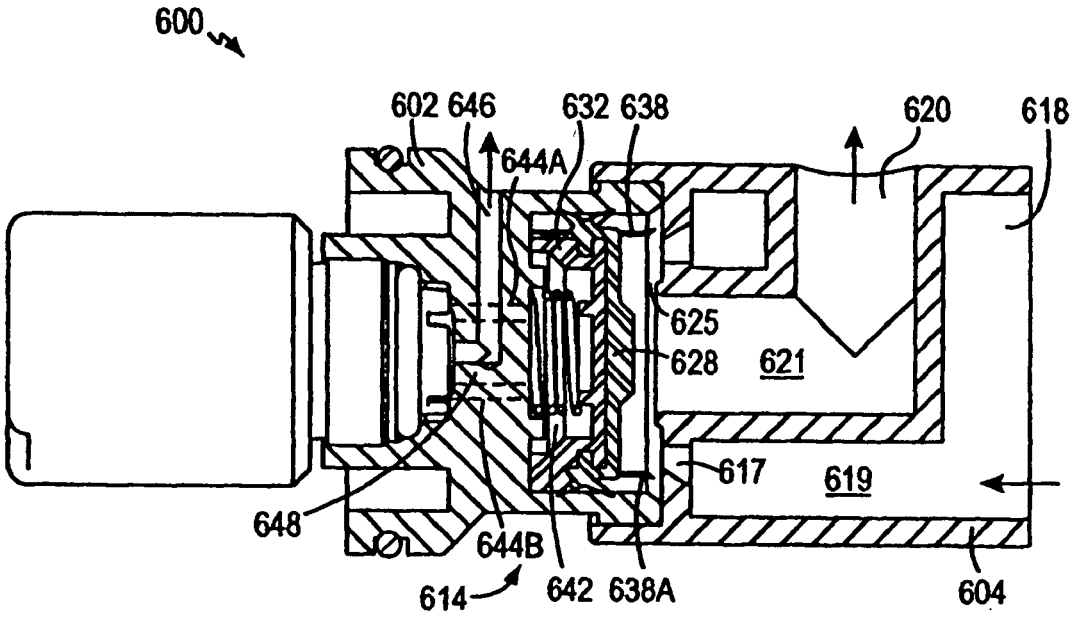
FIG. 5C is an enlarged sectional view of another embodiment of the valve shown in FIG. 5.

Referring to FIG. 5C, valve device 600 includes a valve body 613 providing a cavity for a valve assembly 614, an input port 618, and an output port 620. Valve assembly 614 includes a proximal body 602, a distal body 604, and a fram member or assembly 626. Fram member 626 includes a pliable member 628 and a support member 632. Pliable member 628 may be a diaphragm-like member with a sliding seal 630. Support member 632 may be plunger-like member or a piston like member, but having a different structural and functional properties that a conventional plunger or piston. Valve body 602 provides a guide surface 636 located on the inside wall that includes one or several grooves 638 and 638A. These are novel grooves constructed to provide fluid passages from input chamber located peripherally (unlike the central input chamber shown in FIGS. 5 and 5B).

Fram member 626 defines a pilot chamber 642 arranged in fluid communication with actuator cavity 650 via control passages 644A and 644B. Actuator cavity 650 is in fluid communication with output chamber 621 via a control passage 646. Groove 638 (or grooves 638 and 638A) provides a communication passage between input chamber 619 and pilot chamber 642. Distal body 604 includes an annular lip seal 625 co-operatively arranged with pliable member 628 to provide a seal between input port chamber 619 and output port chamber 621. Distal body 624 also includes a flow channel 617 providing communication (in the open state) between input chamber 619 and output chamber 621 for a large amount of fluid flow. Pliable member 628 also includes sealing members 629A and 629B (or one sided sealing member depending on the pressure conditions) arranged to provide a sliding seal with respect to valve body 622, between pilot chamber 642 and input chamber 619. (Of course, groove 638 enables a controlled flow of fluid from input chamber 619 to pilot chamber 642, as described above.)

We now turn to the system for controlling the operator. Regarding the embodiments shown in FIG. 2 and FIG. 3, as FIG. 2A shows, the operator-control circuitry 42 is contained in a circuit housing formed of three parts, a front piece 116, a center piece 118, and a rear piece 120. Screws not shown secure the front piece 116 to the center piece 118, to which the rear piece 120 is in turn secured by screws such as screw 122. That screw threadedly engages a bushing 124 ultrasonically welded into a recess that the center housing piece 118 forms for that purpose. A main circuit board 126, on which are mounted a number of components such as a capacitor 128 and a microprocessor not shown, is mounted in the housing. An auxiliary circuit board 130 is in turn mounted on the main circuit board 126. Mounted on the auxiliary board 130 is a light-emitting diode 132, which a transmitter hood 134 also mounted on that board partially encloses.

The front circuit-housing piece 116 forms a transmitter-lens portion 136, which has front and rear polished surfaces 138 and 140. The transmitter-lens portion focuses infrared light from light-emitting diode 132 through an infrared-transparent window 144 formed in the flusher housing 146. FIG. 1's pattern 148 represents the resultant radiation-power distribution. A receiver lens 152 formed by part 116 so focuses received light onto a photodiode 154 mounted on the main circuit board 126 that FIG. 1's pattern 150 of sensitivity to light reflected from targets results.

Like the transmitter light-emitting diode 132, the photodiode 154 is provided with a hood, in this case hood 156. The hoods 134 and 156 are opaque and tend to reduce noise and crosstalk. The circuit housing also limits optical noise; its center and rear parts 118 and 120 are made of opaque material such as Lexan 141 polycarbonate, while its front piece 116, being made of transparent material such as Lexan OQ2720 polycarbonate so as to enable it to form effective lenses 136 and 152, has a roughened and/or coated exterior in its non-lens regions that reduces transmission through it. An opaque blinder 158 mounted on front piece 116 leaves a central aperture 160 for infrared-light transmission from the light-emitting diode 132 but otherwise blocks stray transmission that could contribute to crosstalk. Also to prevent crosstalk, an opaque stop 162 is secured into a slot provided for that purpose in the circuit housing's front part 116.

Figure 6:
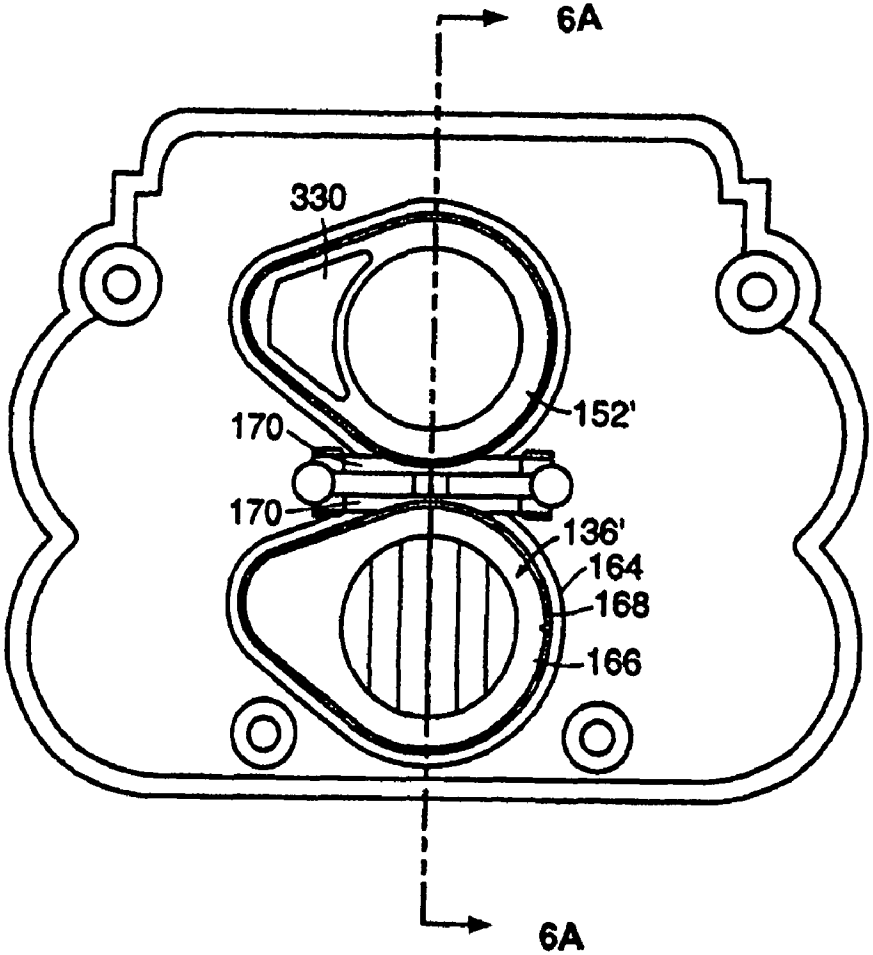
FIG. 6 is a front elevation of an alternative version's transmitter and receiver lenses and front circuit-housing part.
Figure 6A:
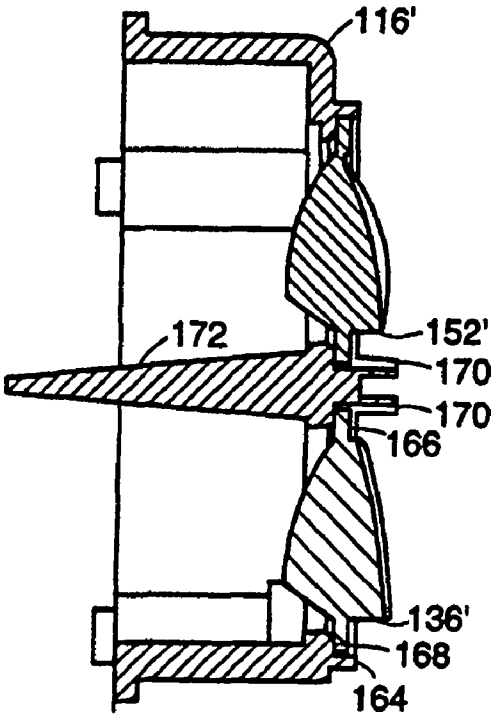
FIG. 6A is a cross-section taken at line 6A-6A of FIG. 6.

The arrangement of FIG. 2A, in which the transmitter and receiver lenses are formed integrally with part of the circuit housing, can afford manufacturing advantages over arrangements in which the lenses are provided separately from the housing. But it may be preferable in some embodiments to make the lenses separate, because doing so affords greater flexibility in material selection for both the lens and the circuit housing. FIGS. 6 and 6A are front-elevational and cross-sectional views of an alternative that uses this approach. That alternative includes a front circuit housing piece 116' separate from lenses 136' and 152'. The housing part 116' forms a teardrop-shaped rim 164 that cooperates during assembly with a similarly shaped flange 166 on lens 136' to orient that lens properly in its position on a teardrop-shaped shoulder 168 to which it is then welded ultrasonically. Referring to FIG. 6A, the teardrop shape ensures that the lens is oriented properly. The receiver lens 152 is mounted similarly. Since the front circuit-housing part 116' and lenses 136' and 152' do not need to be made of the same material, housing part 116' can be made of an opaque material so that blinders 170 and a stop 172 can be formed integrally with it. As was mentioned in connection with FIG. 2A, the circuit housing contains circuitry that controls the valve operator as well as other flusher components.

Figure 4A:
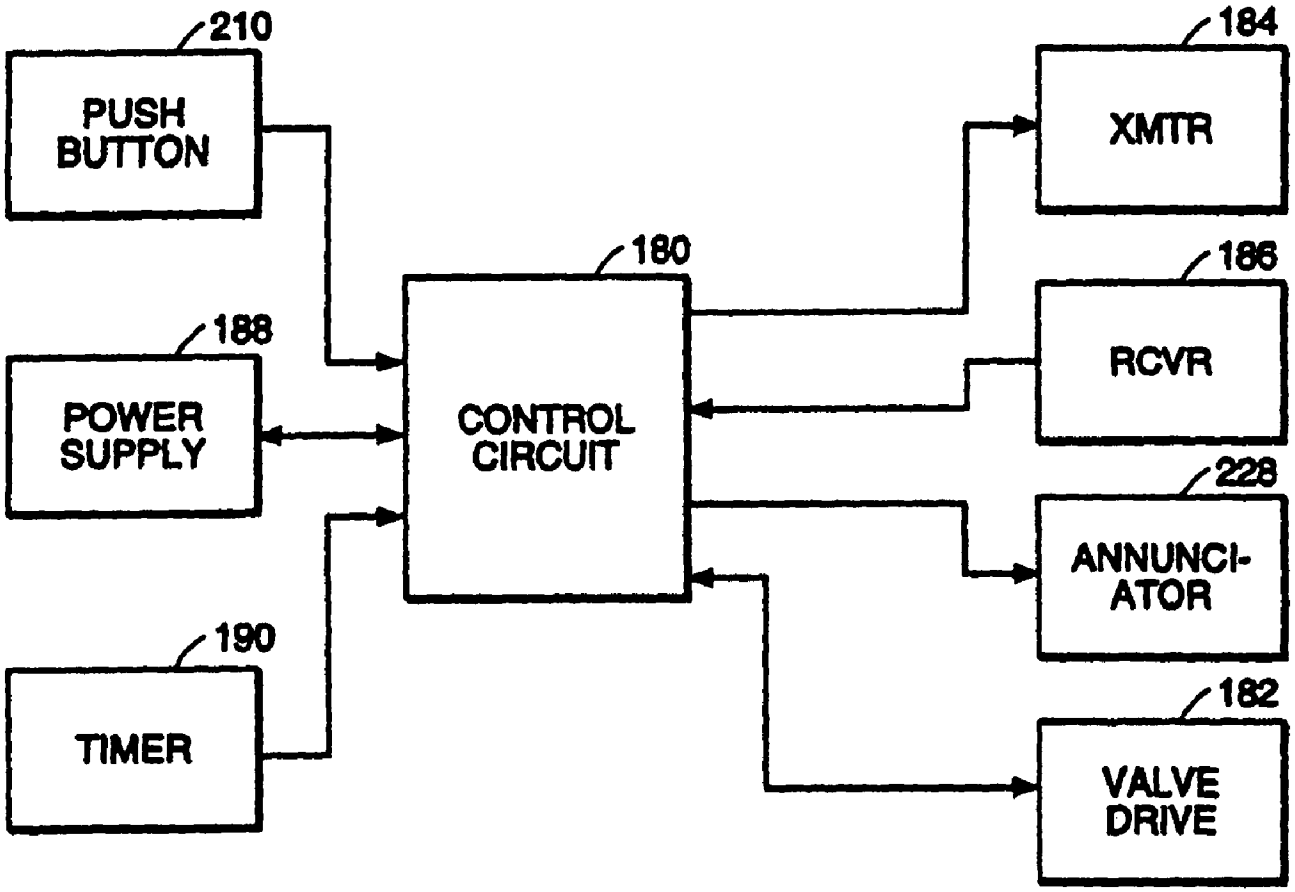
FIG. 4A is a block diagram of the flusher's control circuitry.

FIG. 4A is a simplified block diagram of that circuitry. A microcontroller-based control circuit 180 operates a peripheral circuit 182 that controls the valve operator. Transmitter circuitry 184, including FIG. 2's light-emitting diode 132, is also operated by the control circuit 180, and receiver circuitry 186 includes the photodiode 154 and sends the control circuit its response to resultant echoes. Although the circuitry of FIG. 4A can be so implemented as to run on house power, it is more typical for it to be battery-powered, and FIG. 4A explicitly shows a battery-based power supply 188 because the control circuit 180, as will be explained below, not only receives regulated power from the power supply but also senses its unregulated power for purposes to be explained below. It also controls application of the supply's power to various of the FIG. 4A circuit's constituent parts.

Figures 12, 12A:
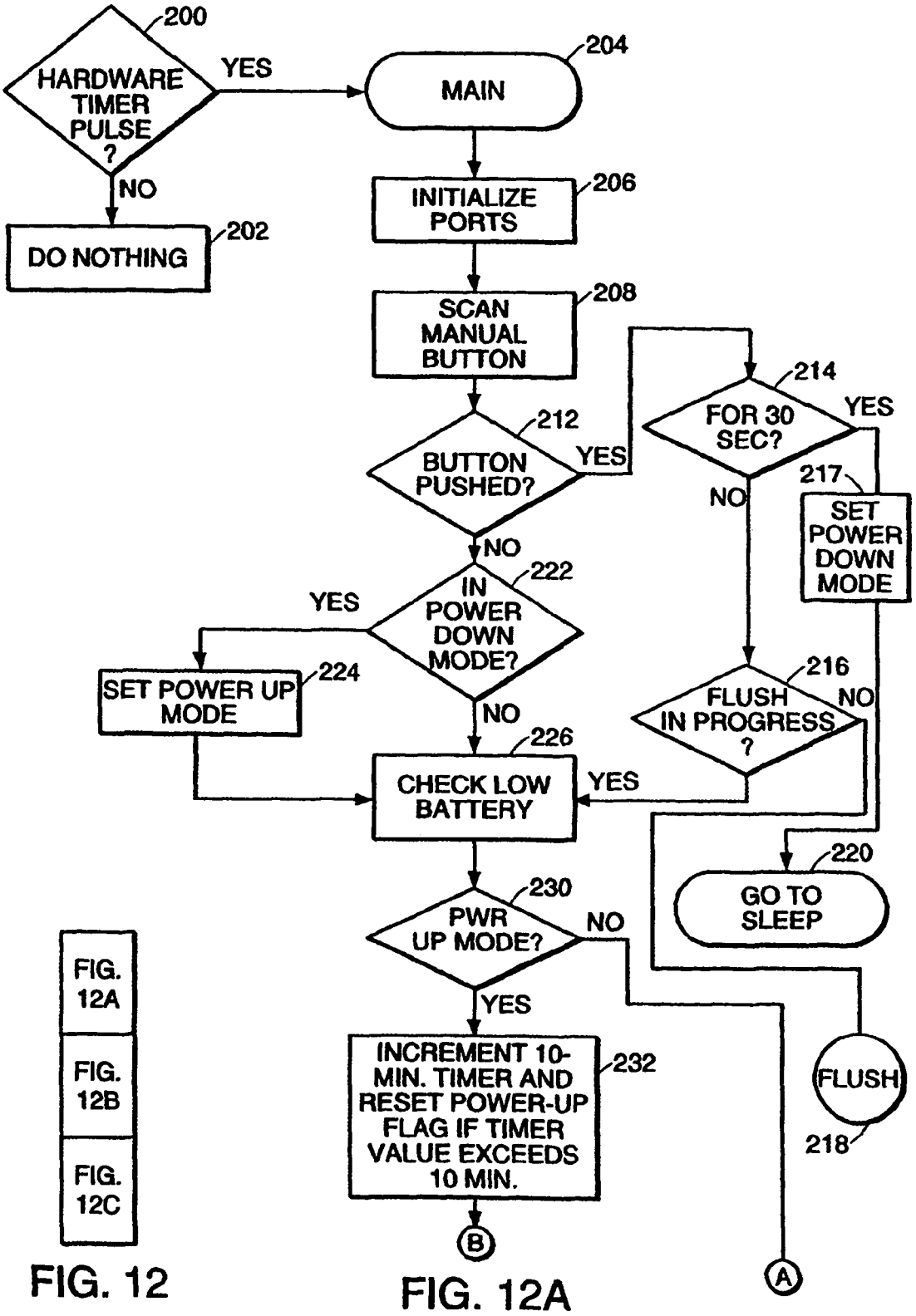
FIGS. 12A, 12B, and 12C together form a simplified flowcharts a routine that the control circuitry of FIG. 4A executes.
Figure 12B:
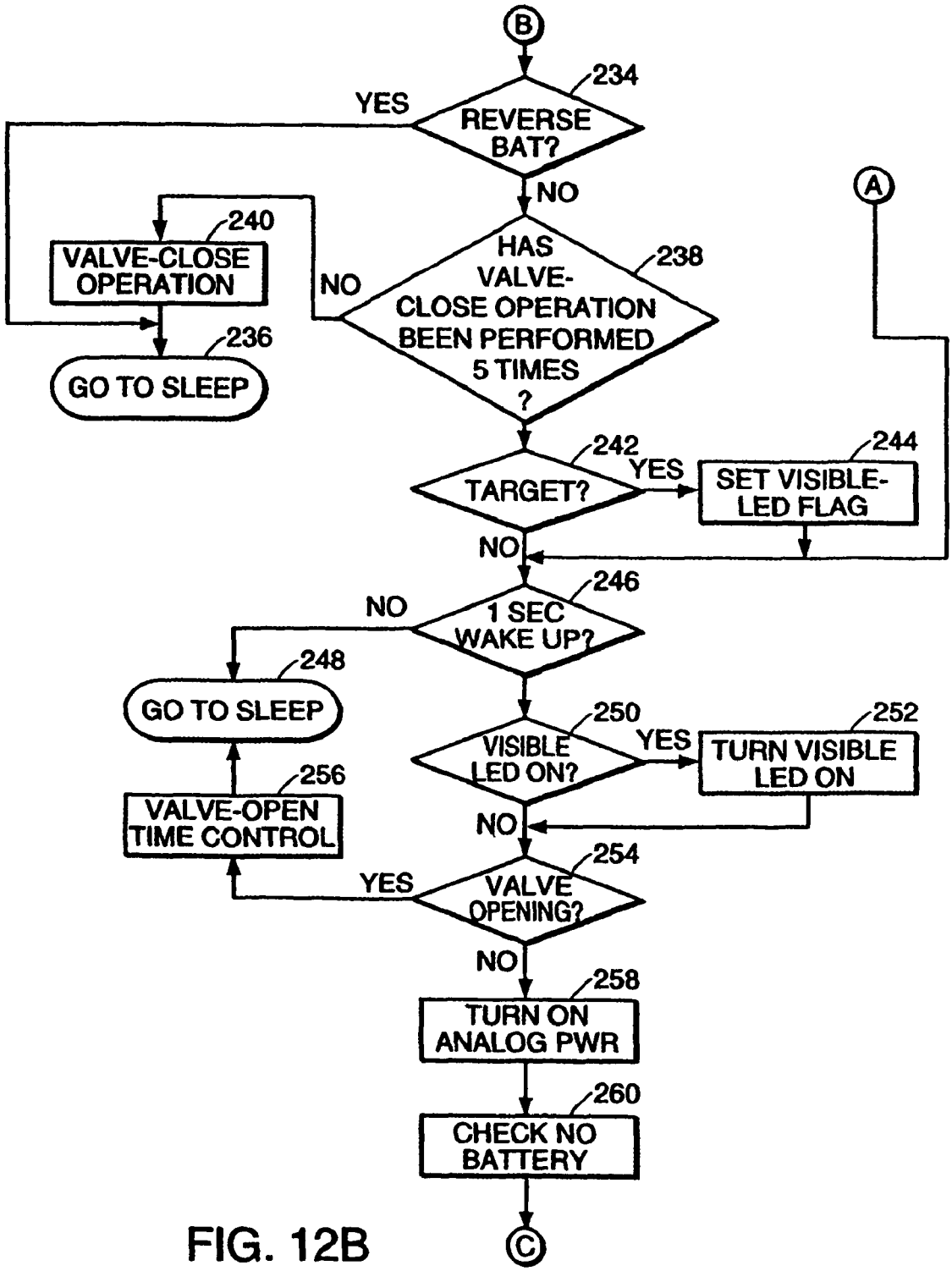
Figure 12C:
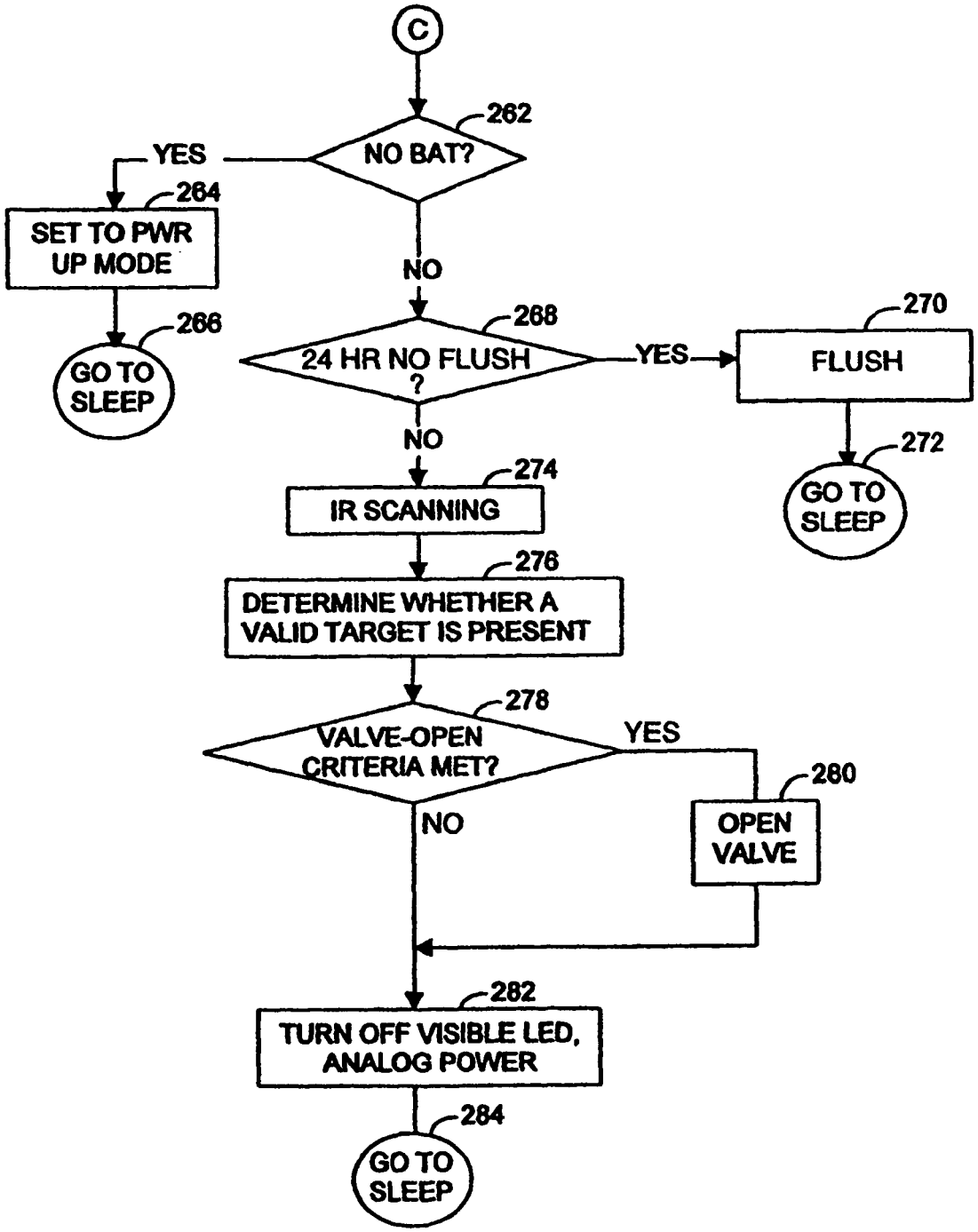

Since the circuitry is most frequently powered by battery, an important design consideration is that power not be employed unnecessarily. As a consequence, the microcontroller-based circuitry is ordinarily in a "sleep" mode, in which it draws only enough power to keep certain volatile memory refreshed and operate a timer 190. In the illustrated embodiment, that timer 190 generates an output pulse every 250 msec., and the control circuit responds to each pulse by performing a short operating routine before returning to the sleep mode. FIGS. 12A and 12B (together, "FIG. 12") form a flow chart that illustrates certain of those operations' aspects in a simplified fashion.

Figure 7:
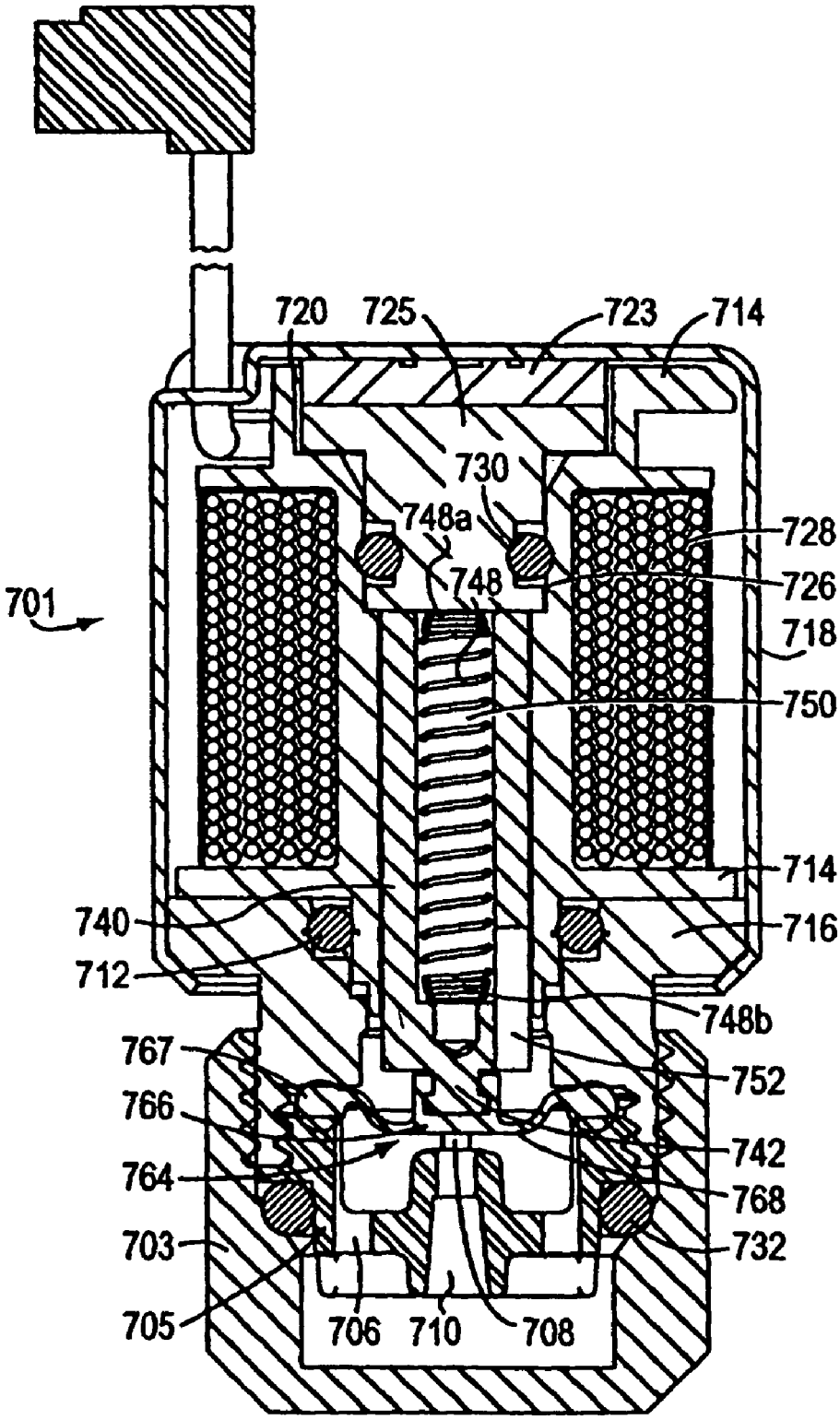
FIG. 7 is a sectional view of a first embodiment of an electromechanical actuator for controlling any one of the valves shown in FIGS. 5 through 5B.
Figure 7A:
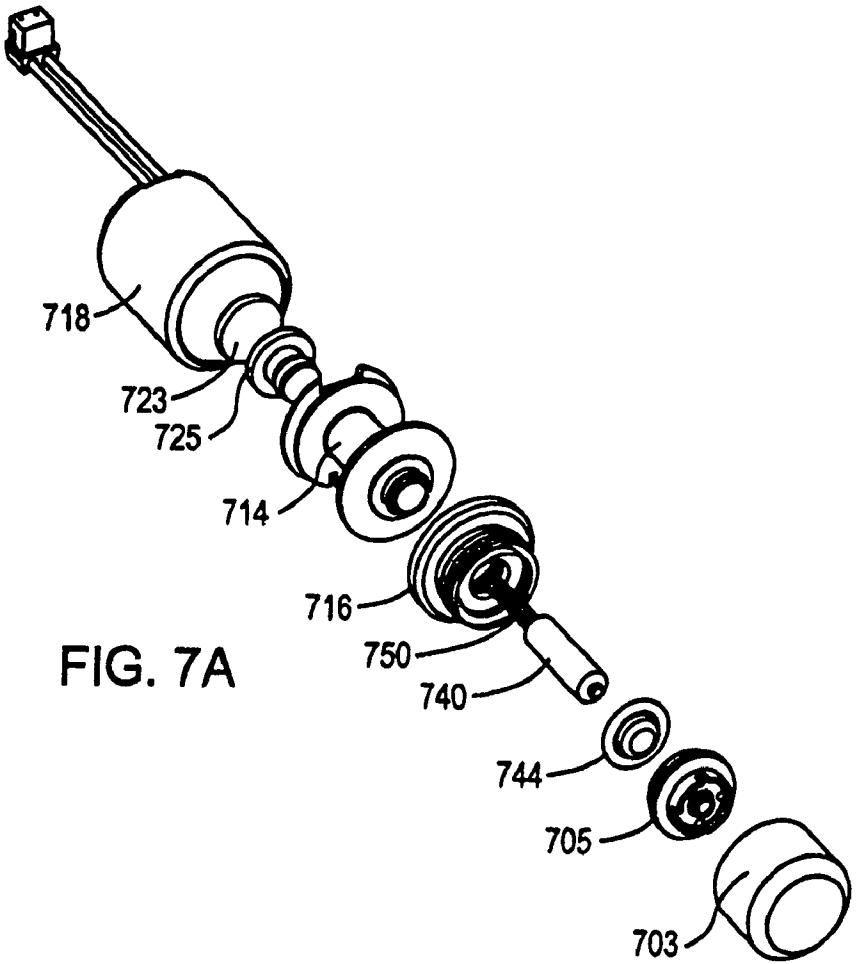
FIG. 7A is a perspective exploded view of the electromechanical actuator shown in FIG. 7
Figure 7B:
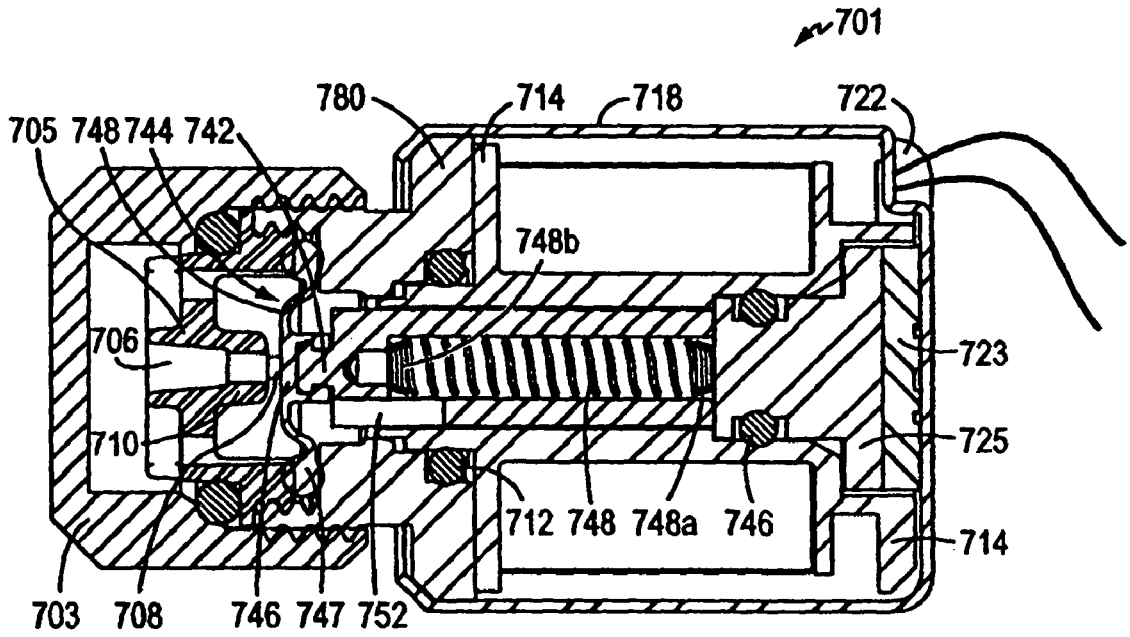
FIG. 7B is a sectional view of a second embodiment of an electromechanical actuator for controlling the valves shown in FIGS. 5 through 6B.
Figure 7C:
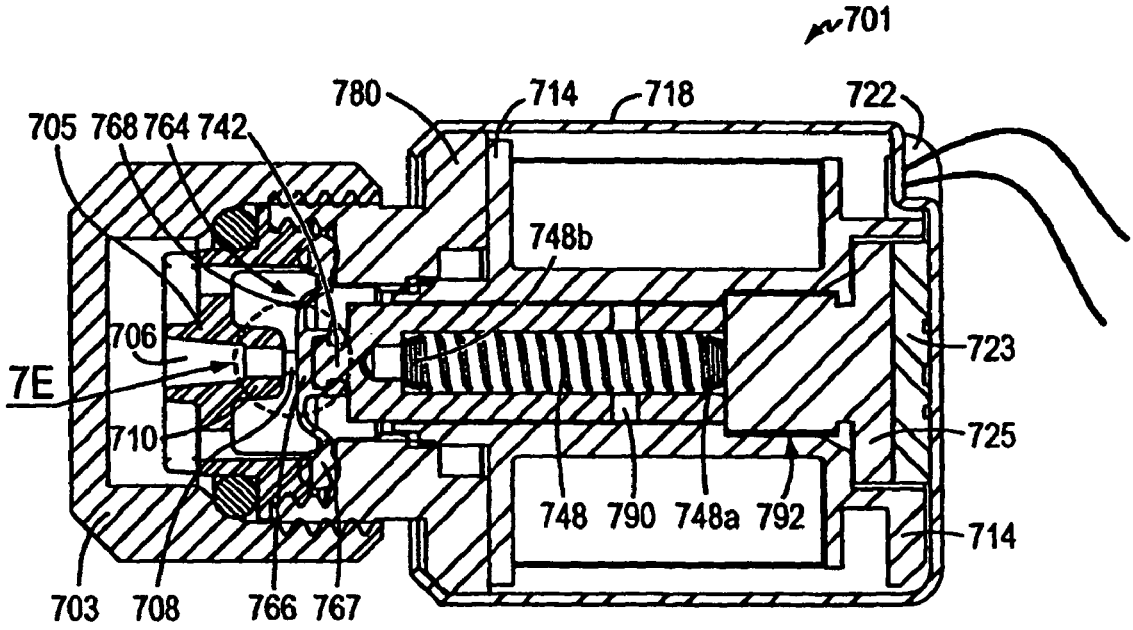
FIG. 7C is a sectional view of a third embodiment of an electromechanical actuator for controlling the valves shown in FIGS. 5 through 6B.

The automatic flushers shown in FIGS. 2, 3, and 4 may utilize various embodiments of the isolated actuator, shown in FIGS. 7, 7B and 7C. Isolated actuator 701 includes an actuator base 716, a ferromagnetic pole piece 725, a ferromagnetic armature 740 slideably mounted in an armature pocket formed inside a bobbin 714. Ferromagnetic armature 740 includes a distal end 742 (i.e., plunger 742) and an armature cavity 750 having a coil spring 748. Coil spring 748 includes reduced ends 748*a* and 748*b* for machine handling Ferromagnetic armature 740 may include one or several grooves or passages 752 providing communication from the distal end of armature 740 (outside of actuator base 716) to armature cavity 750 and to the proximal end of armature 740, at the pole piece 725, for easy movement of fluid during the displacement of the armature.

Isolated actuator body 701 also includes a solenoid windings 728 wound about solenoid bobbin 714 and magnet 723 located in a magnet recess 720. Isolated actuator body 701 also includes a resiliently deformable O-ring 712 that forms a seal between solenoid bobbin 714 and actuator base 716, and includes a resiliently deformable O-ring 730 that forms a seal between solenoid bobbin 714 and pole piece 725, all of which are held together by a solenoid housing 718. Solenoid housing 718 (i.e., can 718) is crimped at actuator base 16 to hold magnet 723 and pole piece 725 against bobbin 714 and thereby secure windings 728 and actuator base 716 together.

Isolated actuator 700 also includes a resilient membrane 744 that may have various embodiments shown and described in connection with FIGS. 7D and 7E. As shown in FIG. 7, resilient membrane 764 is mounted between actuator base 716 and a piloting button 705 to enclose armature fluid located a fluid-tight armature chamber in communication with an armature port 752. Resilient membrane 764 includes a distal end 766, O-ring like portion 767 and a flexible portion 768. Distal end 766 comes in contact with the sealing surface in the region 708. Resilient membrane 764 is exposed to the pressure of regulated fluid provided via conduit 706 in piloting button 705 and may therefore be subject to considerable external force. Furthermore, resilient membrane 764 is constructed to have a relatively low permeability and high durability for thousands of openings and closings over many years of operation.

Referring to still to FIG. 7, isolated actuator 701 is provided, for storage and shipping purposes, with a cap 703 sealed with respect to the distal part of actuator base 716 and with respect to piloting button 705 using a resiliently deformable O-ring 732. Storage and shipping cap 703 includes usually water that counter-balances fluid contained by resilient membrane 744; this significantly limits or eliminates diffusion of fluid through resilient membrane 744.

Referring still to FIG. 7, actuator base 716 includes a wide base portion substantially located inside can 718 and a narrowed base extension threaded on its outer surface to receive cap 703. The inner surface of the base extension threadedly engages complementary threads provided on the outer surface of piloting button 705. Membrane 764 includes a thickened peripheral rim 767 located between the base extension 32's lower face and piloting button 705. This creates a fluid-tight seal so that the membrane protects the armature from exposure to external fluid flowing in the main valve.

For example, the armature liquid may be water mixed with a corrosion inhibitor, e.g., a 20% mixture of polypropylene glycol and potassium phosphate. Alternatively, the armature fluid may include silicon-based fluid, polypropylene polyethylene glycol or another fluid having a large molecule. The armature liquid may in general be any substantially non-compressible liquid having low viscosity and preferably non-corrosive properties with respect to the armature. Alternatively, the armature liquid may be Fomblin or other liquid having low vapor pressure (but preferably high molecular size to prevent diffusion).

If there is anticorrosive protection, the armature material can be a low-carbon steel, iron or any soft magnetic material; corrosion resistance is not as big a factor as it would otherwise be. Other embodiments may employ armature materials such as the 420 or 430 series stainless steels. It is only necessary that the armature consist essentially of a ferromagnetic material, i.e., a material that the solenoid and magnet can attract. Even so, it may include parts, such as, say, a flexible or other tip, that is not ferromagnetic.

Resilient membrane 764 encloses armature fluid located a fluid-tight armature chamber in communication with an armature port 752 or 790 formed by the armature body. Furthermore, resilient membrane 764 is exposed to the pressure of regulated fluid in main valve and may therefore be subject to considerable external force. However, armature 740 and spring 750 do not have to overcome this force, because the conduit's pressure is transmitted through membrane 764 to the incompressible armature fluid within the armature chamber. The force that results from the pressure within the chamber therefore approximately balances the force that the conduit pressure exerts.

Referring still to FIGS. 7, 7A, 7B and 7C, armature 740 is free to move with respect to fluid pressures within the chamber between the retracted and extended positions. Armature port 752 or 790 enables the force-balancing fluid displaced from the armature chamber's lower well through the spring cavity 750 to the part of the armature chamber from which the armature's upper end (i.e. distal end) has been withdrawn upon actuation. Although armature fluid can also flow around the armature's sides, arrangements in which rapid armature motion is required should have a relatively low-flow-resistance path such as the one that port 752 or 790 helps form. Similar considerations favor use of an armature-chamber liquid that has relatively low viscosity. Therefore, the isolated operator (i.e., actuator 700) requires for operation only low amounts of electrical energy and is thus uniquely suitable for battery operation.

In the latching embodiment shown in FIG. 7, armature 740 is held in the retracted position by magnet 723 in the absence of a solenoid current. To drive the armature to the extended position therefore requires armature current of such a direction and magnitude that the resultant magnetic force counteracts that of the magnet by enough to allow the spring force to prevail. When it does so, the spring force moves armature 740 to its extended position, in which it causes the membrane 's exterior surface to seal against the valve seat (e.g., the seat of piloting button 705). In this position, the armature is spaced enough from the magnet that the spring force can keep the armature extended without the solenoid's help.

To return the armature to the illustrated, retracted position and thereby permit fluid flow, current is driven through the solenoid in the direction that causes the resultant magnetic field to reinforce that of the magnet. As was explained above, the force that the magnet 723 exerts on the armature in the retracted position is great enough to keep it there against the spring force. However, in the non-latching embodiment that doesn't include magnet 723, armature 740 remain in the retracted position only so long as the solenoid conducts enough current for the resultant magnetic force to exceed the spring force of spring 748.

Advantageously, diaphragm membrane 764 protects armature 740 and creates a cavity that is filled with a sufficiently non-corrosive liquid, which in turn enables actuator designers to make more favorable choices between materials with high corrosion resistance and high magnetic permeability. Furthermore, membrane 764 provides a barrier to metal ions and other debris that would tend to migrate into the cavity.

Diaphragm membrane 764 includes a sealing surface 766, which is related to the seat opening area, both of which can be increased or decreased. The sealing surface 766 and the seat surface of piloting button 705 can be optimized for a pressure range at which the valve actuator is designed to operate. Reducing the sealing surface 766 (and the corresponding tip of armature 740) reduces the plunger area involved in squeezing the membrane, and this in turn reduces the spring force required for a given upstream fluid-conduit pressure. On the other hand, making the plunger tip area too small tends to damage diaphragm membrane 764 during valve closing over time. Preferable range of tip-contact area to seat-opening area is between 1.4 and 12.3. The present actuator is suitable for variety of pressures of the controlled fluid. including pressures about 150 psi. Without any substantial modification, the valve actuator may be used in the range of about 30 psi to 80 psi, or even water pressures of about 125 psi.

Referring still to FIGS. 7, 7A, 7B and 7C, piloting button 705 has an important novel function for achieving consistent long-term piloting of the diaphragm valve shown in FIG. 2B, or the fram valve shown in FIG. 3B. Solenoid actuator 701 together with piloting button 705 are installed together as one assembly into the electronic flusher; this minimizes the pilot-valve-stroke variability at the pilot seat in region 708 (FIGS. 7, 7B and 7C) with respect to the closing surface (shown in detail in FIG. 7E), which variability would otherwise afflict the piloting operation. This installation is faster and simpler than prior art installations.

The assembly of operator 701 and piloting button 705 is usually put together in a factory and is permanently connected thereby holding diaphragm membrane 764 and the pressure loaded armature fluid (at pressures comparable to the pressure of the controlled fluid). Piloting button 705 is coupled to the narrow end of actuator base 716 using complementary threads or a sliding mechanism, both of which assure reproducible fixed distance between distal end 766 of diaphragm 764 and the sealing surface of piloting button 705. The coupling of operator 701 and piloting button 705 can be made permanent (or rigid) using glue, a set screw or pin. Alternatively, one member my include an extending region that is used to crimp the two members together after screwing or sliding on piloting button 705.

It is possible to install solenoid actuator 701 without piloting button 705, but this process is somewhat more cumbersome. Without piloting button 705, the installation process requires first positioning the pilot-valve body with respect to the main valve and then securing to the actuator assembly onto the main valve as to hold the pilot-valve body in place. If proper care is not taken, there is some variability in the position of the pilot body due to various piece-part tolerances and possible deformation. This variability creates variability in the pilot-valve member's stroke. In a low-power pilot valve, even relatively small variations can affect timing or possibly sealing force adversely and even prevent the pilot valve from opening or closing at all. Thus, it is important to reduce this variability during installation, field maintenance, or replacement. On the other hand, when assembling solenoid actuator 701 with piloting button 705, this variability is eliminated or substantially reduced during the manufacturing process, and thus there is no need to take particular care during field maintenance or replacement.

As described above, the main valve assembly includes a main valve body with a main-valve inlet, a main-valve seat, a main-valve outlet, a pressure chamber (i.e., a pilot chamber), and a pressure-relief outlet through which the pressure in the pressure chamber (pilot chamber) can be relieved, wherein the main valve member can be diaphragm 28 (FIG. 2B), a piston, or a fram member (FIG. 3B or FIG. 4), all of which are movable between a closed position, in which the main valve member seals against the main-valve seat thereby preventing flow from the main inlet (e.g., input 12 in FIGS. 2B, 3B or 4) to the main outlet (e.g., output 34 in FIGS. 2B, 3B or 4).

Figure 7D:
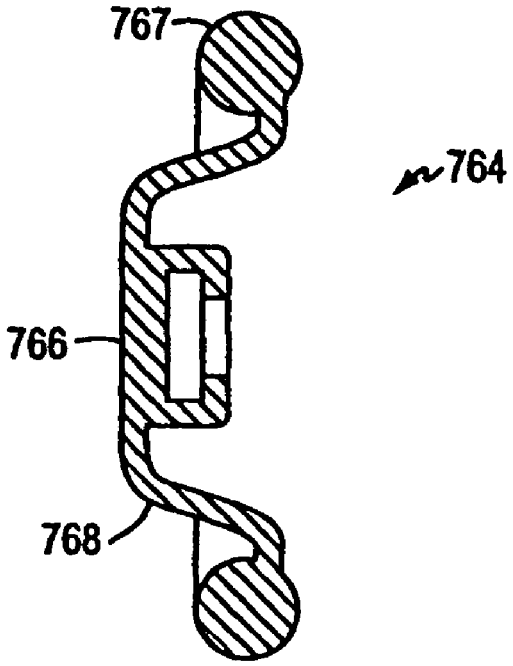
FIG. 7D is a sectional view of another embodiment of a membrane used in the actuator shown in FIGS. 7 through 7C.
Figure 7E:
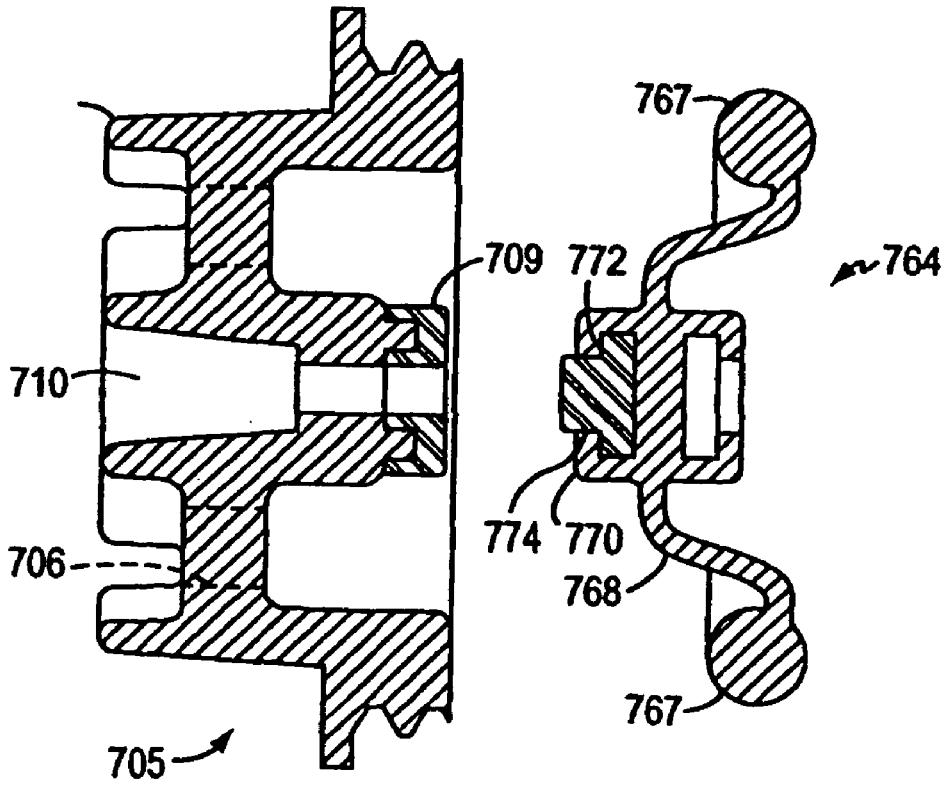
FIG. 7E is a sectional view of another embodiment of the membrane and a piloting button used in the actuator shown in FIGS. 7 through 7C.

Referring to FIGS. 7D and 7E, as described above, diaphragm membrane 764 includes an outer ring 767, flex region 768 and tip or seat region 766. The distal tip of the plunger is enclosed inside a pocket flange behind the sealing region 766. Preferably, diaphragm membrane 764 is made of EPDM due to its low durometer and compression set by NSF part 61 and relatively low diffusion rates. The low diffusion rate is important to prevent the encapsulated armature fluid from leaking out during transportation or installation process. Alternatively, diaphragm member 764 can be made out of a flouro-elastomer, e.g., VITON, or a soft, low compression rubber, such as CRI-LINE® flouro-elastomer made by CRI-TECH SP-508. Alternatively, diaphragm member 764 can be made out of a Teflon-type elastomer, or just includes a Teflon coating. Alternatively, diaphragm member 764 can be made out NBR (natural rubber) having a hardness of 40-50 durometer as a means of reducing the influence of molding process variation yielding flow marks that can form micro leaks of the contained fluid into the surrounding environment. Alternatively, diaphragm member 764 includes a metallic coating that slows the diffusion thru the diaphragm member when the other is dry and exposed to air during storage or shipping of the assembled actuator.

Preferably, diaphragm member 764 has high elasticity and low compression (which is relatively difficult to achieve). Diaphragm member 764 may have some parts made of a low durometer material (i.e., parts 767 and 768) and other parts of high durometer material (front surface 766). The low compression of diaphragm member 764 is important to minimize changes in the armature stroke over a long period of operation. Thus, contact part 766 is made of high durometer material. The high elasticity is needed for easy flexing diaphragm member 764 in regions 768. Furthermore, diaphragm part 768 is relatively thin so that the diaphragm can deflect, and the plunger can move with very little force. This is important for long-term battery operation.

Referring to FIG. 7E, another embodiment of diaphragm membrane 764 can be made to include a forward slug cavity 772 (in addition to the rear plunger cavity shaped to accommodate the plunger tip). The forward slug cavity 772 is filled with a plastic or metal slug 774. The forward surface 770 including the surface of slug 774 is cooperatively arranged with the sealing surface of piloting button 705. Specifically, the sealing surface of piloting button 705 may include a pilot seat 709 made of a different material with properties designed with respect to slug 774. For example, high durometer pilot seat 709 can be made of a high durometer material. Therefore, during the sealing action, resilient and relatively hard slug 772 comes in contact with a relatively soft pilot seat 709. This novel arrangement of diaphragm membrane 764 and piloting button 705 provides for a long term, highly reproducible sealing action.

Diaphragm member 764 can be made by a two stage molding process where by the outer portion is molded of a softer material and the inner portion that is in contact with the pilot seat is molded of a harder elastomer or thermo-plastic material using an over molding process. The forward facing insert 774 can be made of a hard injection molded plastic, such as acceptable co-polymer or a formed metal disc of a non-corrosive non-magnetic material such as 300 series stainless steel. In this arrangement, pilot seat 709 is further modified such that it contains geometry to retain pilot seat geometry made of a relatively high durometer elastomer such as EPDM 60 durometer. By employing this design that transfers the sealing surface compliant member onto the valve seat of piloting button 705 (rather than diaphragm member 764), several key benefits are derived. Specifically, diaphragm member 764 a very compliant material. There are substantial improvements in the process related concerns of maintaining proper pilot seat geometry having no flow marks (that is a common phenomena requiring careful process controls and continual quality control vigilance). This design enables the use of an elastomeric member with a hardness that is optimized for the application.

Figure 7F:
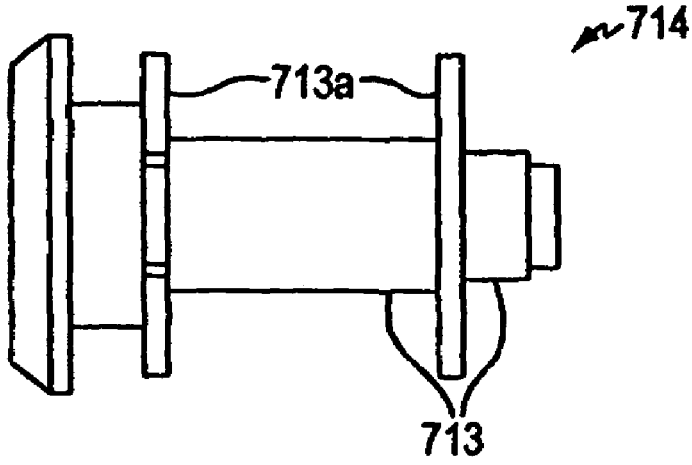
FIG. 7F is a sectional view of another embodiment of an armature bobbin used in the actuator shown in FIGS. 7 through 7C.

FIG. 7F is a cross-sectional view of another embodiment of an armature bobbin used in the actuator shown in FIGS. 7 through 7C. The bobbin's body is constructed to have low permeability to the armature fluid. For example, bobbin 714 includes metallic regions 713, which are in contact with the armature fluid, and plastic regions 713*a*, which are not in contact with the armature fluid.

Figure 8:
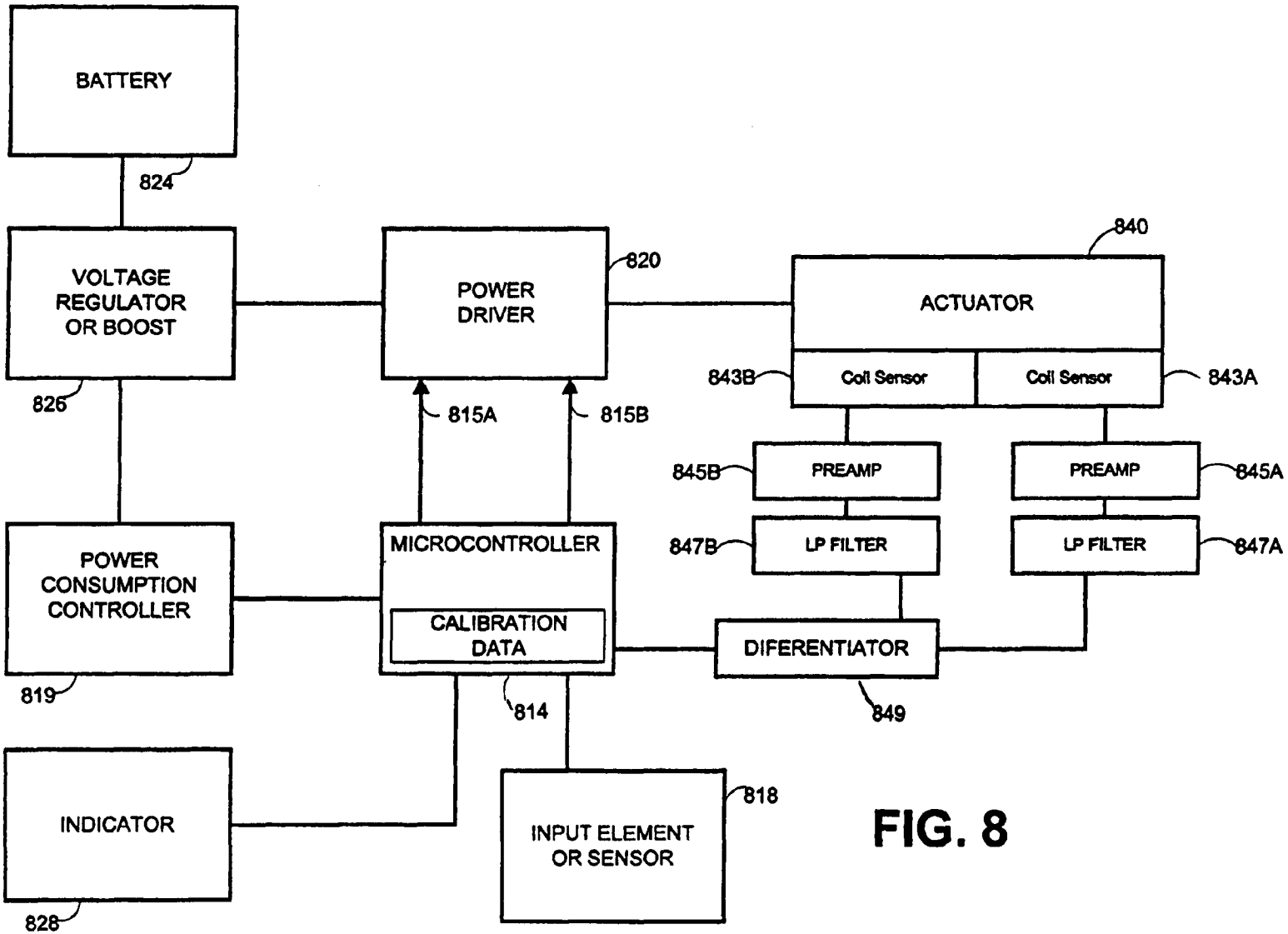
FIG. 8 is a block diagram of another embodiment of a control system for controlling operation of the electromechanical actuator shown in FIGS. 7, 7A, 7B or 7C.

FIG. 8 schematically illustrates a fluid flow control system for a latching actuator 801. The flow control system includes again microcontroller 814, power switch 818, solenoid driver 820. As shown in FIG. 7, latching actuator 701 includes at least one drive coil 728 wound on a bobbin and an armature that preferably is made of a permanent magnet. Microcontroller 814 provides control signals 815A and 815B to current driver 820, which drives solenoid 728 for moving armature 740. Solenoid driver 820 receives DC power from battery 824 and voltage regulator 826 regulates the battery power to provide a substantially constant voltage to current driver 820. Coil sensors 843A and 843B pickup induced voltage signal due to movement of armature 740 and provide this signal to a conditioning feedback loop that includes preamplifiers 845A, 845B and flow-pass filters 847A, 847B. That is, coil sensors 843A and 843B are used to monitor the armature position.

Microcontroller 814 is again designed for efficient power operation. Between actuations, microcontroller 814 goes automatically into a low frequency sleep mode and all other electronic elements (e.g., input element or sensor 818, power driver 820, voltage regulator or voltage boost 826, signal conditioner 822) are powered down. Upon receiving an input signal from, for example, a motion sensor, microcontroller 814 turns on a power consumption controller 819. Power consumption controller 819 powers up signal conditioner that provides power to microcontroller 814.

Also referring to FIG. 7, to close the fluid passage 708, microcontroller 814 provides a "close" control signal 815A to solenoid driver 820, which applies a drive voltage to the coil terminals. Provided by microcontroller 814, the "close" control signal 815A initiates in solenoid driver 820 a drive voltage having a polarity that the resultant magnetic flux opposes the magnetic field provided by permanent magnet 723. This breaks the magnet 723's hold on armature 740 and allows the return spring 748 to displace valve member 740 toward valve seat 708. In the closed position, spring 748 keeps diaphragm member 764 pressed against the valve seat of piloting button 705. In the closed position, there is an increased distance between the distal end of armature 740 and pole piece 725. Therefore, magnet 723 provides a smaller magnetic force on the armature 740 than the force provided by return spring 748.

To open the fluid passage, microcontroller 814 provides an "open" control signal 815B (i.e., latch signal) to solenoid driver 820. The "open" control signal 815B initiates in solenoid driver 820 a drive voltage having a polarity that the resultant magnetic flux opposes the force provided by bias spring 748. The resultant magnetic flux reinforces the flux provided by permanent magnet 723 and overcomes the force of spring 748. Permanent magnet 723 provides a force that is great enough to hold armature 740 in the open position, against the force of return spring 748, without any required magnetic force generated by coil 728.

Referring to FIG. 8, microcontroller 814 discontinues current flow, by proper control signal 815A or 815B applied to solenoid driver 820, after armature 740 has reached the desired open or closed state. Pickup coils 843A and 843B (or any sensor, in general) monitor the movement (or position) of armature 740 and determine whether armature 740 has reached its endpoint. Based on the coil sensor data from pickup coils 843A and 843B (or the sensor), microcontroller 814 stops applying the coil drive, increases the coil drive, or reduces the coil drive.

To open the fluid passage, microcontroller 814 sends OPEN signal 815B to power driver 820, which provides a drive current to coil 842 in the direction that will retract armature 740. At the same time, coils 843A and 843B provide induced signal to the conditioning feedback loop, which includes a preamplifier and a low-pass filter. If the output of a differentiator 849 indicates less than a selected threshold calibrated for armature 740 reaching a selected position (e.g., half distance between the extended and retracted position, or fully retracted position, or another position), microcontroller 814 maintains OPEN signal 815B asserted. If no movement of armature 740 is detected, microcontroller 814 can apply a different level of OPEN signal 815B to increase the drive current (up to several time the normal drive current) provided by power driver 820. This way, the system can move armature 740, which is stuck due to mineral deposits or other problems.

Microcontroller 814 can detect armature displacement (or even monitor armature movement) using induced signals in coils 843A and 843B provided to the conditioning feedback loop. As the output from differentiator 849 changes in response to the displacement of armature 740, microcontroller 814 can apply a different level of OPEN signal 815B, or can turn off OPEN signal 815B, which in turn directs power driver 820 to apply a different level of drive current. The result usually is that the drive current has been reduced, or the duration of the drive current has been much shorter than the time required to open the fluid passage under worst-case conditions (that has to be used without using an armature sensor). Therefore, the system of FIG. 8 saves considerable energy and thus extends life of battery 824.

Advantageously, the arrangement of coil sensors 843A and 843B can detect latching and unlatching movement of armature 740 with great precision. (However, a single coil sensor, or multiple coil sensors, or capacitive sensors may also be used to detect movement of armature 740.) Microcontroller 814 can direct a selected profile of the drive current-applied by power driver 820. Various profiles may be stored in, microcontroller 814 and may be actuated based on the fluid type, fluid pressure, fluid temperature, the time actuator 840 has been in operation since installation or last maintenance, a battery level, input from an external sensor (e.g., a movement sensor or a presence sensor), or other factors.

Optionally, microcontroller 814 may include a communication interface for data transfer, for example, a serial port, a parallel port, a USB port, of a wireless communication interface (e.g., an RF interface). The communication interface is used for downloading data to microcontroller 814 (e.g., drive curve profiles, calibration data) or for reprogramming microcontroller 814 to control a different type of actuation or calculation.

Figure 9:
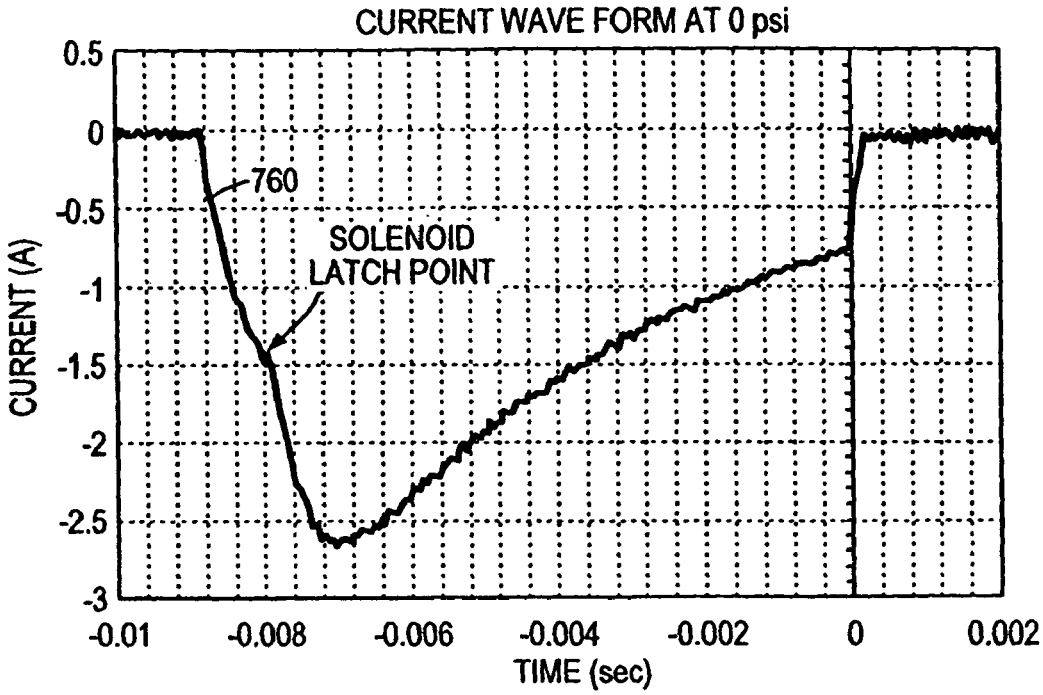
FIGS. 9 and 9A show the relationship of current and time for the valve actuator shown in FIG. 7, 7A, 7B or 7C connected to a water line at 0 psi and 120 psi reverse flow pressure, respectively.
Figure 9A:
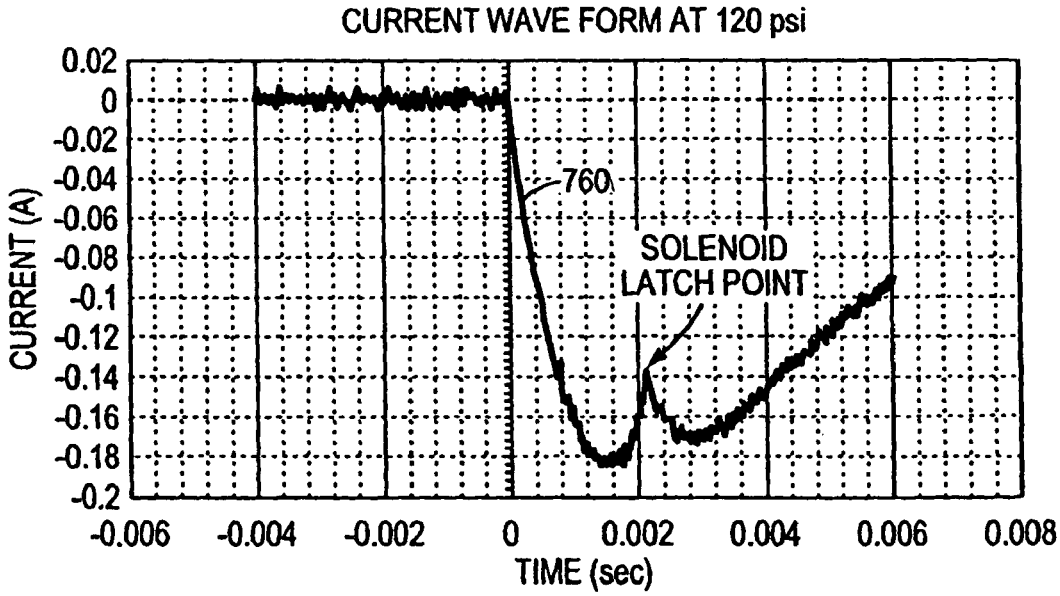
Figure 9B:
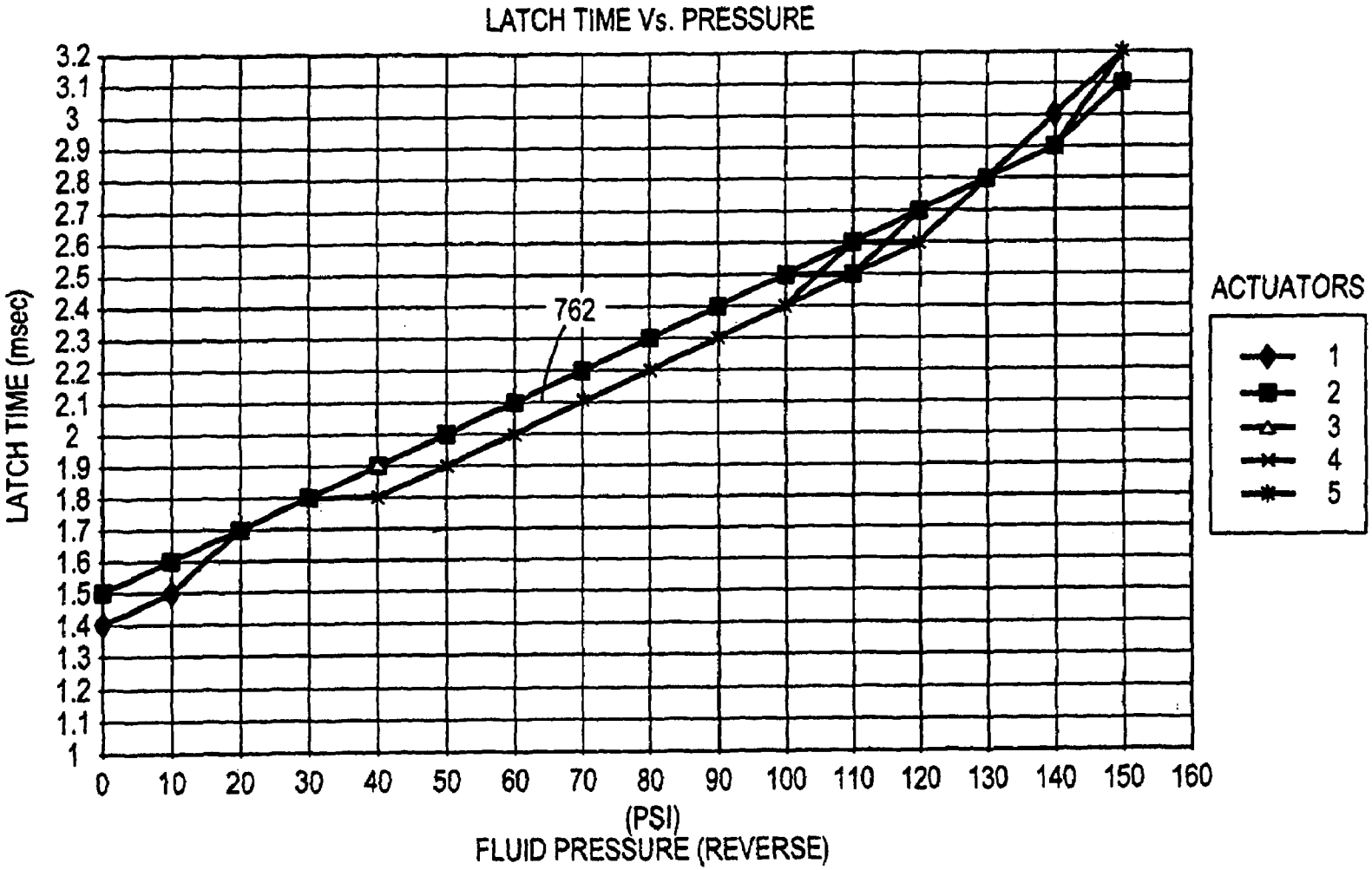
FIG. 9B illustrates a dependence of the latch time on the water pressure for the actuator shown in FIG. 7, 7A, 7B or 7C.

Referring to FIG. 7, electromagnetic actuator 701 is connected in a reverse flow arrangement when the water input is provided via passage 706 of piloting button 705. Alternatively, electromagnetic actuator 701 is connected in a forward flow arrangement when the water input is provided via passage 710 of piloting button 705 and exits via passage 706. In the forward flow arrangement, the plunger "faces directly" the pressure of the controlled fluid delivered by passage 710. That is, the corresponding fluid force acts against spring 748. In both forward and reverse flow arrangements, the latch or unlatch times depend on the fluid pressure, but the actual latch time dependence is different. In the reverse flow arrangement, the latch time (i.e., time it takes to retract plunger 740) increases with the fluid pressure substantially linearly, as shown in FIG. 9B. On the other hand, in the forward flow arrangement, the latch time decreases with the fluid pressure. Based on this latch time dependence, microcontroller 814 can calculate the actual water pressure and thus control the water amount delivery.

Figure 8A:
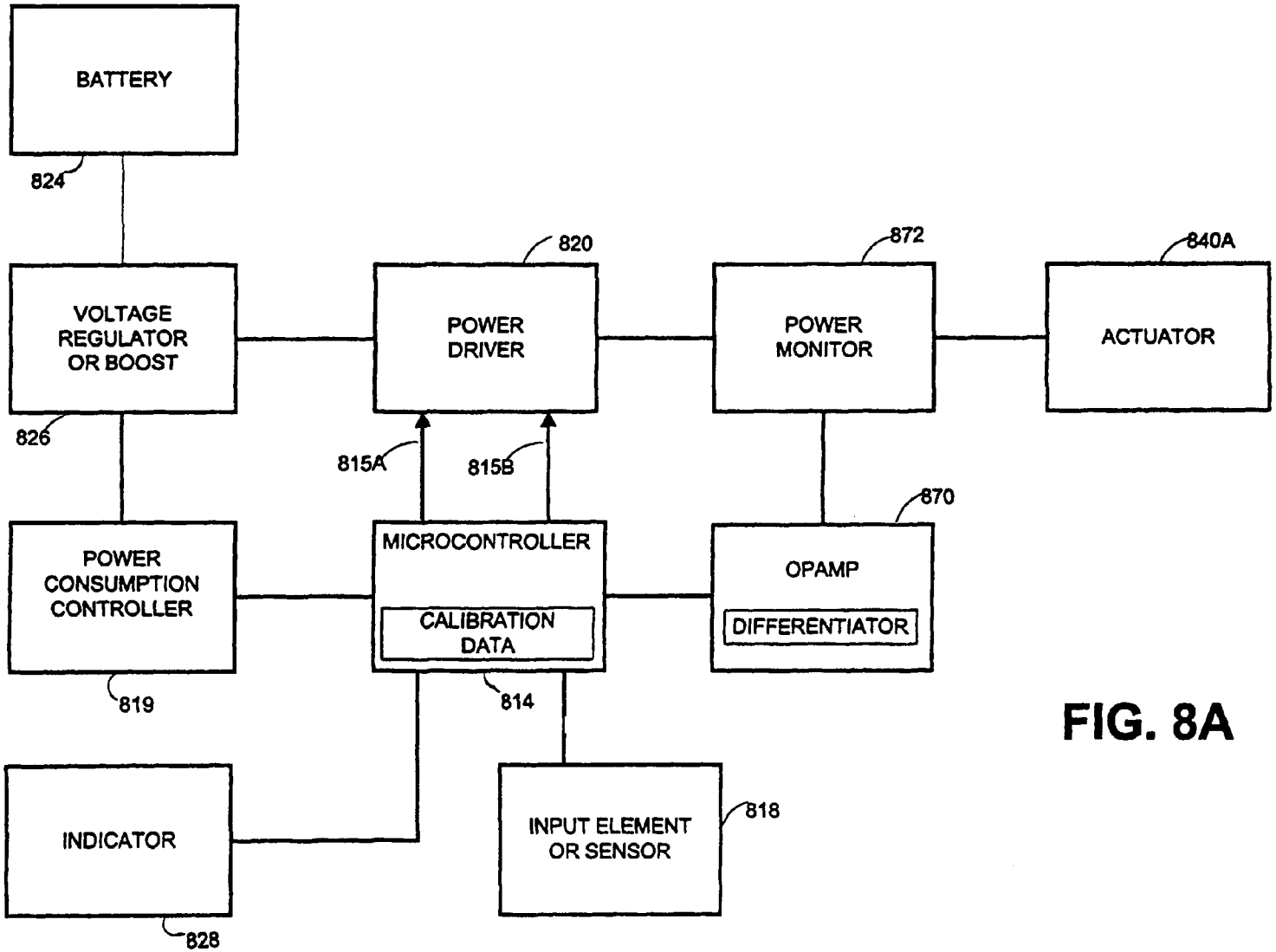
FIG. 8A is a block diagram of yet another embodiment of a control system for controlling operation of the electromechanical actuator shown in FIGS. 7, 7A, 7B or 7C.
Figure 8B:
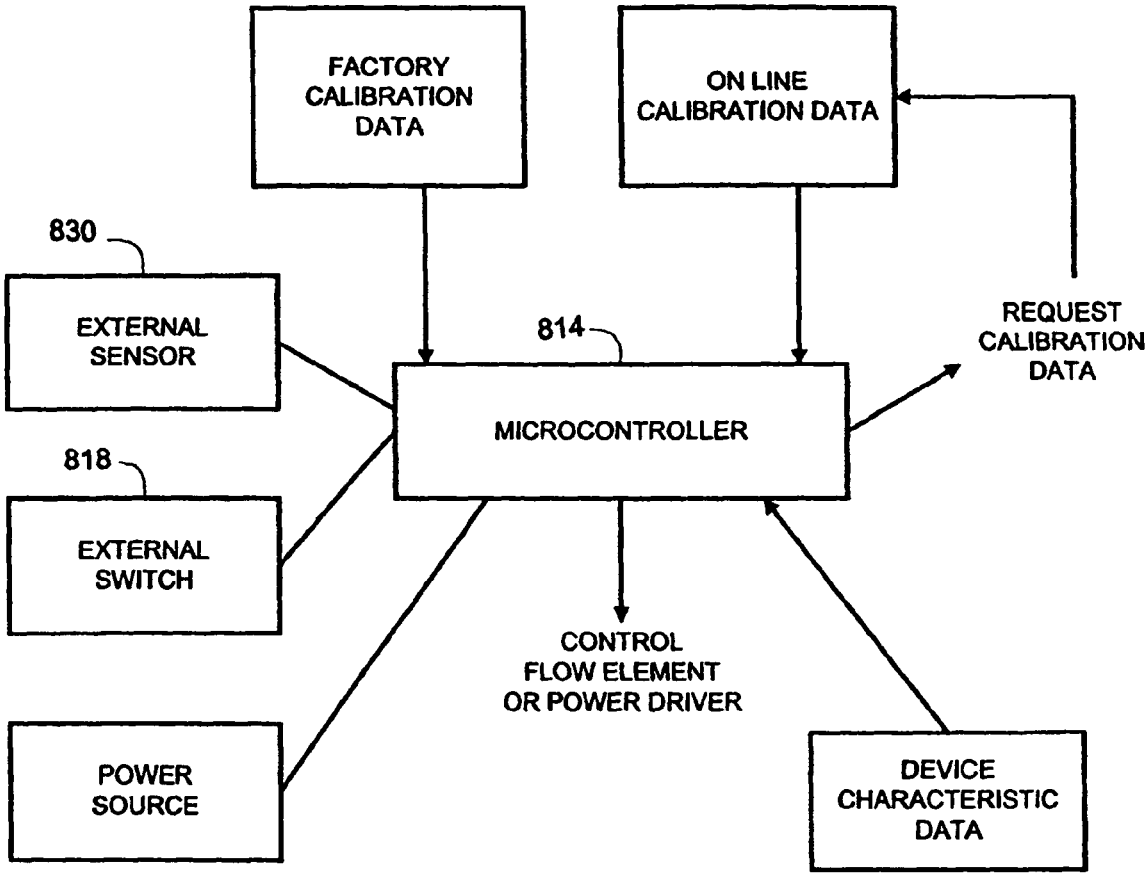
FIG. 8B is a block diagram of data flow to a microcontroller used in the fluid flow control system of FIG. 8A or 8B.

FIG. 8A schematically illustrates a fluid flow control system for another embodiment of the latching actuator. The flow control system includes again microcontroller 814, power consumption controller 819, solenoid driver 820 receiving power from a battery 824 or voltage booster 826, and an indicator 828. Microcontroller 814 operates in both sleep mode and operation mode, as described above. Microcontroller 814 receives an input signal from an input element 818 (or any sensor) and provides control signals 815A and 815B to current driver 820, which drives the solenoid of a latching valve actuator 701. Solenoid driver 820 receives DC power from battery 824 and voltage regulator 826 regulates the battery power. A power monitor 872 monitors power signal delivered to the drive coil of actuator 701 and provides a power monitoring signal to microcontroller 814 in a feedback arrangement having operational amplifier 870. Microcontroller 814 and power consumption controller 819 are designed for efficient power operation, as described above.

Also referring to FIG. 8A, to close the fluid passage, microcontroller 814 provides a "close" control signal 815A to solenoid driver 820, which applies a drive voltage to the actuator terminals and thus drives current through coil 728. Power monitor 872 may be a resistor connected for applied drive current to flow through (or a portion of the drive current) Power monitor 872 may alternatively be a coil or another element. The output from power monitor 872 is provided to the differentiator of signal conditioner 870. The differentiator is used to determine a latch point, as shown in FIG. 9A.

Similarly as described in connection with FIG. 8, to open the fluid passage, microcontroller 814 sends CLOSE signal 815A or OPEN signal 815B to valve driver 820, which provides a drive current to coil 728 in the direction that will extent or retract armature 740 (and close or open passage 708). At the same time, power monitor 872 provides a signal to opamp 870. Microcontroller 814 determines if armature 740 reached the desired state using the power monitor signal. For example, if the output of opamp 870 initially indicates no latch state for armature 740, microcontroller 814 maintains OPEN signal 815B, or applies a higher level of OPEN signal, as described above, to apply a higher drive current. On the other hand, if armature 740 reached the desired state (e.g., latch state shown in FIG. 9A), microcontroller 814 applies a lower level of OPEN signal 815B, or turns off OPEN signal 815B. This usually reduces the duration of drive current or the level of the drive current as compared to the time or current level required to open the fluid passage under worst-case conditions. Therefore, the system of FIG. 8A saves considerable energy and thus extends life of battery 824.

Figure 10:
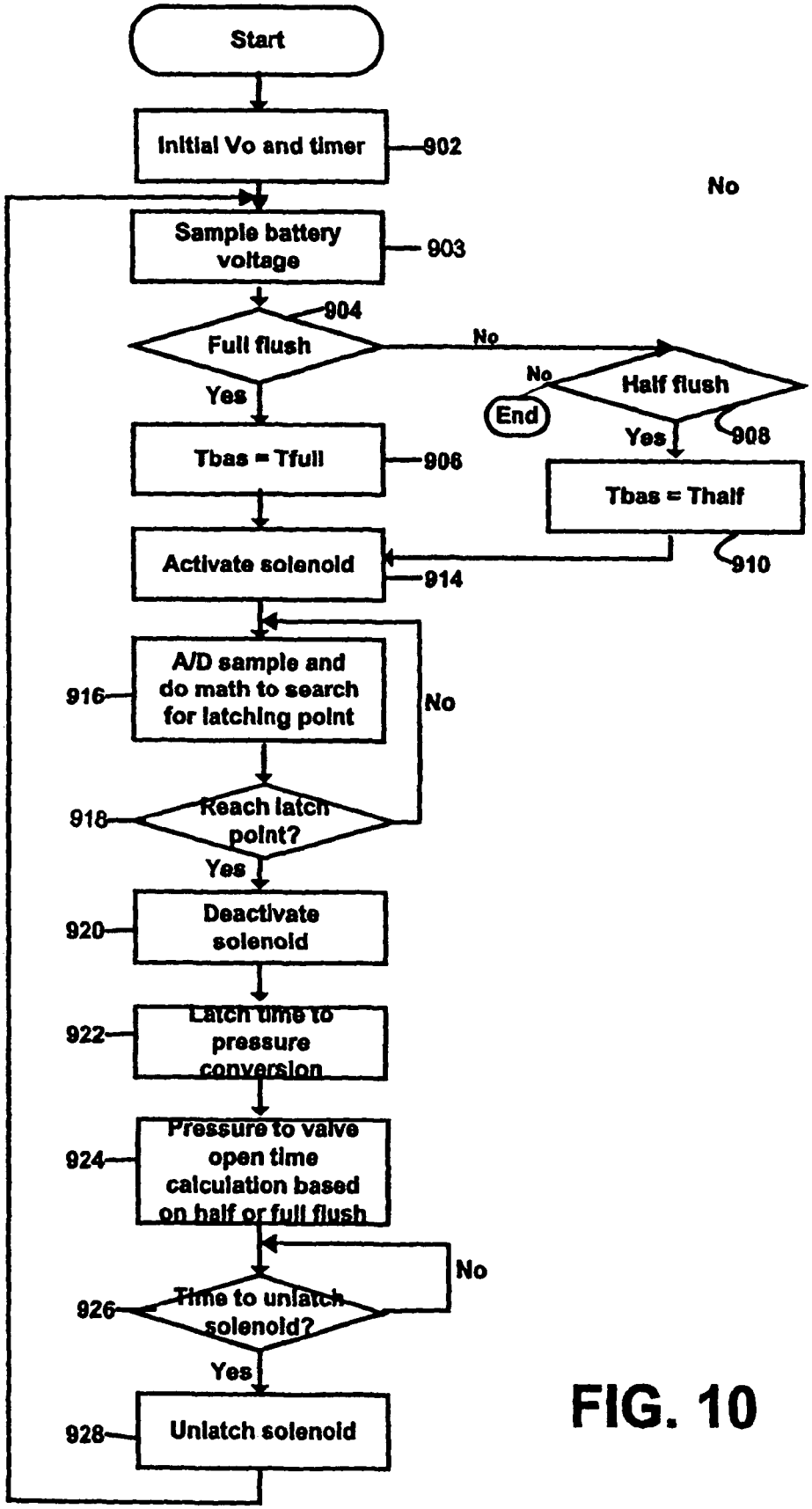
FIG. 10 is a flow diagram of a flushing cycle used to control the flushers shown in FIGS. 2, 3 or 4.

Referring to FIG. 10, flow diagram 900 illustrates the operation of microcontroller 814 during a flushing cycle. Microcontroller 814 is in a sleep mode, as described above. Upon an input signal from the input element or external sensor, microcontroller 814 is initialed and the timer is set to zero (step 902). In step 904, if the valve actuator performs a full flush, the time $T_{bas}$ equals $T_{full}$ (step 906). If there is no full flush, the timer is set in step 910 to $T_{bas}$ equals $T_{half}$. In step 912, microcontroller samples the battery voltage prior to activating the actuator in step 914. After the solenoid of the actuator is activated, microcontroller 814 searches for the latching point (see FIG. 9 or 9A). When the timer reaches the latching point (step 918), microcontroller 814 deactivates the solenoid (step 920). In step 922, based on the latch time, microcontroller 814 calculates the corresponding water pressure, using stored calibration data. Based on the water pressure and the known amount of water discharged by the tank flusher, the microcontroller decides on the unlatch time, (i.e., closing time) of the actuator (step 926). After the latching time is reached, microcontroller 14 provides the "close" signal to current driver 820 (step 928). After this point the entire cycle shown in flow diagram 900 is repeated.

Referring to FIGS. 12A and 12B, blocks 200 and 202 represent the fact that the controller remains in its sleep mode until timer 190 generates a pulse. When the pulse occurs, the processor begins executing stored programming at a predetermined entry point represented by block 204. It proceeds to perform certain initialization operations exemplified by block 206's step of setting the states of its various ports and block 208's step of detecting the state of FIG. 2's push button 210. That push button, which is mounted on the flusher housing 146 for ready accessibility by a user, contains a magnet 210*a* whose proximity to the main circuit board 126 increases when the button is depressed. The circuit board includes a reed switch 211 that, as FIG. 6 suggests, generates an input to the control circuit in response to the resultant increased magnetic field on circuit board 126.

Push button 210's main purpose is to enable a user to operate the flusher manually. As FIG. 12's blocks 212, 214, 216, 217, and 218 indicate, the control circuit 180 ordinarily responds to that button's being depressed by initiating a flush operation if one is not already in progress, and if the button has not been depressed continuously for the previous thirty seconds.

This thirty-second condition is imposed in order to allow batteries to be installed during manufacture without causing significant energy drain between the times when the batteries are installed in the unit and when the unit is installed in a toilet system. Specifically, packaging for the flusher can be so designed that, when it is closed, it depresses the push button 210 and keeps it depressed so long as the packaging remains closed. It will typically have remained closed in this situation for more than thirty seconds, so, as FIG. 12's block 220 shows, the controller returns to its sleep mode without having caused any power drain greater than just enough to enable the controller to carry out a few instructions. That is, the controller has not caused power to be applied to the several circuits used for transmitting infrared radiation or driving current through the flush-valve operator.

Among the ways in which the sleep mode conserves power is that the microprocessor circuitry is not clocked, but some power is still applied to that circuitry in order to maintain certain minimal register state, including predetermined fixed values in several selected register bits. When batteries are first installed in the flusher unit, though, not all of those register bits will have the predetermined values. Block 222 represents determining whether those values are present. If not, then the controller concludes that batteries have just been installed, and it enters a power-up mode, as block 224 indicates.

The power-up mode deals with the fact that the proportion of sensor radiation reflected back to the sensor receiver in the absence of a user differs in different environments. The power-up mode's purpose is to enable an installer to tell the system what that proportion is in the environment is which the flusher has been installed. This enables the system thereafter to ignore background reflections. During the power-up mode, the object sensor operates without opening the valve in response to target detection. Instead, it operates a visible LED whenever it detects a target, and the installer adjusts, say, a potentiometer to set the transmitter's power to a level just below that at which, in the absence of a valid target, the visible LED's illumination nonetheless indicates that a target has been detected. This tells the system what level will be considered the maximum radiation level permissible for this installation.

Among the steps involved in entering this power-up mode is to apply power to certain subsystems that must remain on continually if they are to operate. Among these, for instance, is the sensor's receiver circuit. Whereas the infrared transmitter needs only to be pulsed, and power need not be applied to it between pulses, the receiver must remain powered between pulses so that it can detect the pulse echoes.

Another subsystem that requires continuous power application in the illustrated embodiment is a low-battery detector. As was mentioned above, the control circuitry receives an unregulated output from the power supply, and it infers from that output's voltage whether the battery is running low, as block 226 indicates. If it is low, then a visible-light-emitting diode or some other annunciator, represented in FIG. 4A by block 228, is operated to give the user an indication of the low-battery state.

Now, the battery-check operation that block 226 represents can be reached without the system's having performed block 224's operation in the same cycle, so block 226's battery-check operation is followed by the step, represented by block 230, of determining whether the system currently is in the power-up mode.

In the illustrated embodiment, the system is arranged to operate in this power-up mode for ten minutes, after which the installation process has presumably been completed and a visible target-detection indicator is no longer needed. If, as determined in the block-230 operation, the system is indeed in the power-up mode, it performs block 232's step of determining whether it has been in that mode for more than ten minutes, the intended length of the calibration interval. If so, it resets the system so that it will not consider itself to be in the power-up mode the next time it awakens.

For the current cycle, though, it is still in its power-up mode, and it performs certain power-up-mode operations. One of those, represented by block 234, is to determine from the unregulated power-supply output whether any of the batteries have been installed in the wrong direction. If any have, the system simply goes back to sleep, as block 236 indicates. Otherwise, as block 238 indicates, the system checks its memory to determine whether it has commanded the valve operator five times in a row to close the flush valve, as the illustrated embodiment requires in the power-up mode. We have found that thus ordering the valve to close when the system is first installed tends to prevent inadvertent flushing during initial installation.

As block 242 indicates, the system then determines whether a target has been detected. If is has, the system sets a flag, as block 244 indicates, to indicate that the visible LED should be turned on and thereby notify the installer of this fact. This completes the power-up-mode-specific operations.

The system then proceeds with operations not specific to that mode. In the illustrated embodiment, those further operations actually are intended to be performed only once every second, whereas the timer wakes the system every 250 msec. As block 246 indicates, therefore, the system determines whether a full second has elapsed since the last time it performed the operations that are to follow. If not, the system simply goes back to sleep, as block 248 indicates.

If a full second has elapsed, on the other hand, the system turns on a visible LED if it had previously set some flag to indicate that this should be that LED's state. This operation, represented by blocks 250 and 252, is followed by block 254's step of determining whether the valve is already open. If it is, the routine calls a further routine, represented by block 256, in which it consults timers, etc. to determine whether the valve should be closed. If it should, the routine closes the valve. The system then returns to the sleep mode.

If the valve is not already open, the system applies power, as block 258 indicates, to the above-mentioned subsystems that need to have power applied continuously. Although that power will already have been applied if this step is reached from the power-up mode, it will not yet have been applied in the normal operating mode.

That power application is required at this point because the subsystem that checks battery power needs it. That subsystem's output is then tested, as blocks 260 and 262 indicate. If the result is a conclusion that battery power is inadequate, then the system performs block 264's and block 266's steps of going back to sleep after setting a flag to indicate that it has assumed the power-up mode. Setting the flag causes any subsequent wake cycle to include closing the valve and thereby prevents uncontrolled flow that might otherwise result from a power loss.

Now, it is desirable from a maintenance standpoint for the system not to go too long without flushing. If twenty-four hours have elapsed without the system's responding to a target by flushing, the routine therefore causes a flush to occur and then goes to sleep, as blocks 268, 270, and 272 indicate. Otherwise, the system transmits infrared radiation into the target region and senses any resultant echoes, as block 274 indicates. It also determines whether the resultant sensed echo meets certain criteria for a valid target, as block 276 indicates.

The result of this determination is then fed to a series of tests, represented by block 278, for determining whether flushing should occur. A typical test is to determine whether a user has been present for at least a predetermined minimum time and then has left, but several other situations may also give rise to a determination that the valve should be opened. If any of these situations occurs, the system opens the valve, as block 280 indicates. If the visible LED and analog power are on at this point, they are turned off, as block 282 indicates. As block 284 indicates, the system then goes to sleep.

Figures 13, 13A:
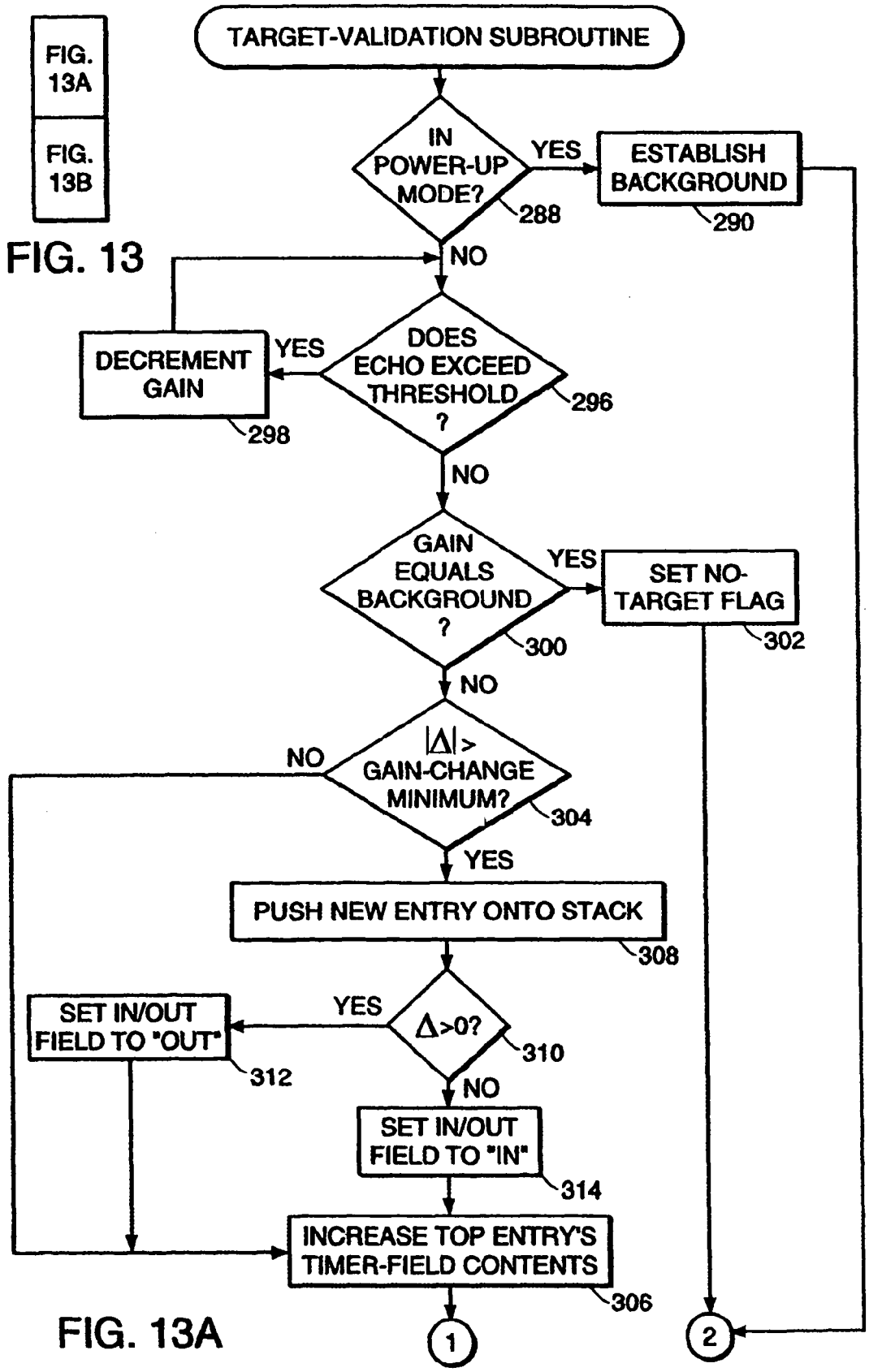
FIGS. 13A and 13B together form a more-detailed flow chart of a step in the routine of FIGS. 12A, 12B, and 12C.
Figure 13B:
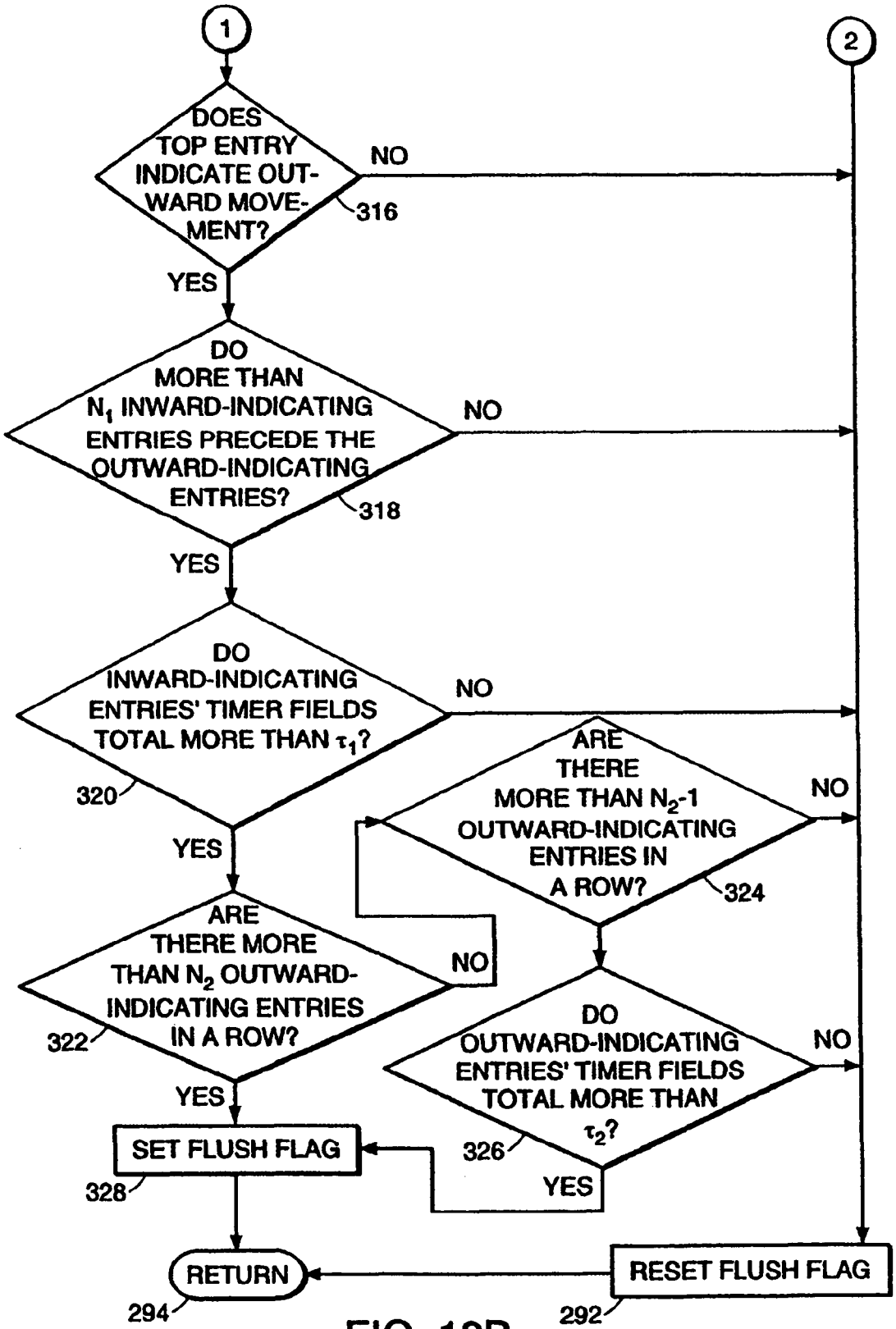
Figure 14:
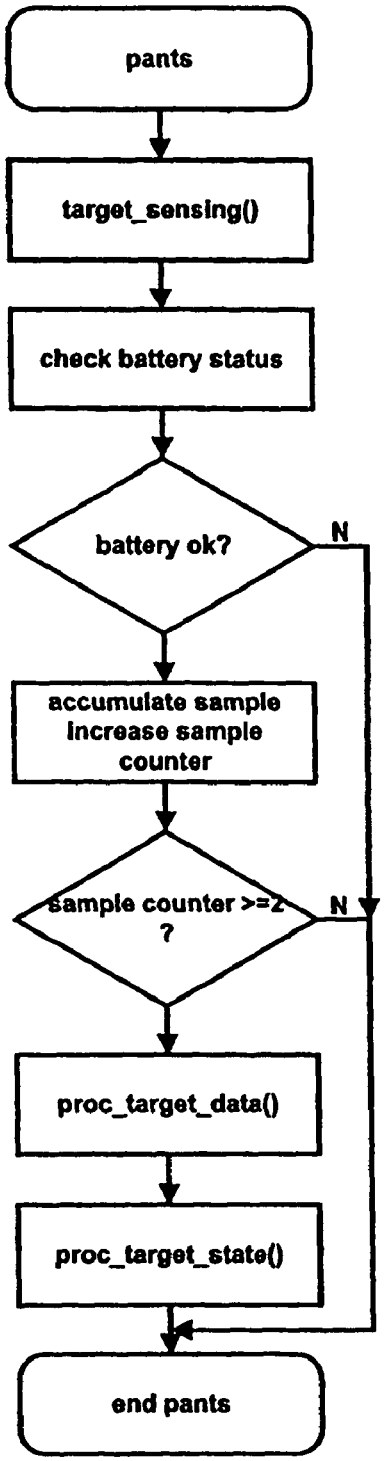
FIG. 14 illustrates a novel algorithm for controlling operation of the flushers

Block 276's operation of determining whether a valid target is present includes a routine that FIGS. 13A and 13B together, ("FIG. 13") depict. If, as determined in the step represented by that drawing's block 288, the system is in its power-up mode, then a background gain is established in the manner explained above. Block 290 represents determining that level.

The power-up mode's purpose is to set a background level, not to operate the flush valve, so the background-determining step 290 is followed by the block-292 operation of resetting a flag that, if set, would cause other routines to open the flush valve. The FIG. 13 routine then returns, as block 294 indicates.

If the step of block 288 instead indicates that the system is not in the power-up mode, the system turns to obtaining an indication of what percentage of the transmitted radiation is reflected back to the sensor. Although any way of obtaining such an indication is suitable for use with the present invention, a way that tends to conserve power is to vary the transmitted power in such a way as to find the transmitted-power level that results in a predetermined set value of received power. The transmitted-power level thereby identified is an (inverse) indication of the reflection percentage. By employing this approach, the system can so operate as to limit its transmission power to the level needed to obtain a detectable echo.

In principle, the illustrated embodiment follows this approach. In practice, the system is arranged to transmit only at certain discrete power levels, so it in effect identifies the pair of discrete transmitted-power levels in response to which the reflected-power levels bracket the predetermined set value of received power. Specifically, it proceeds to block 296's and block 298's steps of determining whether the intensity of the reflected infrared light exceeds a predetermined threshold and, if it does, reducing the system's sensitivity—typically by reducing the transmitted infrared-light intensity—until the reflected-light intensity falls below the threshold. The result is the highest gain value that yields no target indication.

In some cases, though, the reflected-light intensity falls below the threshold even when, if the sensitivity were to be increased any further, the system would (undesirably) detect background objects, such as stall doors, whose presence should not cause flushing. The purpose of block 290's step was to determine what this sensitivity was, and the steps represented by blocks 300 and 302 set a no-target flag if the infrared echo is less than the threshold even with the gain at this maximum, background level. As the drawing shows, this situation also results in the flush flag's being reset and the routine's immediately returning.

If the block-300 step instead results in an indication that the echo intensity can be made lower than the threshold return only if the sensitivity is below the background level, then there is a target that is not just background, and the routine proceeds to steps that impose criteria intended to detect when a user has left the facility after having used it. To impose those criteria, the routine maintains a push-down stack onto which it pushes entries from time to time. Each entry has a gain field, a timer field, and an in/out field.

Block 304 represents determining whether the absolute value of the difference between the current gain and the gain listed in the top stack entry exceeds a threshold gain change. If it does not, the current call of this routine results in no new entry's being pushed onto the stack, but the contents of the existing top entry's timer field are incremented, as block 306 indicates. If the block-304 step's result is instead that the gain change's absolute value was indeed greater than the threshold, then the routine pushes a new entry on to the stack, placing the current gain in that entry's gain field and giving the timer field the value of zero. In short, a new entry is added whenever the target's distance changes by a predetermined step size, and it keeps track of how long the user has stayed in roughly the same place without making a movement as great as that step size.

As blocks 310, 312, and 314 indicate, the routine also gives the entry's in/out field an "out" value, indicating that the target is moving away from the flusher, if the current gain exceeds the previous entry's gain, and it gives that field an "in" value if the current gain is less than the previous entry's gain. In either case, the routine then performs the block-306 step of incrementing the timer (to a value of "1") and moves from the stack-maintenance part of the routine to the part in which the valve-opening criteria are actually applied.

Block 316 represents applying the first criterion, namely, whether the top entry's in/out field indicates that the target is moving away. If the target does not meet this criterion, the routine performs the block-292 step of setting the flush flag to the value that will cause subsequent routines not to open the flush valve, and the routine returns, as block 294 indicates. If that criterion is met, on the other hand, the routine performs block 318's step of determining whether the top entry and any immediately preceding entries indicating that the target is moving away are preceded by a sequence of a predetermined minimum number of entries that indicated that the target was moving in. If they were not, then it is unlikely that a user had actually approached the facility, used it, and then moved away, so the routine again returns after resetting the flush flag. Note that the criterion that the block-318 step applies is independent of absolute reflection percentage; it is based only on reflection-percentage changes, requiring that the reflection percentage traverse a minimum range as it increases.

If the step of block 318 instead determines that the requisite number of inward-indicating entries did precede the outward-indicating entries, then the routine imposes the block-320 criterion of determining whether the last inward-movement-indicating entry has a timer value representing at least, say, 5 seconds. This criterion is imposed to prevent a flush from being triggered when the facility was not actually used. Again, the routine returns after resetting the flush flag if this criterion is not met.

If it is met, on the other hand, then the routine imposes the criteria of blocks 322, 324, and 326, which are intended to determine whether a user has moved away adequately. If the target appears to have moved away by more then a threshold amount, as determined by block 322, or has moved away slightly less but has appeared to remain at that distance for greater then a predetermined duration, as determined in blocks 324 and 326, then, as block 328 indicates, the routine sets the flush flag before returning. Otherwise, it resets the flush flag.

The test of FIG. 13 is typically only one of the various tests that FIG. 12B's operation 276 includes. But it gives an example of how the illustrated system reduces problems that variations in user-clothing colors would otherwise make more prevalent. As a perusal of FIG. 13 reveals, a determination of whether a user has arrived and/or left is based not on absolute gain values but rather on relative values, which result from comparing successive measurements. This reduces the problem, which afflicts other detection strategies more severely, of greater sensitivity to light-colored clothing than to dark-colored clothing.

It was mentioned above that the illustrated system employs a visible-light-emitting diode ("visible LED"). In most cases, the visible LED's location is not crucial, so long as a user can really see its light. One location, for instance, could be immediately adjacent to the photodiode; FIG. 4A shows a non-roughened region 330 in the flange of receiver-lens part 152', and the visible LED could be disposed in registration with this region. In the embodiment of FIG. 2, though, no such separate visible LED is apparent. The reason why is that the visible LED in that embodiment is provided as a part of a combination-LED device 132, which also includes the transmitter's infrared source.

Figure 11:
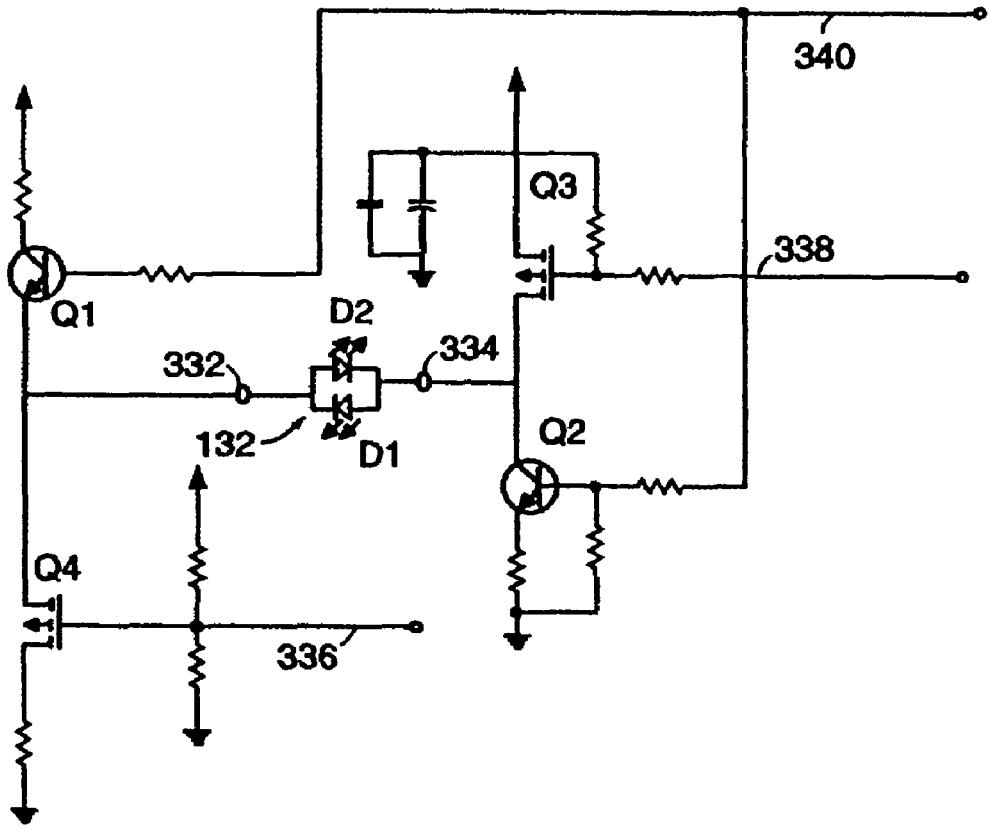
FIG. 11 is a schematic diagram of the circuitry that the flusher uses to drive its light-emitting diodes.

To operate the two-color LED, transmitter and annunciator circuits 184 and 228 (FIG. 4A) together take the form shown in FIG. 11. That circuitry is connected to the two-color LED's terminals 332 and 334. The control circuit separately operates the two-color LED's infrared-light-emitting diode D1 and the visible-light-emitting diode D2 by driving control lines 336, 338, and 340 selectively. Specifically, driving line 340 high turns on transistors Q1 and Q2 and thereby drives the visible-light-emitting diode D2, at least if line 338 is held high to keep transistor Q3 turned off. If line 340 is driven low, on the other hand, and line 338 is also driven low, then infrared-light-emitting diode D1 is allowed to conduct, with a power that is determined by the voltage applied to a line 336 that controls transistor 04.

It was stated above in connection with FIG. 12's blocks 214, 217, and 220 that the system goes to sleep if the push button has remained depressed for over 30 seconds. FIG. 6 illustrates packaging that takes advantage of this feature to keep power use negligible before the kit is installed, even if the kit includes installed batteries while it is in inventory or being transported. To adapt a previously manual system to automatic operation, a prospective user may acquire a flow controller that, for example, contains all of the elements depicted in FIG. 2A except the through-diaphragm feed tube 38. This flow controller, identified by reference numeral 348 in FIG. 6D, is delivered in a container comprising a generally rectangular cardboard box 350. The box's top includes an inner flap 352, which is closed first, and an outer flap 354, which is closed over the inner flap. Tabs 356 that fit into slots 358 provided in the box body keep the box closed. To keep the button depressed while the box is closed, the box is provided with a button activator 360 so mounted on the inner flap 352 that it registers with the push button 310 when that flap is closed. The package may be provided with inserts, not shown, to ensure that the flow controller's push button registers correctly with the activator.

Figure 6B:
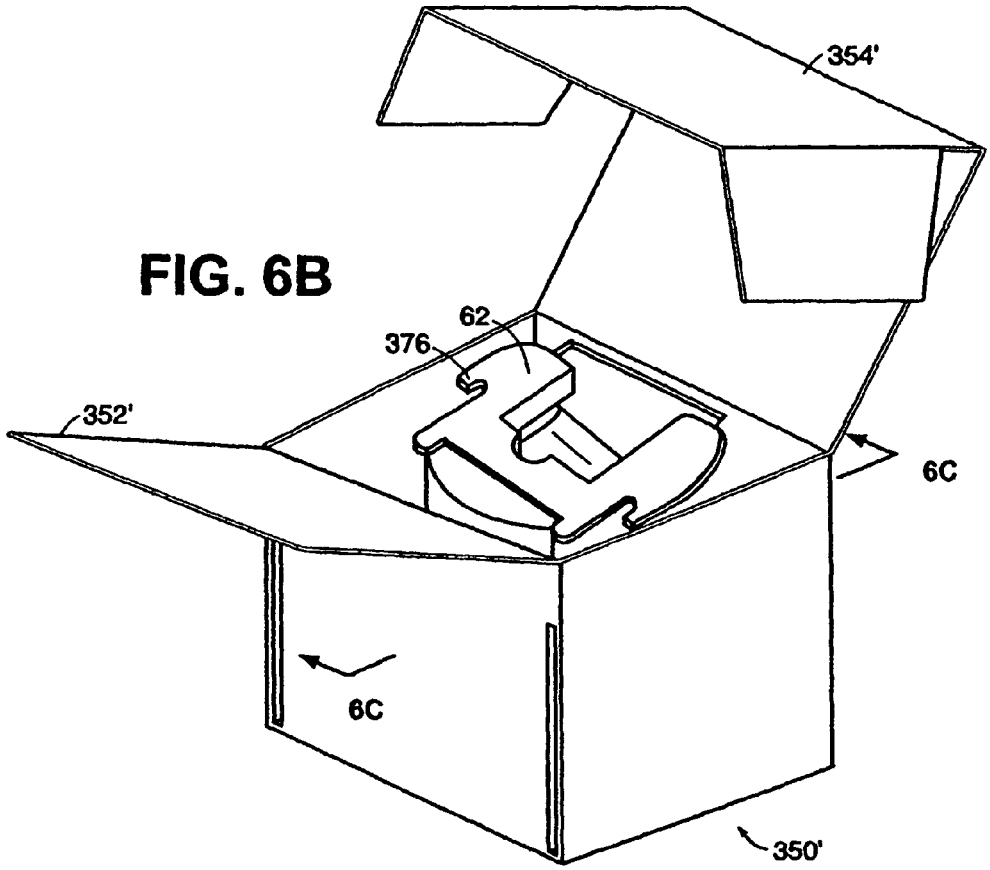
FIG. 6B is an isometric view of a container that can be used for a subassembly of a flusher conversion kit.
Figure 6C:
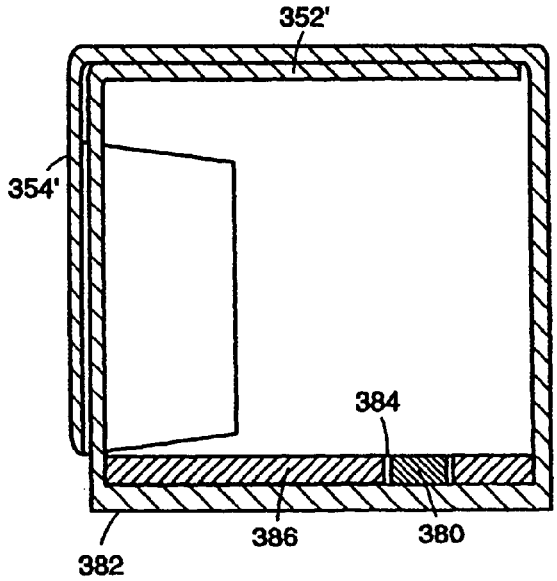
FIG. 6C is a cross section taken at line 6C-6C of FIG. 6B.
Figure 6D:
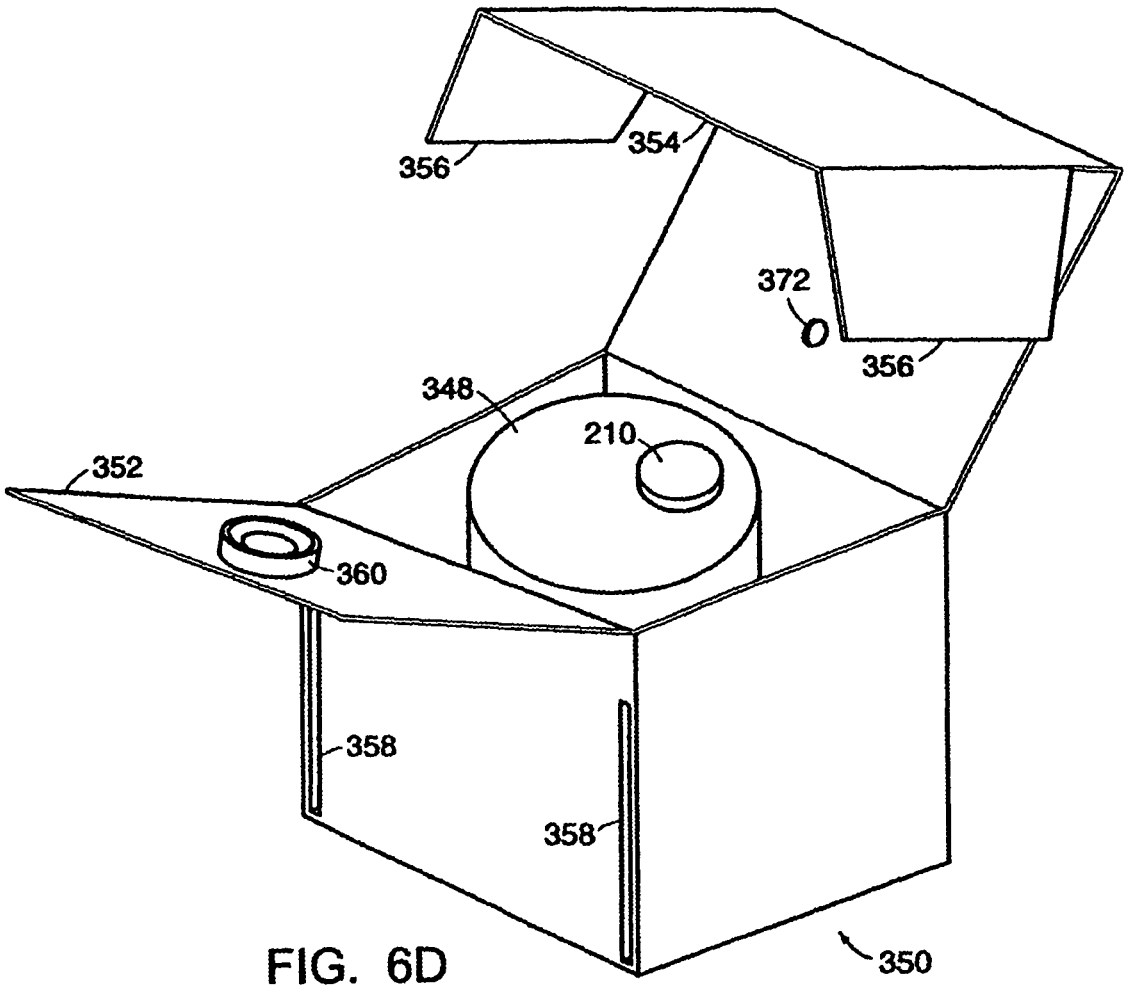
FIG. 6D is an isometric view of a container that may be employed for a flusher conversion kit of the type depicted in FIG. 2 or FIG. 3.
Figure 6E:
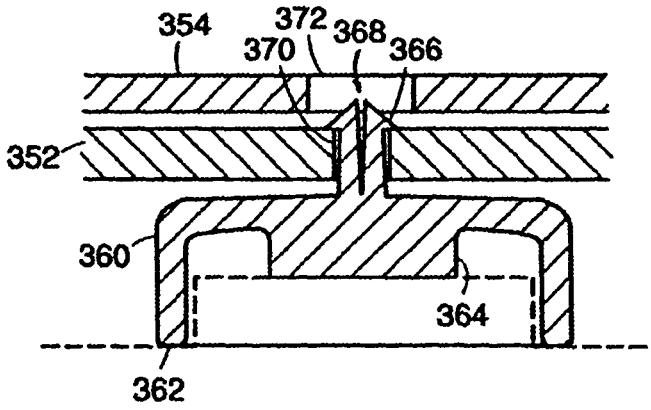
FIG. 6E is a detailed cross section of a button-depression device included in a container.

FIG. 6E is a detailed cross-sectional view of the button activator 360 showing it mounted on the inner flap 352 with the outer flap 354 closed over it. The illustrated activator 360 is typically a generally circular plastic part. It forms an annular stop ring 362, which engages the top of the flow controller's housing 146 (FIG. 2A) to ensure that a central protuberance 364 depresses the push button by only the correct amount. To mount the activator 360 in the inner flap, it is provided with a barbed post 366. Post 366 forms a central slot 368 that enables it to deform so that its barbs can fit through a hole 370 in the inner flap 352. The outer flap 354 forms another hole 372 to accommodate the barbed post 366.

Other arrangements may place the button actuator elsewhere in the container. It may be placed on the container's bottom wall, for example, and the force of the top flaps against the flow controller.

Now, it sometimes occurs that the batteries are placed into the circuit even before it is assembled into the housing, and the circuit with the batteries installed may need to be shipped to a remote location for that assembly operation. Since there is as yet no housing, the circuitry cannot be kept asleep by keeping the housing's button depressed. For such situations, an approach that FIGS. 6B and 6C depict can be employed.

FIG. 6B is a view similar to FIG. 6D, but the contents 376 of FIG. 6B's package 350' are only a subset of the kit 348 that the package 350 contains. They may, for instance, exclude FIG. 2's housing 146 as well as the pressure cap 24 and the solenoid and pilot-valve members mounted on it. So the package 350' in the FIG. 6B embodiment does not include a button activator like the one that the box 350 includes. Instead, as FIG. 6C shows, a magnet 380 is glued to the inner surface of the package 350's bottom wall 382, and a hole 384 in an insert board 386 that rests on the bottom wall 382 receives the magnet.

The circuit assembly 376, which FIG. 6C omits for the sake of simplicity, is so placed into the package that the circuit's reed switch is disposed adjacent to the magnet. That switch is therefore closed just as it is when the push button is operated, and the circuit therefore remains asleep.

Figure 15:
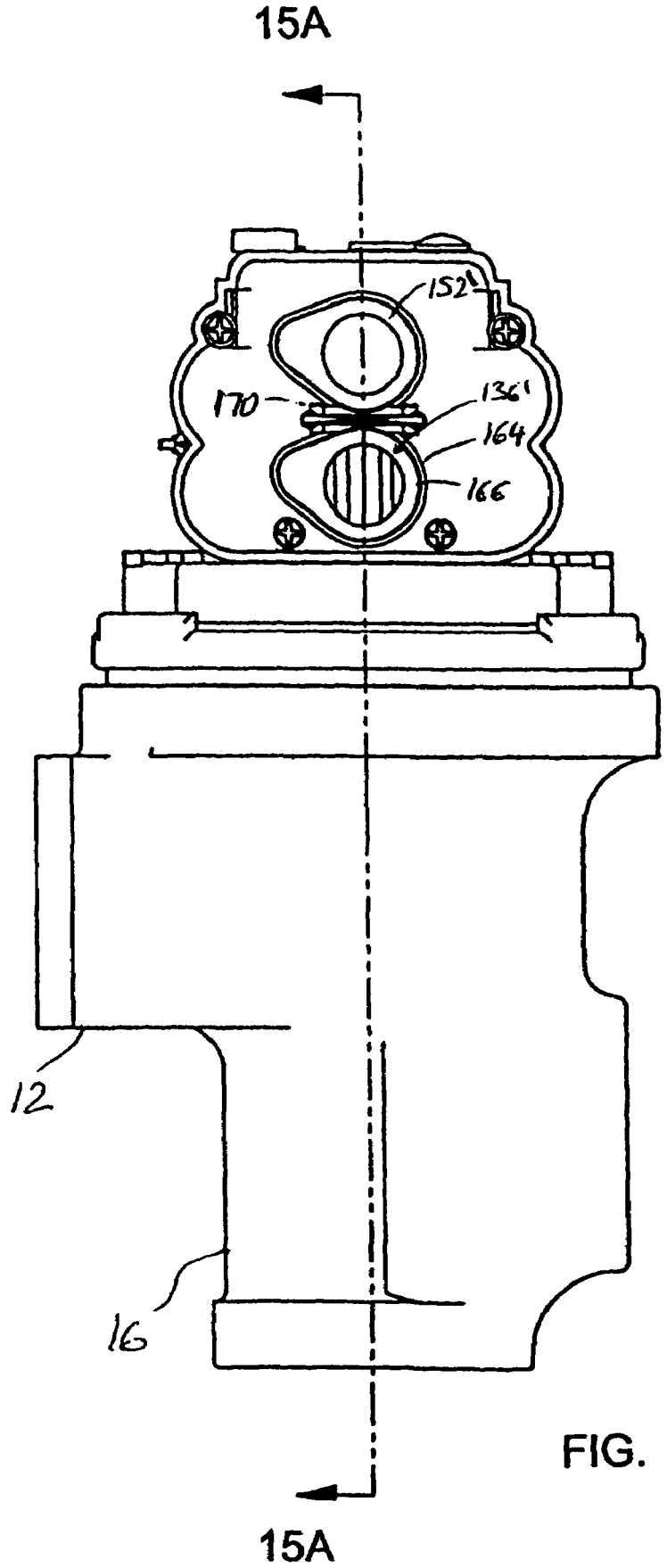
FIG. 15 is a front view of another embodiment of an automatic flusher and FIG. 15A is a cross-section taken at line 15A-15A in FIG. 15.
Figure 15A:
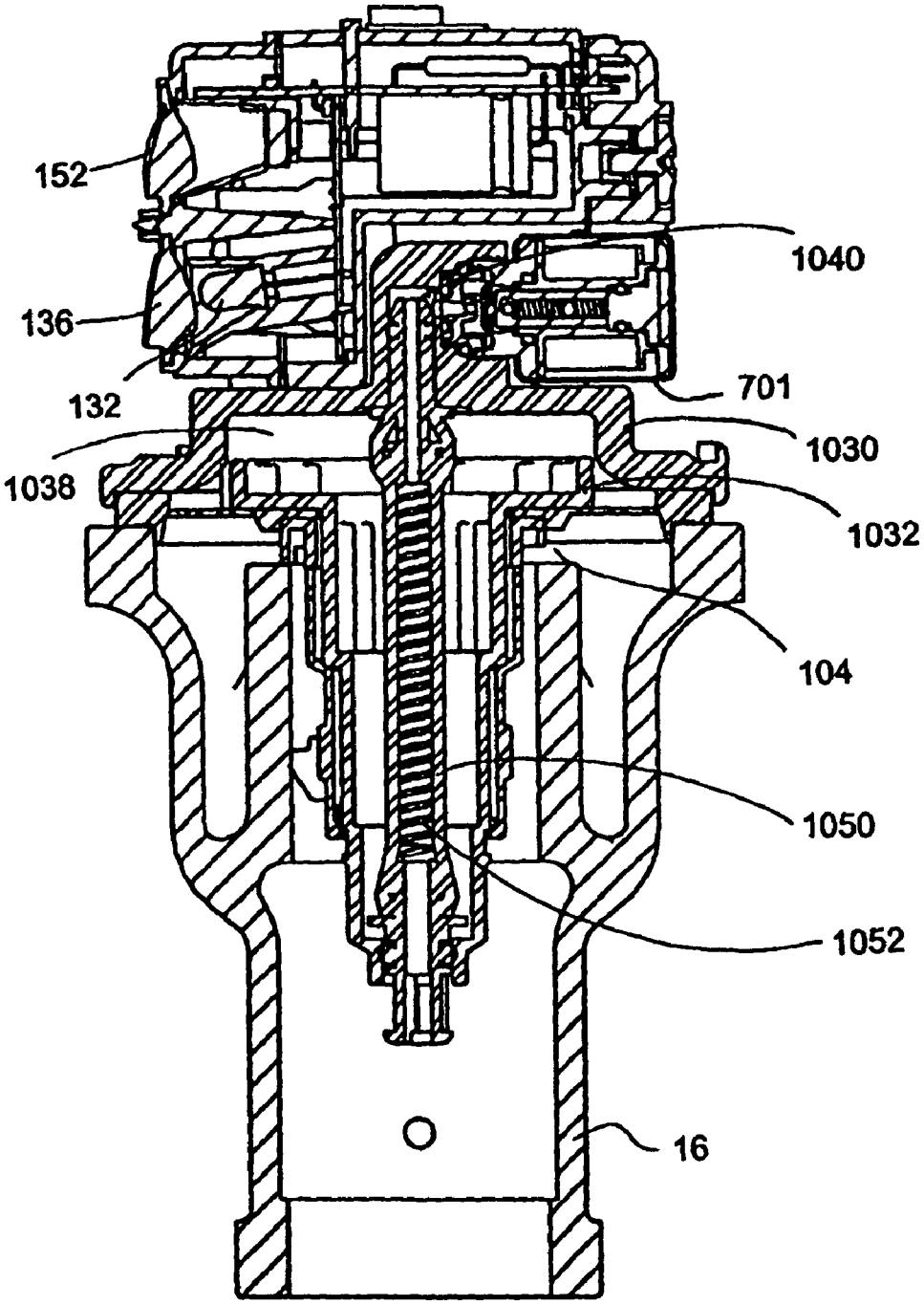

FIGS. 15 and 15A illustrate another embodiment of an automatic flusher including a flexible tube that eliminates dynamic seal 38 used in the flusher described in connection with FIG. 2. The automatic controller shown schematically in FIG. 15 transmitter and receiver lenses and front circuit-housing part (see FIG. 6) described above. The automatic flusher includes the isolated operator 701 in a side (perpendicular) position.

The flush valve body is indicated at 10 and may have an inlet opening 12 and a bottom directed outlet opening 14. The area between the underside of the inner cover 1030 and the upper side of the diaphragm 1032 forms a pressure chamber 1038. The pressure of the water within this chamber holds the diaphragm 1032 upon a seat 1040 formed at the upper end of barrel which forms a conduit between the inlet 12 and the outlet 14.

Details of this operation are disclosed in U.S. Pat. No. 5,244,179, as well as in U.S. Pat. Nos. 4,309,781 and 4,793,588. Water flow through the inlet 12 reaches the pressure chamber 38 through a filter and bypass ring, the details of which are disclosed in U.S. Pat. No. 5,967,182. Thus, water from the flush valve inlet reaches the pressure chamber, to maintain the diaphragm in a closed position, and the pressure chamber will be vented by the operation of the solenoid as water will flow upwardly through passage 44 (FIG. 2A), then into chamber 46 and then through the passage in the flex tube as described in U.S. Pat. No. 6,382,586, which is incorporated by reference.

The flex tube 1050 is hollow and in the form of a flexible sleeve. The sleeve includes a coiled spring 1052, which prevents the tube from collapsing due to water pressure flowing downwardly through the disc of the assembly. At its upper end, the flex tube 1050 is attached to an inner cover adaptor or another element.

Seated on top of the upper end of the guide is a refill head with the diaphragm 1032 being captured between the upper surface of the refill head and a lower surface of a radially outwardly extending portion of the disc. The diaphragm, the disc and the guide, will all move together when pressure is relieved in chamber 1038 and the diaphragm moves upwardly to provide a direct connection between flush valve inlet 12 and flush valve outlet 14. When this takes place, the disc will move up and will carry with it the lower end of the flex tube 1050. Thus, the flex tube must bend as its upper end is fixed within the passage of the inner cover 1030. However, the flex tube always provides a reliable vent passage for operation of the valve assembly.

What is claimed is:

1. A bathroom flusher comprising:

a valve body having an inlet coupled to a water pipe and an outlet, a valve assembly in said body positioned to close water flow between said inlet and outlet upon sealing action of a moving member at a valve seat thereby controlling flow from said inlet to said outlet, an actuator including a solenoid coil and an armature housing constructed to receive a linearly movable armature constructed to be displaced between extended and retracted positions by a drive current delivered to said solenoid coil and thereby control said sealing action of said moving member, and a control circuitry, including a microcontroller, constructed and arranged to provide said drive current for actuating operation of said moving member, said microcontroller being connected to provide signals to and receive signals from said control circuitry and, said microcontroller being programmed to calculate water pressure in said water pipe at said inlet, based on a latch time of said linearly movable armature, and thereby control amount of water delivered by the bathroom flusher by initiating closing of said water flow after prior opening of said water flow by said moving member.

2. The bathroom flusher of claim 1 wherein said moving member is a high flow rate diaphragm constructed to linearly move within a valve cavity.

3. The bathroom flusher of claim 1 wherein said moving member is a diaphragm.

4. The bathroom flusher of claim 1 wherein said moving member is a piston.

5. A bathroom flusher including:

a valve body having an inlet coupled to a water pipe and an outlet, a valve assembly in said body positioned to close water flow between said inlet and outlet upon sealing action of a moving member at a valve seat thereby controlling flow from said inlet to said outlet, a pressure chamber located within said valve body arranged to provide control water pressure to said moving member;

a flexible member having one end fixed relative to said pressure chamber and another end of said flexible member being attached to said moving member of said valve assembly, wherein there is a passage in said flexible member arranged to reduce pressure in said pressure chamber;

an actuator including a solenoid coil and an armature housing constructed to receive a linearly movable armature constructed to be displaced between extended and retracted positions by a drive current delivered to said solenoid coil and thereby control said sealing action of said moving member, and a control circuitry, including a microcontroller, constructed and arranged to provide said drive current for actuating operation of said moving member, said microcontroller being connected to receive signals from said control circuitry, and said microcontroller being programmed to calculate water pressure in said water pipe at said inlet, based on a latch time of said linearly movable armature, and thereby control amount of water delivered by the bathroom flusher by initiating closing of said water flow after prior opening of said water flow by said moving member.

6. The bathroom flusher of claim 5 wherein said moving member is a high flow rate diaphragm constructed to linearly move within a valve cavity.

7. The bathroom flusher of claim 5 wherein said moving member is a diaphragm.

8. The bathroom flusher of claim 5 wherein said moving member is a piston.

9. The bathroom flusher of claim 1 wherein said control circuitry includes a sensor constructed to detect voltage induced by said linearly movable armature and said microcontroller is connected to receive a signal corresponding to said voltage.

10. The bathroom flusher of claim 9 wherein said sensor is constructed and arranged to detect changes to said drive current due to movement of said armature.

11. The bathroom flusher of claim 9 wherein said sensor includes a resistor arranged to receive at least a portion of said drive current, and a voltmeter constructed to measure voltage across said resistor.

12. The bathroom flusher of claim 9 wherein said sensor includes a coil sensor constructed and arranged to detect said voltage induced by movement of said armature.

13. The bathroom flusher of claim 12 wherein said coil sensor is connected in a feedback arrangement to a signal conditioner providing conditioned signal to said microcontroller.

14. The bathroom flusher of claim 13 wherein said signal conditioner includes a preamplifier and a low-pass filter.

15. The bathroom flusher of claim 9 wherein said sensor includes two coil sensors each constructed and arranged to detect said voltage induced by movement of said armature.

16. The bathroom flusher of claim 15 wherein said two coil sensors are connected in a feedback arrangement to a differential amplifier constructed to provide a differential signal to said microcontroller.

17. The bathroom flusher of claim 1 wherein said actuator is a latching actuator.

18. The bathroom flusher of claim 17 wherein said latching actuator further includes a bias spring positioned and arranged to bias said armature toward an extended position providing a closed passage state without any drive signal being delivered to said solenoid coil.

19. The bathroom flusher of claim 1 wherein said control circuitry further including a presence sensor connected to provide signals to said microcontroller.

20. The bathroom flusher of claim 5 wherein said control circuitry includes a sensor constructed to detect voltage induced by said linearly movable armature and said microcontroller is connected to receive a signal corresponding to said voltage.

21. The bathroom flusher of claim 20 wherein said sensor is constructed and arranged to detect changes to said drive current due to movement of said armature.

22. The bathroom flusher of claim 20 wherein said sensor includes a resistor arranged to receive at least a portion of said drive current, and a voltmeter constructed to measure voltage across said resistor.

23. The bathroom flusher of claim 20 wherein said sensor includes a coil sensor constructed and arranged to detect said voltage induced by movement of said armature.

24. The bathroom flusher of claim 5 wherein said actuator is a latching actuator.

25. The bathroom flusher of claim 24 wherein said latching actuator further includes a bias spring positioned and arranged to bias said armature toward an extended position providing a closed passage state without any drive signal being delivered to said solenoid coil.

26. The bathroom flusher of claim 5 wherein said control circuitry further including a presence sensor connected to provide signals to said microcontroller.

27. The bathroom flusher of claim 1 further including an optical sensor constructed to detect a user.

28. The bathroom flusher of claim 27, wherein said optical sensor includes:

a light emitter constructed and arranged to emit light to a selected direction; and a light detector constructed and arranged to detect light corresponding to a reflection of the emitted light from said user; wherein said microcontroller is further constructed to direct light emission from said light emitter and constructed to receive signal from said light detector corresponding to the detected light.

29. The bathroom flusher of claim 28, wherein said microcontroller is constructed to provide said drive current based on first detecting arrival of the target and then detecting departure of the target.

30. The bathroom flusher of claim 28, wherein said microcontroller is constructed to provide said drive current based on relative movement of the target with respect to the light source and detector.

31. The bathroom flusher of claim 28, wherein said microcontroller is constructed to provide said drive current based on detecting presence of the target.

32. The bathroom flusher of claim 5 further including an optical sensor constructed to detect a user.

33. The bathroom flusher of claim 32, wherein said optical sensor includes:

a light emitter constructed and arranged to emit light to a selected direction; and a light detector constructed and arranged to detect light corresponding to a reflection of the emitted light from said user; wherein said microcontroller is further constructed to direct light emission from said light emitter and constructed to receive signal from said light detector corresponding to the detected light.

* * * * *